US010496028B2

(12) United States Patent
Minagawa et al.

(10) Patent No.: US 10,496,028 B2
(45) Date of Patent: Dec. 3, 2019

(54) IMAGE FORMING APPARATUS

(71) Applicant: CANON KABUSHIKI KAISHA, Tokyo (JP)

(72) Inventors: Taisuke Minagawa, Suntou-gun (JP); Yusaku Iwasawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/130,174

(22) Filed: Sep. 13, 2018

(65) Prior Publication Data

US 2019/0101859 A1 Apr. 4, 2019

(30) Foreign Application Priority Data

Sep. 29, 2017 (JP) ..... 2017-190398
Sep. 29, 2017 (JP) ..... 2017-190431

(51) Int. Cl.
*G03G 21/00* (2006.01)
*G03G 15/00* (2006.01)

(52) U.S. Cl.
CPC ..... *G03G 21/0005* (2013.01)

(58) Field of Classification Search
USPC ..... 399/71
See application file for complete search history.

(56) References Cited

U.S. PATENT DOCUMENTS 5,732,310 A 3/1998 Hiroshima et al.
8,891,986 B2 * 11/2014 Kawaguchi ..... G03G 15/0157 399/45
9,977,363 B2 5/2018 Hirado et al.
2006/0210334 A1 * 9/2006 Tokumasu ..... G03G 21/0005 399/346
2014/0356006 A1 * 12/2014 Adachi ..... G03G 21/0064 399/50
2017/0351201 A1 12/2017 Nakai et al.
2018/0149993 A1 * 5/2018 Tetsuno ..... G03G 15/0266
2018/0253051 A1 9/2018 Nakai et al.

FOREIGN PATENT DOCUMENTS

JP 3267507 B2 3/2002
JP 2016-004140 A 1/2016

* cited by examiner

*Primary Examiner* — Quana Grainger
(74) *Attorney, Agent, or Firm* — Venable LLP

(57) ABSTRACT

An image forming apparatus includes an image bearing member on which an electrostatic latent image is formed; an image bearing member charging unit which applies an image bearing member charging voltage; a developer bearing member to which developing voltage for developing the electrostatic latent image on the image bearing member is applied and which bears and transports a developer; a primary transfer unit which transfers a developer image on the image bearing member to an intermediate transfer member; and a charging member which charges the developer on the intermediate transfer member. The developer image is first primarily transferred and then secondarily transferred to a recording material. The image forming apparatus operates in a first mode in which a residual developer on the intermediate transfer member after the secondary transfer is electrostatically removed from the intermediate transfer member, and a second mode.

35 Claims, 21 Drawing Sheets

IMAGE FORMING APPARATUS

BACKGROUND OF THE INVENTION

Field of the Invention

The present invention relates to an image forming apparatus.

Description of the Related Art

In recent years, more and more image forming apparatuses such as printers, copiers, and facsimile machines are being adapted to process color. An intermediate transfer system image forming apparatus is known as an apparatus that forms a color image. In an intermediate transfer system image forming apparatus, after a developer (toner) image is transferred from an intermediate transfer member (an intermediate transfer belt) to a recording material, untransferred toner remains on the intermediate transfer member. The untransferred toner (secondary untransferred toner) on the intermediate transfer member is removed from the intermediate transfer member and recovered by an intermediate transfer member cleaning unit.

Japanese Patent No. 3267507 proposes providing, as an intermediate transfer member cleaning unit, a charging unit which charges secondary untransferred toner on an intermediate transfer member with a reverse polarity to a normal charging polarity of toner. In this case, the secondary untransferred toner is charged with a reverse polarity to the normal charging polarity of toner. The charged toner is reverse-transferred from the intermediate transfer member to an image bearing member (a photosensitive drum) in a primary transfer unit of the image forming unit and eventually recovered by a cleaning blade on the photosensitive drum.

In addition, Japanese Patent Application Laid-open No. 2016-004140 proposes a cleaning unit of an intermediate transfer member in an image forming apparatus adopting an in-line system. In Japanese Patent Application Laid-open No. 2016-004140, in order to recover toner remaining on an intermediate transfer belt after a paper jam (jamming), voltage applied to a charging member and voltage applied to a primary transfer unit are set to a same polarity as the normal charging polarity of toner.

In this case, the toner remaining on the intermediate transfer belt after jamming without being secondarily transferred has the normal charging polarity of the toner and, at the same time, an amount of the remaining toner is larger than that of secondary untransferred toner during an image formation period. Therefore, when attempting to recover toner by applying voltage with a reverse polarity to the normal charging polarity of the toner with a charging unit as proposed in Japanese Patent No. 3267507, it is difficult to properly charge all of the reverse-polarity, high-volume toner and, consequently, there is a risk that faulty cleaning may occur.

In consideration thereof, in Japanese Patent Application Laid-open No. 2016-004140, as described above, voltage with a same polarity as the normal charging polarity of toner is applied to a charging member after jamming. Accordingly, the toner on the intermediate transfer belt passes through the charging member while maintaining its polarity, and the toner is reverse-transferred from the photosensitive drum in the primary transfer unit and properly removed from the intermediate transfer belt.

A cleaning unit such as that described in Japanese Patent Application Laid-open No. 2016-004140 is useful not only after jamming but also when performing cleaning after a density adjusting mode. The density adjusting mode is a mode for optimizing image formation conditions by forming a test patch on an intermediate transfer member and measuring density and chromaticity of the test patch with an optical sensor. Since the test patch remains on an intermediate transfer belt without being secondarily transferred, the test patch can be properly removed from the intermediate transfer belt by setting voltage applied to a charging member and voltage applied to a primary transfer unit to a same polarity as the normal charging polarity of toner in a similar manner to cleaning after jamming.

Patent Literature 1: Japanese Patent No. 3267507

Patent Literature 2: Japanese Patent Application Laid-open No. 2016-004140

SUMMARY OF THE INVENTION

It was found that setting voltage applied to a charging member and voltage applied to a primary transfer unit to a same polarity as the normal charging polarity of toner in order to clean toner remaining on an intermediate transfer belt during a non-image formation period such as after jamming and after a density adjusting mode has the following problems.

When cleaning toner on an intermediate transfer belt, a minute amount of a "fogging developer (fogging toner)" may be inadvertently transferred from an image forming unit having a developing unit onto an intermediate transfer member. "Fogging toner" as used herein refers to toner which is inadvertently transferred to a region where an electrostatic latent image is not formed on a photosensitive drum and which also tends not to have a proper charge quantity due to deterioration or the like. Therefore, even during cleaning after jamming or after the density adjusting mode which is a non-image formation period in which an electrostatic latent image is not formed, the "fogging toner" may be inadvertently transferred to a photosensitive drum and, further, to the intermediate transfer belt. An example of means for preventing the "fogging toner" from being transferred to a photosensitive drum during cleaning after jamming or after the density adjusting mode is a method involving mechanically separating a developing unit from a photosensitive drum during cleaning. However, with an image forming apparatus in which a separation mechanism of a developing unit is not provided for the purpose of cost reduction or an image forming apparatus in which separation of the developing unit cannot be realized during cleaning due to other constraints, the "fogging toner" may end up being transferred to a photosensitive drum and, further, to the intermediate transfer belt.

When the "fogging toner" is transferred to the intermediate transfer belt in this manner, the "fogging toner" cannot be charged by a charging member during cleaning after jamming or after the density adjusting mode due to the following reasons. Therefore, the "fogging toner" continues to remain on the intermediate transfer belt even after cleaning is finished. That is, the "fogging toner" cannot be charged during cleaning after jamming or after the density adjusting mode because a bias high enough to charge the toner cannot be applied to the charging member.

Specifically, a bias with a same polarity as residual toner (toner not secondarily transferred) having a normal polarity is applied to the charging member during cleaning after jamming or after the density adjusting mode in order to prevent the residual toner from adhering to the charging member due to electrostatic repulsion. At this point, the bias applied to the charging member is a bias for allowing the residual toner to pass through and a bias high enough to charge the toner need not be applied. Conversely, applying an excessively high bias ends up excessively charging the residual toner, and an increase in a reflection force of the residual toner with respect to the intermediate transfer belt increases an electrostatic attachment force to the belt and may prevent the residual toner from being transferred to a photosensitive drum at the primary transfer unit. Therefore, an absolute value of the bias applied to the charging member during cleaning is set to a value that is lower than an absolute value of a bias applied during an image formation period. As a result, the "fogging toner" transferred onto the intermediate transfer belt ends up remaining on the intermediate transfer belt without being properly charged by the charging member.

However, if an amount of the "fogging toner" remaining on the intermediate transfer belt is large, when the "fogging toner" is charged by the charging member with a reverse polarity to the normal charging polarity of toner during a subsequent image formation period, there may be cases where all of the "fogging toner" cannot be recovered by the primary transfer unit. In such a case, a stain (faulty cleaning) attributable to the "fogging toner" is created on an output image. To begin with, the "fogging toner" is toner with low chargeability which has not been properly charged by the developing unit and is toner that is difficult to properly charge even with the charging member provided on the intermediate transfer belt.

In addition, the amount of the "fogging toner" tends to increase as toner deteriorates and, particularly at the end of a lifetime of the image forming unit, the frequency of occurrence of faulty cleaning attributable to the "fogging toner" tends to increase.

In consideration thereof, for the purpose of preventing faulty cleaning due to the "fogging toner" remaining on the intermediate transfer belt, the "fogging toner" can conceivably be recovered by carrying out a method such as the following once cleaning after jamming or after the density adjusting mode is completed. That is, the belt is rotated several turns in a state where a bias with a reverse polarity to the normal charging polarity of toner is applied to the charging member, the "fogging toner" is charged gradually, and the "fogging toner" is recovered by the primary transfer unit. However, there is a concern with this method that a period of time from an end of processing of jamming to a start of a next print or a period of time from an end of execution of the density adjusting mode to a start of a next print may increase.

As described above, in recent years where demands for reduction in downtime are growing, faulty cleaning attributable to the "fogging toner" during cleaning after jamming or after the density adjusting mode has become a major problem.

The present invention has been made in consideration of the problems described above. An object of the present invention is to reduce fogging toner to be transferred to an intermediate transfer belt during cleaning of an image forming apparatus.

Another object of the present invention is to reduce fogging toner to be transferred to an intermediate transfer member during cleaning of the intermediate transfer member during a non-image formation period without increasing downtime required by the cleaning.

The present invention provides an image forming apparatus, comprising:

an image bearing member on which an electrostatic latent image is formed;

an image bearing member charging unit which applies image bearing member charging voltage for charging the image bearing member;

a developer bearing member to which developing voltage is applied and which bears and transports a developer in order to develop the electrostatic latent image formed on the image bearing member;

a primary transfer unit which primarily transfers a developer image developed on the image bearing member to an intermediate transfer member; and a charging member which applies voltage to the intermediate transfer member so that a developer on the intermediate transfer member can be charged, the developer image being first primarily transferred to the intermediate transfer member by the primary transfer unit and then secondarily transferred to a recording material from the intermediate transfer member to form an image on the recording material, wherein the image forming apparatus operates in:

a first mode in which a developer remaining on the intermediate transfer member after the developer image is secondarily transferred to the recording material is charged by the charging member and electrostatically removed from the intermediate transfer member; and a second mode in which the intermediate transfer member is driven in a state in which an absolute value of voltage applied to the charging member is smaller than in the first mode, and in which the developer bearing member and the image bearing member are in contact with each other, and a difference in potential between developing voltage and image bearing member charging voltage in the second mode differs from a difference in potential between developing voltage and image bearing member charging voltage in the first mode.

The present invention also provides an image forming apparatus, comprising:

an image bearing member on which an electrostatic latent image is formed;

a developer bearing member which bears a developer for developing the electrostatic latent image formed on the image bearing member;

a developer control member which controls an amount of the developer on the developer bearing member;

an intermediate transfer member which is provided with a transfer unit and in which a developer image developed on the image bearing member is primarily transferred to the transfer unit due to the transfer unit and the image bearing member coming into contact with each other and the developer image is further secondarily transferred from the transfer unit to a recording material due to the transfer unit and the recording material coming into contact with each other;

a charging member which charges a developer on the intermediate transfer member; and a cleaning unit capable of executing a cleaning mode in which a developer remaining on the intermediate transfer member after being secondarily transferred from the intermediate transfer member to the recording material is charged by the charging member and removed from the intermediate transfer member, wherein when executing the cleaning mode during a non-image formation period in which an image is not formed, the cleaning unit reduces an absolute value of voltage applied to the charging member and, at the same time, sets a difference in potential ΔVb of voltage applied to the developer control member relative to voltage applied to the developer bearing member to a value on a side of a same polarity as a normal charging polarity of the developer, as compared to when executing the cleaning mode during an image formation period in which an image is formed.

The present invention also provides an image forming apparatus, comprising:

an image bearing member on which an electrostatic latent image is formed;

a developer bearing member which bears a developer for developing the electrostatic latent image formed on the image bearing member;

a developer supplying member which supplies the developer to the developer bearing member;

an intermediate transfer member which is provided with a transfer unit and in which a developer image developed on the image bearing member is primarily transferred to the transfer unit due to the transfer unit and the image bearing member coming into contact with each other and the developer image is further secondarily transferred from the transfer unit to a recording material due to the transfer unit and the recording material coming into contact with each other;

a charging member which charges a developer on the intermediate transfer member; and a cleaning unit capable of executing a cleaning mode in which a developer remaining on the intermediate transfer member after being secondarily transferred from the intermediate transfer member to the recording material is charged by the charging member and removed from the intermediate transfer member, wherein when executing the cleaning mode during a non-image formation period in which an image is not formed, the cleaning unit reduces an absolute value of voltage applied to the charging member and, at the same time, sets a difference in potential ΔVs of voltage applied to the developer supplying member relative to voltage applied to the developer bearing member to a value on a side of an opposite polarity to a normal charging polarity of the developer, as compared to when executing the cleaning mode during an image formation period in which an image is formed.

The present invention also provides an image forming apparatus, comprising:

an image bearing member on which an electrostatic latent image is formed after a surface of the image bearing member is charged;

a developer bearing member which bears a developer for developing the electrostatic latent image formed on the image bearing member;

an intermediate transfer member which is provided with a transfer unit and in which a developer image developed on the image bearing member is primarily transferred to the transfer unit due to the transfer unit and the image bearing member coming into contact with each other and the developer image is further secondarily transferred from the transfer unit to a recording material due to the transfer unit and the recording material coming into contact with each other;

a transfer member for primarily transferring the developer image from the image bearing member to the intermediate transfer member;

a charging member which charges a developer on the intermediate transfer member; and a cleaning unit capable of executing a cleaning mode in which a developer remaining on the intermediate transfer member after being secondarily transferred from the intermediate transfer member to the recording material is charged by the charging member and removed from the intermediate transfer member, wherein when executing the cleaning mode during a non-image formation period in which an image is not formed, the cleaning unit reduces an absolute value of voltage applied to the charging member and, at the same time, varies an absolute value of a difference in potential Vback between voltage applied to the developer bearing member and surface voltage prior to formation of an electrostatic latent image on the charged image bearing member, as compared to when executing the cleaning mode during an image formation period in which an image is formed.

As described above, according to the present invention, fogging toner to be transferred to an intermediate transfer belt during cleaning of an image forming apparatus can be reduced.

According to a further configuration of the present invention, fogging toner to be transferred to an intermediate transfer member during cleaning of the intermediate transfer member during a non-image formation period can be reduced without increasing downtime required by the cleaning.

Further features of the present invention will become apparent from the following description of exemplary embodiments with reference to the attached drawings.

DESCRIPTION OF THE EMBODIMENTS

Figure 1:
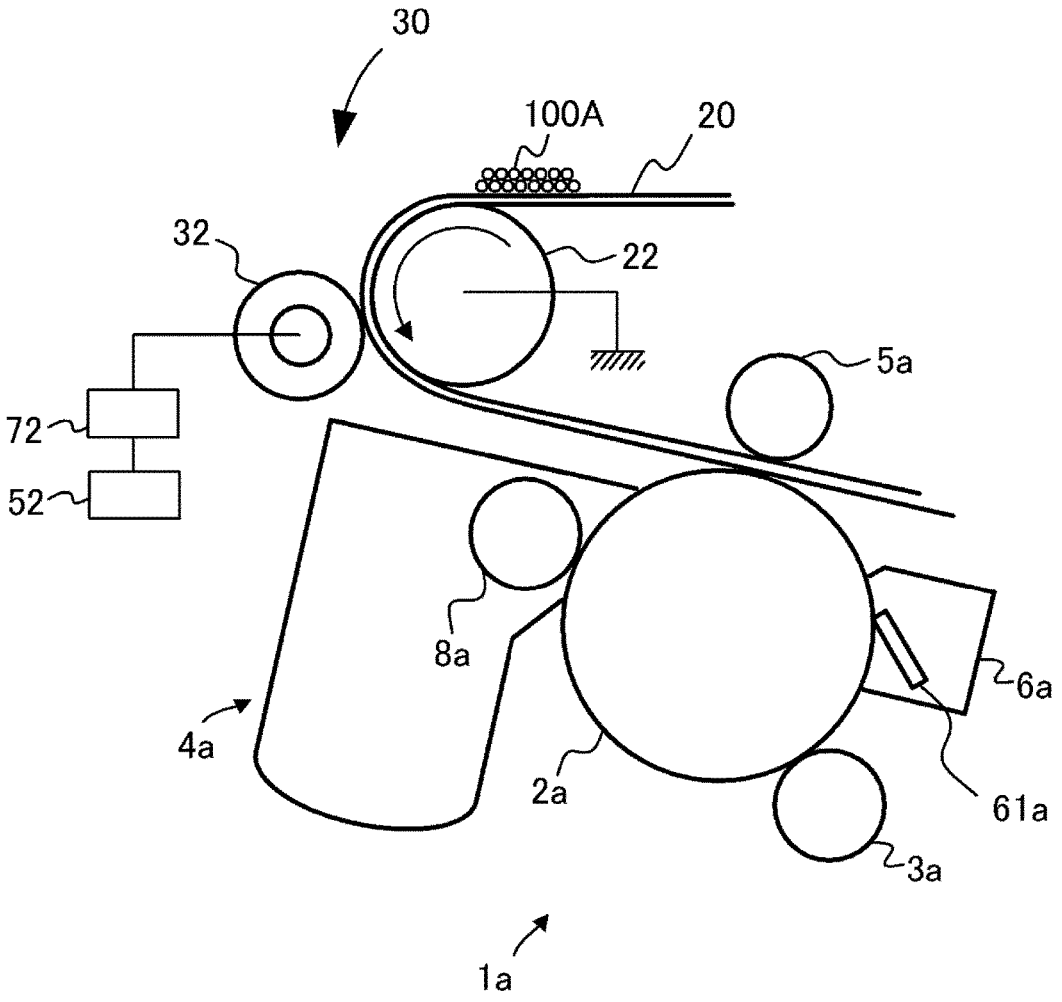
FIG. 1 is an explanatory diagram of a cleaning mechanism of an intermediate transfer belt in a first embodiment.

Hereinafter, preferred embodiments of the present invention will be described with reference to the drawings. However, it is to be understood that dimensions, materials, shapes, relative arrangements, and the like of components described below are intended to be changed as deemed appropriate in accordance with configurations and various conditions of apparatuses to which the present invention is to be applied. Therefore, the scope of the present invention is not intended to be limited to the embodiments described below.

First Embodiment

Fogging Toner

First, a "fogging developer (fogging toner)" will be described. When cleaning toner on an intermediate transfer belt, a minute amount of the "fogging toner" may be inadvertently transferred from an image forming unit having a photosensitive drum and a developing unit onto an intermediate transfer member. The "fogging toner" as used herein refers to toner which is inadvertently transferred to a region where an electrostatic latent image is not formed on a photosensitive drum and which also tends not to have a proper charge quantity due to deterioration or the like. Therefore, even during cleaning after a paper jam ("jamming") or after a density adjusting mode which is a non-image formation period in which an electrostatic latent image is not formed, the "fogging toner" may be inadvertently transferred to a photosensitive drum and, further, to the intermediate transfer belt.

As described above, the "fogging toner" transferred to the intermediate transfer belt during the execution of cleaning after jamming or after the density adjusting mode is not readily charged by a charging member and may remain on the intermediate transfer belt even after the cleaning is finished. Studies carried out by the present inventors revealed that if an amount of the "fogging toner" remaining on the belt is large, when the "fogging toner" is charged by a charging member with a reverse polarity to a normal charging polarity of toner during a subsequent image formation period, there is a possibility that all of the "fogging toner" cannot be recovered by the primary transfer unit. As a result, faulty cleaning may occur.

To begin with, the "fogging toner" is toner with low chargeability which has not been properly charged by a developing member and may be considered toner that is difficult to charge even with the charging member provided on the intermediate transfer belt. At the same time, the "fogging toner" is also toner of which an amount transferred to the belt varies significantly even when a variation of voltage applied to the developing member is small and which the transfer amount to the belt is difficult to control.

One method of preventing the "fogging toner" from being transferred to a photosensitive drum during cleaning after jamming or after the density adjusting mode involves mechanically separating a developing member from a photosensitive drum during cleaning. However, providing a separation mechanism incurs an increase in cost. In addition, there may be cases where the developing member cannot be separated during cleaning due to other constraints. An example of such a case is when constantly having a developing roller 8 in contact with a photosensitive drum in order to reduce noise (blade squeal) due to minute vibrations generated by friction between the photosensitive drum and a drum cleaning blade.

In addition, in a conceivable method of preventing faulty cleaning due to the "fogging toner" remaining on the intermediate transfer belt, once cleaning after jamming or after the density adjusting mode is completed, the belt is rotated several turns in a state where voltage with a reverse polarity to the normal charging polarity of toner is applied to the charging member, the "fogging toner" is charged gradually, and the "fogging toner" is recovered by the primary transfer unit. However, with this method, there is a risk that downtime which is a period of time from an end of processing of jamming or an end of execution of the density adjusting mode to a start of a next print may increase.

As described above, reducing faulty cleaning attributable to the "fogging toner" during cleaning after jamming or the like while suppressing cost and downtime has become an issue.

(1) Image Forming Apparatus

Configuration and Function

An overall configuration of an image forming apparatus according to the present invention will be described with reference to FIG. 2.

Figure 2:
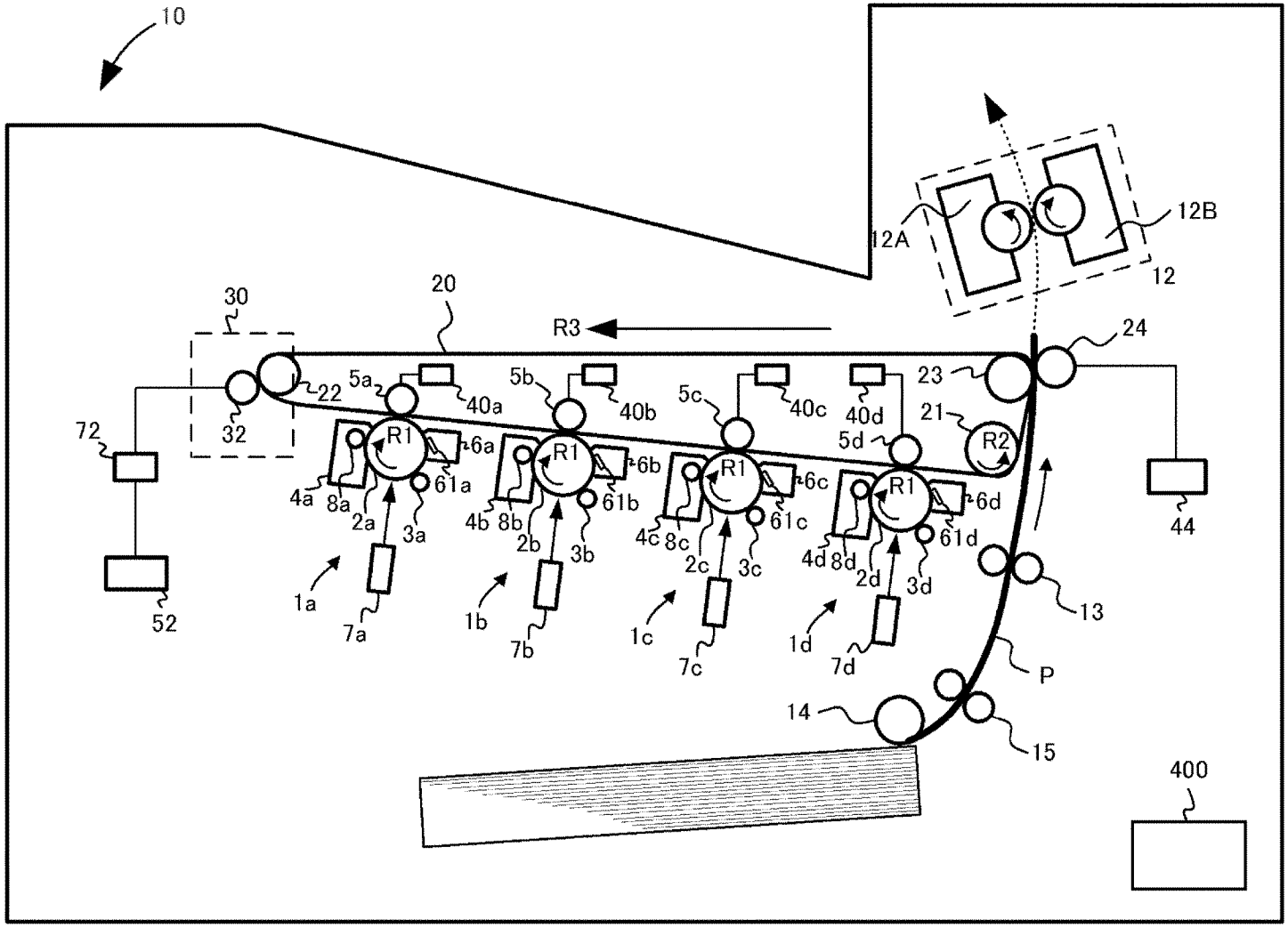
FIG. 2 is a schematic sectional view of an image forming apparatus in the first embodiment.

FIG. 2 is a schematic sectional view of an image forming apparatus 10 in the present embodiment. The image forming apparatus 10 according to the present embodiment is an in-line, intermediate-transfer full-color printer utilizing an electrophotographic system. In the present embodiment, the image forming apparatus 10 includes a plurality of image forming units. Specifically, the image forming apparatus 10 includes first, second, third, and fourth image forming stations (image forming units) 1*a*, 1*b*, 1*c*, and 1*d*. The first, second, third, and fourth image forming units 1*a*, 1*b*, 1*c*, and 1*d* respectively form an image of each of the colors of yellow, magenta, cyan, and black. The four image forming units 1*a*, 1*b*, 1*c*, and 1*d* are arranged in a single row at regular intervals.

Moreover, in the present embodiment, configurations of the first to fourth image forming units 1*a* to 1*d* are substantially the same with the exception of differences in colors of used developers (toners). Therefore, unless the image forming units must be distinguished from one another, the suffixes a, b, c, and d added to the reference characters in the drawings to indicate which color is to be produced by which element will be omitted and the image forming units will be collectively described.

A drum-type electrophotographic photosensitive member (photosensitive drum) 2 as an image bearing member on which a toner image (a developer image) is formed by an electrophotographic processing unit is installed in the image forming unit 1. As members constituting the electrophotographic processing unit, a drum charging roller 3 as an image bearing member charging unit, a developing apparatus 4 as a developing unit, a primary transfer roller 5 as a primary transfer unit, and a drum cleaning apparatus 6 as a photosensitive drum cleaning unit are installed around the photosensitive drum 2. In addition, an exposing apparatus (a laser scanner apparatus) 7 as an exposing unit is installed below a space between the drum charging roller 3 and the developing apparatus 4 as shown in the drawing.

In addition, an intermediate transfer belt 20 which is an intermediate transfer member with an endless belt-shape is arranged so as to oppose all of the photosensitive drums 2*a* to 2*d* of the respective image forming units 1*a* to 1*d*. The intermediate transfer belt 20 is stretched over a driver roller 21, a cleaning opposing roller 22, and a secondary transfer opposing roller 23 as a plurality of supporting members, and rotates in a direction of an arrow R3. Primary transfer rollers 5*a* to 5*d* are arranged so as to correspond to the respective photosensitive drums 2*a* to 2*d* of the respective image forming units 1*a* to 1*d* on a side of an inner circumferential surface of the intermediate transfer belt 20. In addition, a secondary transfer roller 24 as secondary transfer means is arranged at a position opposing the secondary transfer opposing roller 23 on a side of an outer circumferential surface of the intermediate transfer belt 20.

The photosensitive drum 2 in the present embodiment is a negative-charging OPC (organic photoconductor) photosensitive member, and includes a photosensitive layer on an aluminum drum substrate. The photosensitive drum 2 is rotationally driven by a drive apparatus (not shown) at a prescribed peripheral velocity (surface movement speed) in a direction of an arrow R1 (clockwise). In the present embodiment, the peripheral velocity of the photosensitive drum 2 corresponds to a processing speed of the image forming apparatus 10.

The drum charging roller 3 is in contact with the photosensitive drum 2 with a prescribed pressure contact force, and prescribed charging voltage is applied to the drum charging roller 3 from a charging voltage power supply (not shown) as a charging voltage applying unit so as to uniformly charge a surface of the photosensitive drum 2 to a prescribed potential. In the present embodiment, the photosensitive drum 2 is charged by the drum charging roller 3 with a negative polarity.

The exposing apparatus 7 exposes the surface of the photosensitive drum 2 to form an electrostatic latent image (an electrostatic image) in accordance with image information on the surface of the photosensitive drum 2 having been charged by the drum charging roller 3. In other words, in the exposing apparatus 7, laser light modulated in correspondence to a time-series electric digital pixel signal of image information input from a host computer (not shown) is output from a laser output unit, and the laser light is irradiated on the surface of the photosensitive drum 2 via a reflective mirror.

The developing apparatus 4 in the present embodiment uses a contact developing system as a developing system. The developing roller 8 (8*a*, 8*b*, 8*c*, and 8*d*) serves as a developer bearing member which bears and transports a developer. Toner borne in the form of a thin layer on the developing roller is transported to an opposing portion (a developing unit) to the photosensitive drum 2 as the developing roller 8 is rotationally driven by a driving unit (not shown). In addition, developing voltage is applied to the developing roller 8 from a developing voltage power supply (not shown) as a developing voltage applying unit in order to develop the electrostatic latent image formed on the photosensitive drum 2 as a toner image. Details of a configuration and operations of the developing apparatus 4 will be provided later.

In the present embodiment, the electrostatic latent image is developed by a reversal development system. Specifically, by causing toner charged with a same polarity as a charging polarity of the photosensitive drum 2 to adhere to a portion (an exposed portion) of which a charge has been attenuated by exposure on the uniformly-charged photosensitive drum 2, the electrostatic latent image on the photosensitive drum 2 is developed as a toner image. In the present embodiment, the normal charging polarity of toner is a negative polarity, and the toner forming a toner image has a mainly negative charge.

Toner of each of the colors of yellow, magenta, cyan, and black are respectively stored in the developing apparatuses 4*a*, 4*b*, 4*c*, and 4*d*. In a full-color image formation mode, all developing rollers 8 of the four developing apparatuses 4 come into contact with the photosensitive drum 2. In addition, in a monochrome (single color) image formation mode, developing rollers 8 of the developing apparatuses 4 other than the image forming unit that forms an image are configured to be separated from the photosensitive drum 2. This is done to prevent deterioration and wear of the developing rollers 8 and the toners.

In the present embodiment, PEN (polyethylene naphthalate) resin is used as the intermediate transfer belt 20 as a second image bearing member which bears a toner image. The intermediate transfer belt 20 has a surface resistivity of $5.0\times10^{11}\Omega/\square$ and a volume resistivity of $8.0\times10^{11}$ Ωcm.

In addition, a resin such as PVDF (vinylidene fluoride resin), ETFE (ethylene tetrafluoride-ethylene copolymer resin), polyimide, PET (polyethylene terephthalate), and polycarbonate constructed in an endless belt-shape can be used as the intermediate transfer belt 20. Alternatively, for example, a rubber base layer such as EPDM being coated with, for example, urethane rubber containing a dispersed fluororesin such as PTFE and being constructed in an endless belt-shape can be used as the intermediate transfer belt 20.

Due to the driver roller 21 being rotationally driven in a direction of an arrow R2 (counterclockwise) in the drawing, the intermediate transfer belt 20 circulates (rotates) at approximately the same speed as a peripheral velocity of the photosensitive drum 2 or, in other words, at a prescribed processing speed in a direction of an arrow R3 (counterclockwise) in the drawing.

The primary transfer roller 5 is constructed by an elastic member such as sponge rubber. In the present embodiment, a 6 mm-diameter nickel-plated steel rod coated with 4 mm-thick NBR hydrin rubber is used as the primary transfer roller. An electric resistance value of the primary transfer roller 5 is $1.0\times10^{5}\Omega$ when the primary transfer roller is pressed onto an aluminum cylinder with a force of 9.8 N, rotated at 50 mm/sec, and 100 V is applied thereto.

In addition, the primary transfer roller 5 comes into contact with the photosensitive drum 2 via the intermediate transfer belt 20 and forms a primary transfer nip unit (a primary transfer unit) in a contact portion between the intermediate transfer belt 20 and the photosensitive drum 2. Furthermore, the primary transfer roller 5 rotates so as to follow a movement of the intermediate transfer belt 20.

A primary transfer voltage power supply 40 as a primary transfer voltage applying unit is connected to the primary transfer roller 5, and primary transfer voltage is applied to the primary transfer roller 5 from the primary transfer voltage power supply 40. The primary transfer voltage power supply is capable of selectively applying voltage with positive and negative polarities. The toner image formed on the photosensitive drum 2 is transferred (primarily transferred) onto the rotating intermediate transfer belt 20 by the primary transfer roller 5 to which primary transfer voltage with a reverse polarity to the normal charging polarity (negative polarity) of toner is applied.

The secondary transfer roller 24 is constructed by an elastic member such as sponge rubber. In the present embodiment, a 6 mm-diameter nickel-plated steel rod coated with 6 mm-thick NBR hydrin rubber is used as the secondary transfer roller. An electric resistance value of the secondary transfer roller 24 is $3.0\times10^7\Omega$ when the secondary transfer roller is pressed onto an aluminum cylinder with a force of 9.8 N, rotated at 50 mm/sec, and 1000 V is applied thereto.

The secondary transfer roller 24 comes into contact with the secondary transfer opposing roller 23 via the intermediate transfer belt 20, and forms a secondary transfer nip unit (a secondary transfer unit) in a contact portion. The secondary transfer roller 24 rotates so as to follow a movement of the intermediate transfer belt or movements of the intermediate transfer belt and a sheet of paper P that is a recording material. A secondary transfer voltage power supply 44 as a secondary transfer voltage applying unit is connected to the secondary transfer roller 24, and secondary transfer voltage is applied to the secondary transfer roller from the secondary transfer voltage power supply 44. The secondary transfer voltage power supply is capable of selectively applying voltage with positive and negative polarities.

The toner image formed on the intermediate transfer belt 20 is transferred (secondarily transferred) onto the sheet of paper P having been transported to the secondary transfer nip unit by the secondary transfer roller 24 to which secondary transfer voltage with a reverse polarity to the normal charging polarity of toner is applied.

A belt cleaning unit 30 as an intermediate transfer member cleaning unit is installed on a downstream side of the secondary transfer unit on an outer side of the intermediate transfer belt 20. Details of a configuration and operations of the belt cleaning unit 30 will be provided later.

A resist roller 13, a transporting roller 15, and a paper feeding roller 14 which constitute a paper supplying unit are installed on an upstream side in a transport direction of the sheet of paper P of the secondary transfer unit.

In addition, a fixing apparatus 12 as a fixing unit is installed on a downstream side in the transport direction of the sheet of paper P of the secondary transfer unit. The fixing apparatus 12 includes a fixing roller 12A provided with a heat source and a pressure roller 12B which comes into pressure contact with the fixing roller 12A.

A control unit 400 is connected to the respective components of the image forming apparatus by control lines or the like (not shown), and operates the image forming apparatus by controlling start/end of operations, voltage/current settings, transmission/reception of information, and the like of the respective components. For example, the control unit 400 can be realized by computing resources such as an information processing circuit and a memory. The control unit 400 may exist outside of the image forming apparatus.

Image Forming Operation

Next, an image forming operation by the image forming apparatus 10 according to the present embodiment will be described using an example of a full-color image formation mode.

First, a toner image in each color is formed on the photosensitive drums 2*a* to 2*d* of the respective image forming units 1*a* to 1*d* by an electrophotographic process. Specifically, when an image forming operation start signal is issued, the photosensitive drums 2*a* to 2*d* being rotationally driven at a prescribed processing speed are respectively uniformly charged by the drum charging rollers 3*a* to 3*d*. Hereinafter, starting and ending operations, generation of an operation signal, and voltage and current control of each component of the apparatus are to be performed by the control unit 400 and/or circuits and the like controlled by the control unit 400.

Each exposing apparatus 7*a* to 7*d* converts an input color-separated color image signal into an optical signal at a laser output unit. In addition, each of the exposing apparatuses 7*a* to 7*d* scans and exposes a surface of each of the uniformly-charged photosensitive drums 2*a* to 2*d* with laser light that is the converted optical signal and forms an electrostatic latent image on each of the photosensitive drums 2*a* to 2*d*.

In the first image forming unit 1*a*, yellow toner from the developing apparatus 4*a* is electrostatically adsorbed in accordance with a potential of the surface of the photosensitive drum 2*a* and developed as a toner image.

Figure 3:
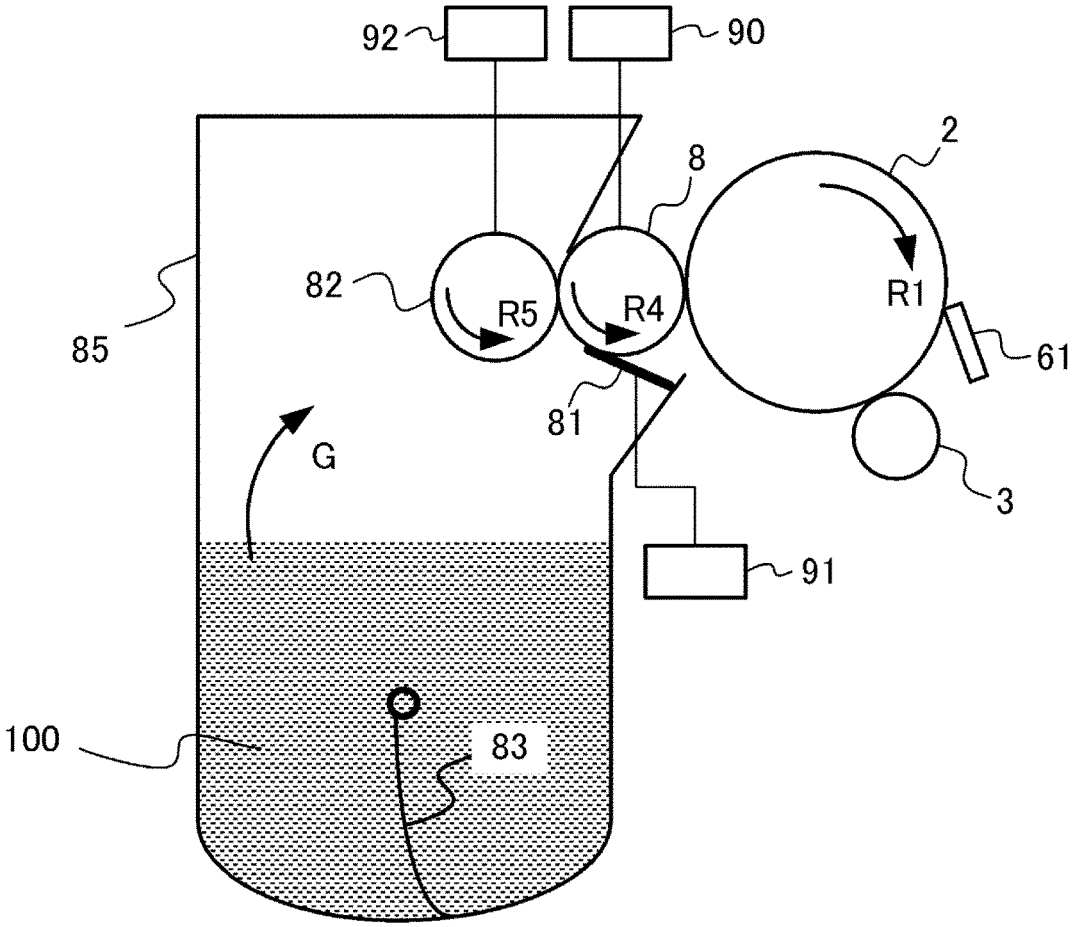
FIG. 3 is a schematic sectional view of an image forming unit in the first embodiment.

Hereinafter, a configuration of the developing apparatus 4 will be described in detail with reference to FIG. 3. FIG. 3 is a schematic sectional view of the image forming unit 1 according to the present embodiment as viewed from a longitudinal direction (a rotational axis direction) of the photosensitive drum 2.

The developing apparatus 4 is constituted by the developing roller 8, a developing blade 81, a toner supplying roller 82, toner 100, and a toner storage chamber 85 which stores the toner. As the toner 100, a non-magnetic spherical toner charged with a negative polarity as a normal polarity and having a particle size of 7 μm is used. In addition, silica particles (external additive particles) with a particle size of 20 nm are added as a toner external additive to the surface of the toner.

The developing blade 81 is in contact with the developing roller 8 in a counter direction, and regulates a coating amount of and imparts a charge to toner supplied by the toner supplying roller 82. The developing blade is formed of a thin plate-like member and creates contact pressure using spring elasticity of the thin plate, and a surface of the developing blade is brought into contact with the toner and the developing roller.

In the present embodiment, a 0.1 mm-thick, leaf spring-like SUS thin plate coated with a semiconductive resin is used as the developing blade 81, contact pressure is created using spring elasticity of the thin plate, and a surface of the developing blade 81 is brought into contact with the toner and the developing roller. Moreover, the developing blade is not limited thereto and a metal thin plate made of phosphor bronze, aluminum, or the like instead of SUS may be used. Alternatively, a metal thin plate coated with a semiconductive rubber instead of a semiconductive resin or an uncoated metal plate may be used.

In the present embodiment, prescribed voltage is applied to the developing blade 81 from a blade voltage power supply 91. Due to discharge between the developing blade and the developing roller and triboelectric charging by friction between the developing blade and the developing roller, a negative charge is imparted to the toner and, at the same time, a layer thickness of the toner is regulated. In the present embodiment, DC voltage is applied to the toner supplying roller from the blade voltage power supply so that a difference between a potential of the developing blade relative to a potential of the developing roller during image formation is ΔV=−100 V.

The toner supplying roller 82 is arranged so as to form a prescribed nip unit on a circumferential surface of the developing roller 8, and rotates in a direction of an arrow R5 (counterclockwise). The toner supplying roller is an elastic sponge roller in which a foam is formed on an outer circumference of a conductive core metal. The toner supplying roller and the developing roller are in contact with each other at a prescribed penetration level. Both rollers rotate so as to move in mutually opposite directions in a contact portion. Due to this operation, supply of toner to the developing roller by the toner supplying roller and stripping of toner remaining as development residue on the developing roller are performed. In doing so, a toner supply amount to the developing roller can be adjusted by adjusting a difference in potential of the toner supplying roller relative to the developing roller. In the present embodiment, DC voltage is applied to the toner supplying roller from a toner supply voltage power supply 92 so that the potential of the developing roller is ΔV=+50 V relative to the potential of the toner supplying roller.

A toner stirring member 83 is provided inside the toner storage chamber 85. The toner stirring member 83 is for stirring the toner stored in the toner storage chamber and also for transporting the toner in a direction of an arrow G in the diagram toward an upper part of the toner supplying roller. In the present embodiment, the developing roller 8 and the toner supplying roller 82 both have an outer diameter ϕ of 20 mm and a penetration level of the toner supplying roller with respect to the developing roller is set to 1.5 mm.

The developing roller 8 and the photosensitive drum 2 respectively rotate so that surfaces thereof move in a same direction (in the present embodiment, the directions of the arrows R1 and R4 in the drawings) in an opposing portion (contact portion).

In the present embodiment, DC voltage with a same polarity as the charging polarity (in the present embodiment, a negative polarity) of the photosensitive drum 2 is applied to the developing roller 8 from a developing voltage power supply 90. In the developing unit that comes into contact (sliding contact) with the photosensitive drum 2, due to the difference in potential between the developing roller 8 and the photosensitive drum 2, negatively charged toner is transferred only to a portion of the electrostatic latent image and develops the electrostatic latent image.

The yellow toner image developed on the photosensitive drum 2*a* is primarily transferred onto the rotating intermediate transfer belt 20 by the primary transfer roller 5*a* to which primary transfer voltage with a reverse polarity (in the present embodiment, a positive polarity) to the normal charging polarity of toner is applied in the primary transfer nip unit. The intermediate transfer belt 20 onto which the yellow toner image has been transferred moves to a side of the second image forming unit 1*b*.

In the second image forming unit 1*b*, a magenta toner image is formed on the photosensitive drum 2*b* in a similar manner to the first image forming unit 1*a*. In addition, the magenta toner image is primarily transferred in the primary transfer nip unit so as to overlap with the yellow toner image on the intermediate transfer belt 20.

In a similar manner, in the third and fourth image forming units 1*c* and 1*d*, the respective toner images of cyan and black are sequentially primarily transferred in the primary transfer nip unit so as to overlap with the respective toner images of yellow and magenta on the intermediate transfer belt 20.

As described above, a multiple toner image constituted by toner images of a plurality of colors having been primarily transferred so as to sequentially overlap with one another in the respective primary transfer nip units is formed on the intermediate transfer belt 20.

In accordance with a timing at which a leading edge of the toner image on the intermediate transfer belt 20 moves to a secondary transfer unit, a sheet of paper fed out by the paper feeding roller 14 is transported to the secondary transfer unit by the transporting roller 15 and the resist roller 13. In addition, in the secondary transfer unit, the multiple toner image on the intermediate transfer belt 20 is collectively secondarily transferred to the sheet of paper P by the secondary transfer roller 24 to which secondary transfer voltage with a reverse polarity (in the present embodiment, a positive polarity) to the normal charging polarity of toner is applied.

Subsequently, the sheet of paper P onto which the toner image has been transferred is transported to the fixing apparatus 12. The sheet of paper P bearing the toner image is heated and pressurized by a fixing nip unit between the fixing roller 12A and the pressure roller 12B installed inside the fixing apparatus 12. Accordingly, the toner image is thermally fixed (fused and fixed) to a surface of the sheet of paper P and a full-color image is formed on the sheet of paper P. Subsequently, the sheet of paper P is discharged to the outside of the image forming apparatus 10 and the series of image forming operations ends.

Toner (primary untransferred toner) that remains on the photosensitive drum 2 after the primary transfer process is removed and recovered from the photosensitive drum 2 by the drum cleaning apparatus 6. The drum cleaning apparatus 6 includes a drum cleaning blade 61 which is a plate-like member formed by an elastic body such as urethane rubber as a cleaning member and a recovered toner container which stores toner scraped off from the photosensitive drum 2 by the drum cleaning blade.

In addition, as will be described in detail later, toner (secondary untransferred toner) remaining on the intermediate transfer belt 20 after the secondary transfer process is removed and recovered from the intermediate transfer belt 20 by being uniformly charged with a positive polarity by the belt cleaning unit 30 and then reverse-transferred onto the photosensitive drum 2 by the primary transfer unit.

(2) Belt Cleaning Mechanism during Image Formation Period

The belt cleaning mechanism during an image formation period that constitutes a first mode in the present embodiment will be described in detail with reference to FIG. 1. As a general rule, the first mode is performed simultaneously with image formation. FIG. 1 is a schematic view showing a configuration of the belt cleaning unit 30. In the present embodiment, a charging roller 32 is included as a charging member of secondary untransferred toner. The charging roller 32 is positioned on a downstream side of the secondary transfer unit and an upstream side of the primary transfer unit in a movement direction (rotation direction) of the intermediate transfer belt 20.

As the charging roller 32 in the present embodiment, a 6 mm-diameter nickel-plated steel rod coated with a 5 mm-thick solid elastic body made of EPDM rubber dispersed with carbon is used. An electric resistance value of the charging roller 32 is $5.0\times10^{7}\Omega$ when the charging roller is pressed onto an aluminum cylinder with a force of 9.8 N, rotated at 50 mm/sec, and 500 V is applied thereto. The charging roller 32 is in contact with the intermediate transfer belt 20 and is pressed toward the cleaning opposing roller 22 with total pressure of 9.8 N.

As shown in FIG. 1, the charging roller 32 is electrically connected to a high-voltage power supply 52 via a current detection unit 72 and is configured so that voltage with a positive polarity and a negative polarity can be selectively applied thereto. During a belt cleaning operation, DC voltage with a positive polarity is output from the high-voltage power supply 52 to the charging roller 32. An output value of the DC voltage is controlled based on a current value detected by the current detection unit 72, and constant-current control is performed so that the current value is at a target current value set in advance. A value which does not cause the secondary untransferred toner to be excessively charged and does not cause an occurrence of faulty cleaning due to insufficient charging is selected as the target current value, and the target current value of the charging roller in the present embodiment is 30 μA. The charging roller (charging member) applies voltage to an intermediate transfer member so that a developer can be charged.

The toner on the intermediate transfer belt 20 prior to the secondary transfer process is charged with a negative polarity that is the same polarity as an electrified charge on the surface of the photosensitive drum 2 and is charged in a state where a variation in charge distribution is small. On the other hand, secondary untransferred toner 100A on the intermediate transfer belt after the secondary transfer process forms a distribution in which charge distribution has become broader and in which a peak has moved to a side of positive polarity that is an opposite polarity to the normal charging polarity of toner. As a result, the secondary untransferred toner is in a state where toner charged with a negative polarity, toner that is hardly charged, and toner charged with a positive polarity are present in a mixed manner.

During a cleaning operation, applying voltage with a positive polarity to the charging roller 32 causes a positive electric field to be formed from the charging roller 32 toward the intermediate transfer belt and effectively charges toner toward a side of positive polarity due to discharge between the charging roller 32 and the secondary untransferred toner.

The toner charged with a positive polarity by the charging roller 32 advances to the primary transfer nip unit of the first image forming unit 1*a*. In addition, due to an effect of primary transfer voltage with a positive polarity that is applied to the primary transfer roller 5*a* of the first image forming unit 1*a*, the toner is reverse-transferred to the photosensitive drum 2*a* of the first image forming unit 1*a* from the intermediate transfer belt. The toner reverse-transferred to the photosensitive drum 2*a* is subsequently recovered by a drum cleaning blade 61*a* of the drum cleaning apparatus 6*a*.

As described above, by uniformly charging the secondary untransferred toner with a positive polarity by the charging roller 32 and subsequently recovering the secondary untransferred toner with the primary transfer nip unit, the secondary untransferred toner can be removed from the intermediate transfer belt.

In addition, in order to prevent a decline in toner charging performance of the charging roller 32 due to toner adhering to the charging roller 32 when cleaning is repetitively performed, voltage with a same polarity (in the present embodiment, a negative polarity) as the normal charging polarity of the toner is applied to the charging roller during a non-image formation period. Most of the toner that adheres to the charging roller during cleaning has a negative polarity, and applying voltage with a negative polarity to the charging roller causes the toner having adhered to the charging roller to be electrostatically ejected to the intermediate transfer belt. Regularly performing this ejection process enables toner adhered to the charging roller to be removed and favorable cleaning performance to be maintained.

The toner ejected onto the intermediate transfer belt from the charging roller is reverse-transferred to the photosensitive drum in the primary transfer unit on the downstream side and recovered by the photosensitive member cleaning unit (the drum cleaning apparatus) 6. Specifically, in the image forming units 1*a* to 1*d* during the ejection process, by applying voltage with a negative polarity from the primary transfer voltage power supply 40 to the transfer roller 5 of at least one image forming unit, ejected toner with a negative polarity is reverse-transferred to the photosensitive drum and eventually removed from the photosensitive member by the drum cleaning blade on the photosensitive drum.

(3) Belt Cleaning Mechanism after Jamming or after Density Adjusting Mode

Figure 4A:
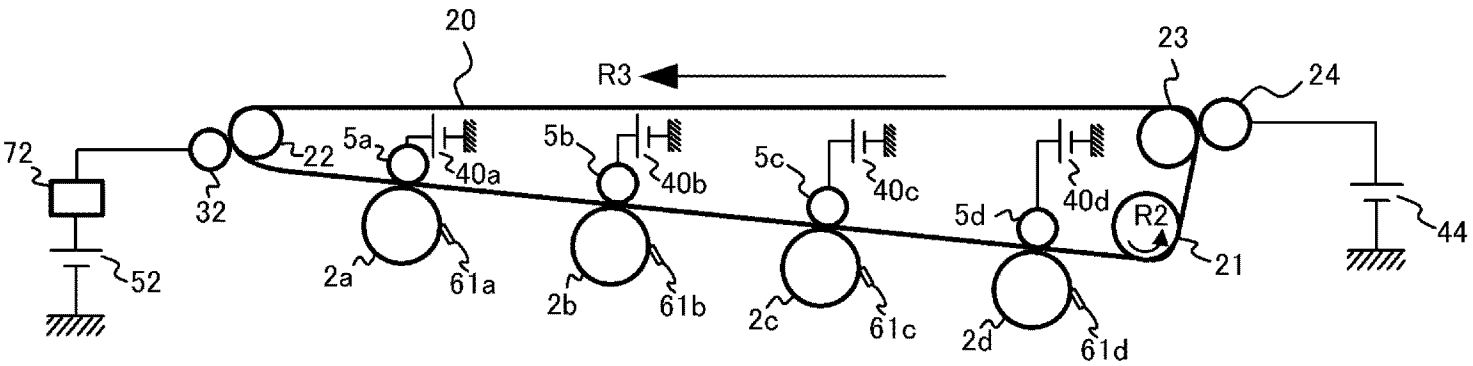
FIGS. 4A and 4B are schematic views for illustrating a polarity of voltage to be applied to the respective components in the first embodiment.
Figure 4B:
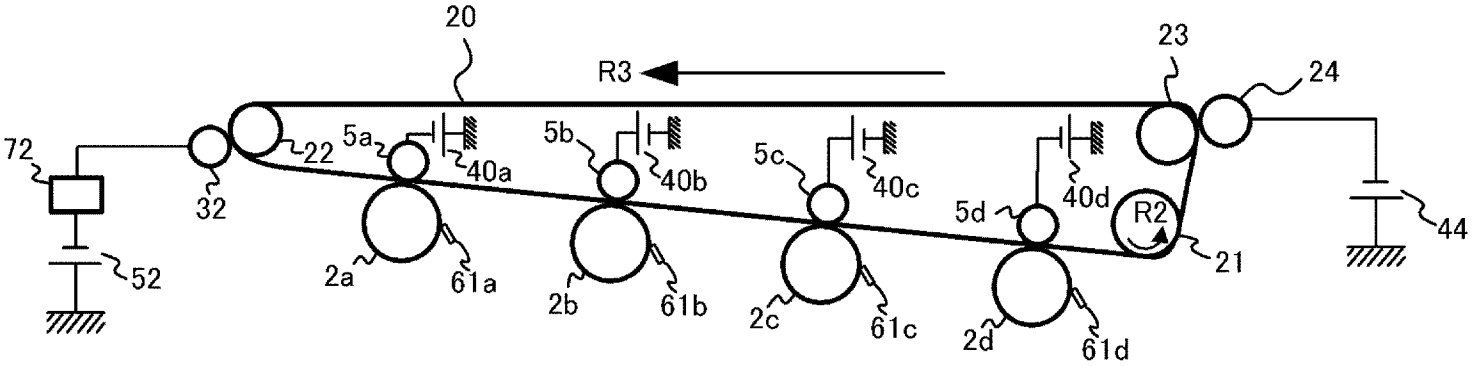

Next, the belt cleaning mechanism which is executed after jamming or after the density adjusting mode that constitutes a second mode in the present embodiment will be described in detail with reference to FIGS. 4A and 4B. FIG. 4A corresponds to the first mode described earlier and represents polarities of voltage applied to the charging roller 32 as a charging member, the primary transfer roller 5, and the secondary transfer roller 24 during image formation. FIG. 4B corresponds to the second mode and represents polarities of voltage applied to the charging roller 32, the primary transfer roller 5, and the secondary transfer roller 24 during belt cleaning executed after jamming or after the density adjusting mode.

In the first mode, as described above, voltage with a positive polarity is respectively applied to the charging roller 32, the primary transfer roller 5, and the secondary transfer roller 24. On the other hand, in the second mode, voltage with a negative polarity is applied to the charging roller 32, voltage with a negative polarity is applied to the secondary transfer roller 24, and with respect to the primary transfer roller 5, voltage with a negative polarity is applied in the first and fourth image forming stations but voltage with a positive polarity is applied in the second and third image forming stations.

Table 1 presents a summary of contents of operations, polarity settings, and voltage settings in cleaning during an image formation period and in cleaning after jamming or the like in the present embodiment. While a detailed description will be given later, although drum charging voltage and developing voltage of some image forming stations may be set the same as in the first mode, the drum charging voltage and the developing voltage of at least one image forming station are set differently from the first mode.

TABLE 1

(Polarity and voltage settings in respective operations of the first embodiment)

| | Image formation period | | After jamming/after |
|---|---|---|---|
| Operation | Image formation | Cleaning (first mode) | density adjusting mode Cleaning (second mode) |
| Primary transfer roller polarity | Positive polarity | | Set for each image forming station |
| Secondary transfer roller polarity | Positive polarity | | Negative polarity |

TABLE 1-continued (Polarity and voltage settings in respective operations of the first embodiment)

| Operation | Image formation period: Image formation | Image formation period: Cleaning (first mode) | After jamming/after density adjusting mode: Cleaning (second mode) |
|---|---|---|---|
| Charging roller polarity | Positive polarity | | Negative polarity |
| Drum charging voltage and developing voltage | Arbitrary setting | | Setting that differs from first mode for at least one image forming station |

Next, a reason for setting the polarity of voltage applied to each member as shown in FIG. 4B will be described.

Toner remaining on the intermediate transfer belt during jamming and a test patch in the density adjusting mode are toner that remains without having been secondarily transferred and has the normal charging polarity of toner (in the present embodiment, a negative polarity). In addition, an amount of such toner is larger than that of secondary untransferred toner during an image formation period. Therefore, even if voltage with a positive polarity is applied to the charging roller 32 as in the first mode, it is difficult to uniformly impart a positive polarity to all of the residual toner.

In consideration thereof, in the second mode, as shown in FIG. 4B, voltage with a negative polarity that is a same polarity as the residual toner is applied to the charging roller 32. Accordingly, residual toner is prevented by electrostatic repulsion from adhering to the charging roller without reversing the polarity of the residual toner. At this point, voltage which allows residual toner to pass through is sufficient as the voltage with a negative polarity to be applied to the charging roller and voltage high enough to charge the toner need not be applied. Conversely, applying an excessively high voltage with a negative polarity ends up excessively charging the residual toner, and a reflection force of the toner with respect to the intermediate transfer belt increases. As a result, an electrostatic attachment force of the toner to the belt increases and may prevent the residual toner from being transferred to a photosensitive drum 2 at the primary transfer unit. Therefore, an absolute value of the voltage with a negative polarity applied to the charging roller during cleaning is set to a value that is lower than an absolute value of the voltage with a positive polarity applied during an image formation period. In the present embodiment, while the voltage applied to the charging roller (voltage necessary for causing a target current of 30 μA to flow) during an image formation period is +1500 V, the voltage applied to the charging roller during cleaning is set to −500 V.

In a similar manner, voltage with a negative polarity is also applied to the secondary transfer roller 24 to prevent residual toner by electrostatic repulsion from adhering to the secondary transfer roller.

On the other hand, at the primary transfer roller 5, the polarity of applied voltage is changed for each image forming station. In other words, voltage with a negative polarity is applied to the primary transfer rollers 5*a* and 5*d* in the first and fourth image forming stations. Accordingly, residual toner having passed through the secondary transfer roller 24 and the charging roller 32 is electrostatically reverse-transferred to the photosensitive drums 2*a* and 2*d* and removed from the intermediate transfer belt. The reason for performing recovery of the residual toner with two image forming stations is to recover all residual toner at once even when an amount of the residual toner is large (for example, when jamming occurs during printing of a high-quality print image). In the present embodiment, residual toner which the first image forming station fails to recover is recovered by the fourth image forming station positioned downstream from the first image forming station.

In addition, voltage with a positive polarity is applied to the primary transfer rollers 5*b* and 5*c* in the second and third image forming stations. This is done in order to remove toner with a positive polarity which is contained in a minute amount in toner remaining on the intermediate transfer belt after jamming or after the density adjusting mode. For example, when jamming occurs, a part of the secondary untransferred toner present in an already secondarily-transferred region has been positively polarized due to voltage with a positive polarity which is applied from the secondary transfer roller during image formation. Such toner with a positive polarity is electrostatically transferred to the photosensitive drums 2*b* and 2*c* by applying voltage with a positive polarity to the primary transfer rollers 5*b* and 5*c*.

As described above, in belt cleaning after jamming or after the density adjusting mode, toner with a negative polarity which remains on the intermediate transfer belt is recovered by the primary transfer unit without charging the toner with a reverse polarity by the charging roller 32.

The polarity of the voltage applied to the primary transfer roller of each image forming station is not limited to the combination described in the present embodiment and can be optimized in accordance with an amount of the residual toner and recovery performance at the photosensitive drum 2. For example, when the amount of residual toner is small, a configuration may be adopted in which voltage with a negative polarity is only applied to the primary transfer roller 5*a* and voltage with a positive polarity is applied to the primary transfer rollers 5*b*, 5*c*, and 5*d*. Conversely, when the amount of residual toner is large, a configuration may be adopted in which voltage with a negative polarity is applied to the primary transfer rollers 5*a*, 5*c*, and 5*d* and voltage with a positive polarity is only applied to the primary transfer roller 5*b*.

In addition, when the amount of residual toner recovered by a specific image forming station is large, there is a risk that recovery failure (toner slipping through) at the drum cleaning blade 61 may occur. In consideration thereof, the recovery of the residual toner is favorably distributed among a plurality of image forming stations by adjusting periods of time during which voltage with a negative polarity is applied and application timings of the voltage. Since the recovery of the residual toner is performed while voltage with a negative polarity is being applied to the primary transfer roller, reducing a period of time of application of the voltage with a negative polarity in a specific image forming station enables a recovery amount of the residual toner by the image forming station to be reduced. For example, in the present embodiment, adjusting a period of time of application of voltage with a negative polarity to the primary transfer roller 5*a* and a period of time of application of the voltage with a negative polarity to the primary transfer roller 5*d* enables a toner amount to be recovered by the drum cleaning blades 61*a* and 61*d* to be adjusted and prevents a large amount of residual toner from being sent to one drum cleaning blade.

(4) Setting of Image Bearing Member Charging Voltage During Belt Cleaning after Jamming or after Density Adjusting Mode Next, a setting of image bearing member charging voltage (drum charging voltage) that is a feature of the present embodiment will be described in detail. A feature of the present embodiment is that a difference in potential between drum charging voltage and developing voltage in the second mode (during belt cleaning after jamming or after the density adjusting mode) is changed from a difference in potential during an image formation period. For example, in the present embodiment, while the difference in potential between the drum charging voltage and the developing voltage during an image formation period is 150 V, the difference in potential between the drum charging voltage and the developing voltage during belt cleaning after jamming or after the density adjusting mode is 180 V.

The reason for changing the difference in potential between the drum charging voltage and the developing voltage is to reduce an influence of a variation in voltage applied to the developing member and to keep an amount of fogging toner that is transferred to the intermediate transfer belt during belt cleaning after jamming or after the density adjusting mode at a low level in a stable manner.

As described earlier, fogging toner is derived from toner which has deteriorated due to wear of the developing apparatus, of which chargeability has declined, and which is no longer able to maintain a normal charge quantity on a developing roller as well as toner of which polarity has shifted to a side of positive polarity due to triboelectric charging with the photosensitive drum 2 on the developing roller. Such fogging toner has weak electrostatic repulsion relative to a region in which an electrostatic latent image is not formed on the photosensitive drum 2 and may be inadvertently transferred to a region in which an electrostatic latent image is not formed. Therefore, even during cleaning after jamming or after the density adjusting mode which is a non-image formation period in which an electrostatic latent image is not formed, fogging toner may be inadvertently transferred to the photosensitive drum 2 and, in turn, to the intermediate transfer belt 20 via the primary transfer nip unit.

In the present embodiment, during cleaning after jamming or after the density adjusting mode, the voltage applied to the charging roller 32 has a negative polarity and is not high enough to charge residual toner. Therefore, the fogging toner on the intermediate transfer belt 20 cannot be charged with a uniform polarity and a state exists where the fogging toner retains a lower charge quantity than a normal charge quantity. Accordingly, it is difficult to electrostatically reverse-transfer the fogging toner to the photosensitive drum 2 in the primary transfer unit. As a result, the fogging toner remains on the intermediate transfer belt 20 even after cleaning.

In the event where an amount of such residual fogging toner is large, it is difficult to uniformly impart a positive polarity to all of the fogging toner even if the fogging toner is charged with a positive polarity by the charging roller 32 to which voltage with a positive polarity has been applied when performing image formation after cleaning. This is because, to begin with, fogging toner is toner with low chargeability due to deterioration. Performing next image formation in this state creates a risk of the fogging toner being inadvertently transferred onto an output image. A conceivable countermeasure against this phenomenon is a method involving rotating the intermediate transfer belt several turns in a state where the charging roller 32 is subjected to constant-current control using voltage with a positive polarity to gradually charge the fogging toner with a positive polarity, and recovering the fogging toner with the primary transfer unit. However, this method results in a longer downtime.

In consideration thereof, in the present embodiment, a difference in potential between drum charging voltage and developing voltage during cleaning after jamming or after the density adjusting mode is changed from a difference in potential during an image formation period. Hereinafter, a reason for a stable reduction in an amount of fogging toner that is transferred to the intermediate transfer belt due to such a change in the difference in potential will be described in order with reference to (4-1) to (4-3).

Figure 5:
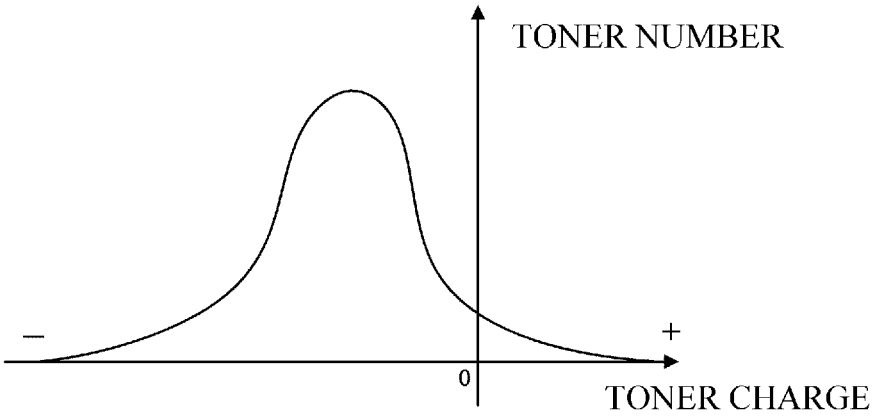
FIG. 5 is a schematic view of a charge quantity and a number distribution of toner on a developing roller in the first embodiment.

(4-1) Relationship Between Difference in Potential Between Drum Charging Voltage and Developing Voltage and Charging Polarity and Amount of "Fogging Toner" to be Transferred to Photosensitive Drum FIG. 5 is a graph schematically showing a charge quantity and a number distribution of toner existing on the developing roller 8. As shown in FIG. 5, in addition to toner charged with a negative polarity that is the normal charging polarity, toner with a negative polarity but having a small charge quantity and a minute amount of toner charged with a positive polarity exist on the developing roller 8. Whether or not such toner on the developing roller 8 is transferred onto the photosensitive drum as the "fogging toner" largely depends on a difference in potential between a surface potential (hereinafter, referred to as a dark-part potential Vd) of the photosensitive drum 2 charged by drum charging voltage and developing voltage. For the sake of simplicity, the following description is based on the assumption that a value of developing voltage is fixed to −350 V that is a setting adopted during an image formation period.

((1)) when Difference in Potential Between Dark-Part Potential Vd and Developing Voltage is within Proper Range For example, when the dark-part potential Vd is −500 V which is the setting during an image formation period and the difference in potential between the developing voltage and the dark-part potential Vd (hereinafter, a difference in potential obtained by subtracting the dark-part potential Vd from the developing voltage will be referred to as Vback) is around 150 V, the amount of fogging toner transferred to the photosensitive drum 2 is minimal. A detailed description will be given with reference to FIGS. 6A to 6E.

Figure 6A:
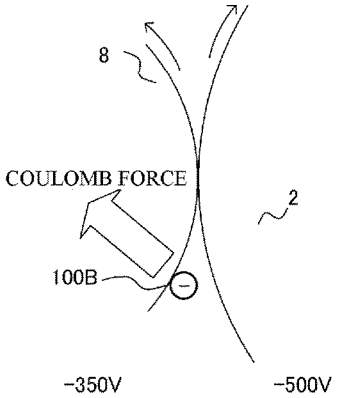
FIGS. 6A to 6E are explanatory diagrams of forces that act on toner and fogging toner in the first embodiment.
Figure 6B:
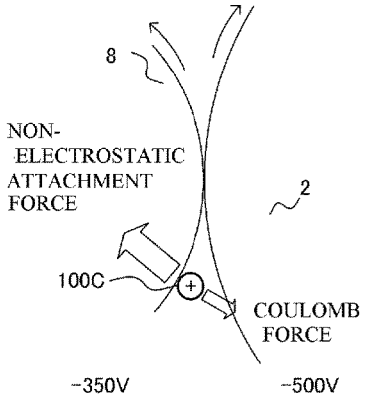
Figure 6C:
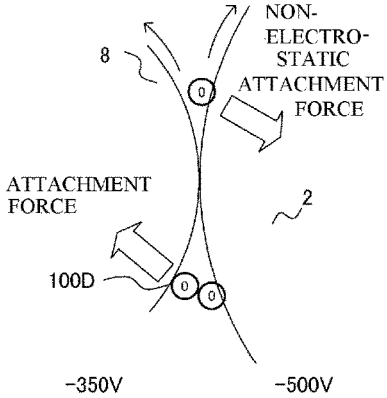

FIGS. 6A to 6C are schematic explanatory diagrams of the developing unit according to the first embodiment. FIG. 6A is an explanatory diagram schematically illustrating a force that acts on toner charged with a negative polarity. FIG. 6B is an explanatory diagram schematically illustrating a force that acts on toner charged with a positive polarity. FIG. 6C is an explanatory diagram schematically illustrating a force that acts on toner with a small charge quantity.

When Vback is around 150 V, with toner 100B charged with a negative polarity, since Coulomb force dominantly acts on the toner 100B and causes the toner 100B to be attracted to the developing roller 8, the toner 100B is hardly transferred to the photosensitive drum (FIG. 6A).

Toner 100C which is charged with a positive polarity and which exists in a minute amount is subjected to a force that attracts the toner 100C to the photosensitive drum 2 due to Coulomb force. However, when Vback is within a proper range, non-electrostatic attachment force with the developing roller 8 is larger than the Coulomb force. Therefore, most of the toner 100C remains on the developing roller 8 (FIG. 6B).

Toner 100D with a small charge quantity is less likely to be influenced by Coulomb force and a major portion thereof remains on the developing roller 8 due to a non-electrostatic attachment force with the developing roller 8 (a lower side of FIG. 6C). However, in a state where the toner amount is relatively large, a part of the toner may be influenced by the non-electrostatic attachment force with the photosensitive drum 2 and may be transferred onto the photosensitive drum 2 (an upper side of FIG. 6C).

Figure 6D:
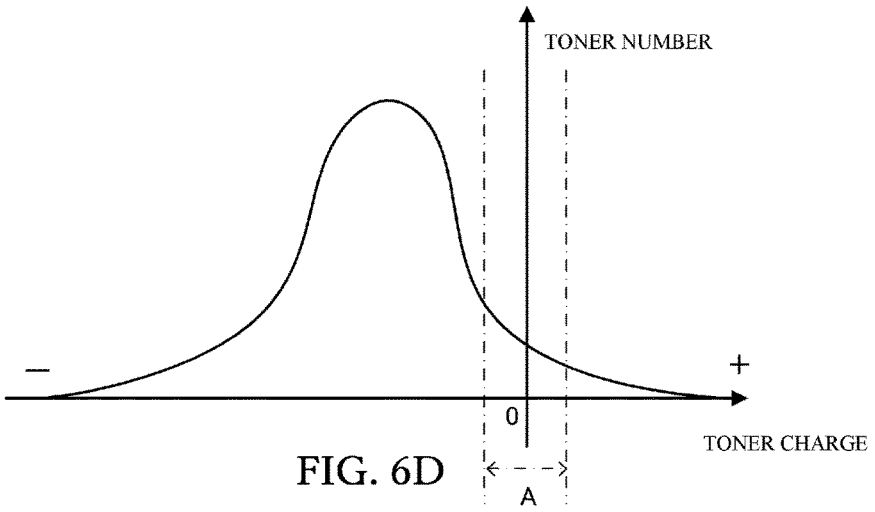
Figure 6E:
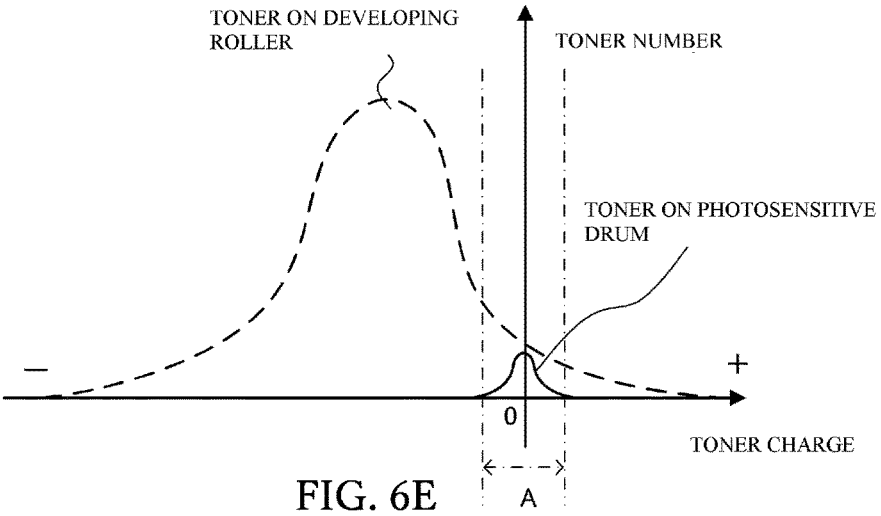

FIG. 6D is a schematic view illustrating a region of fogging toner transferred from the developing roller when the Vback value is within a proper range. FIG. 6E is a schematic view of a charge quantity and a number distribution of fogging toner transferred to the photosensitive drum when the Vback value is within a proper range.

In summary, as a charge quantity distribution of toner on the developing roller 8, the toner in a region "A" shown in FIG. 6D tends to be transferred to the photosensitive drum 2 as the "fogging toner". In addition, trends of a charge quantity distribution and a total amount of transferred the "fogging toner" are as shown in FIG. 6E.

((2)) When Difference in Potential Between Drum Charging Voltage and Developing Voltage is Relatively Small For example, when the dark-part potential Vd is −450 V of which an absolute value is smaller than the setting during an image formation period and the difference in potential Vback between the developing voltage and the dark-part potential Vd is around 100 V, the amount of the "fogging toner" to be transferred to the photosensitive drum 2 increases and charging polarity shifts to a negative side as compared to ((1)). A description will now be given with reference to FIGS. 7A and 7B.

Figure 7A:
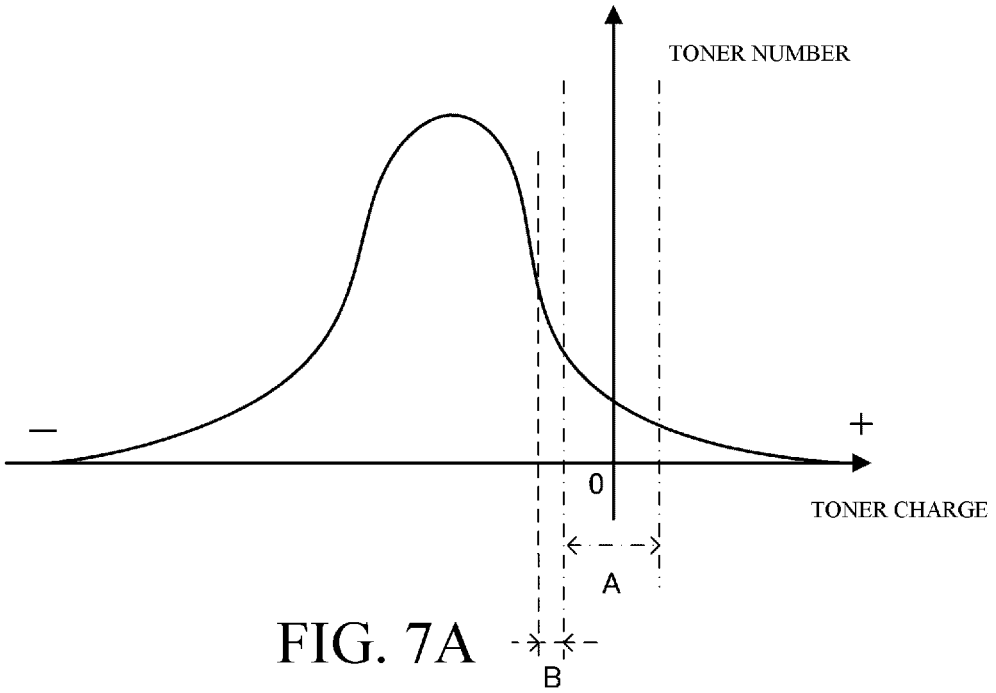
FIGS. 7A and 7B are schematic views of a case where a Vback value is relatively small in the first embodiment.
Figure 7B:
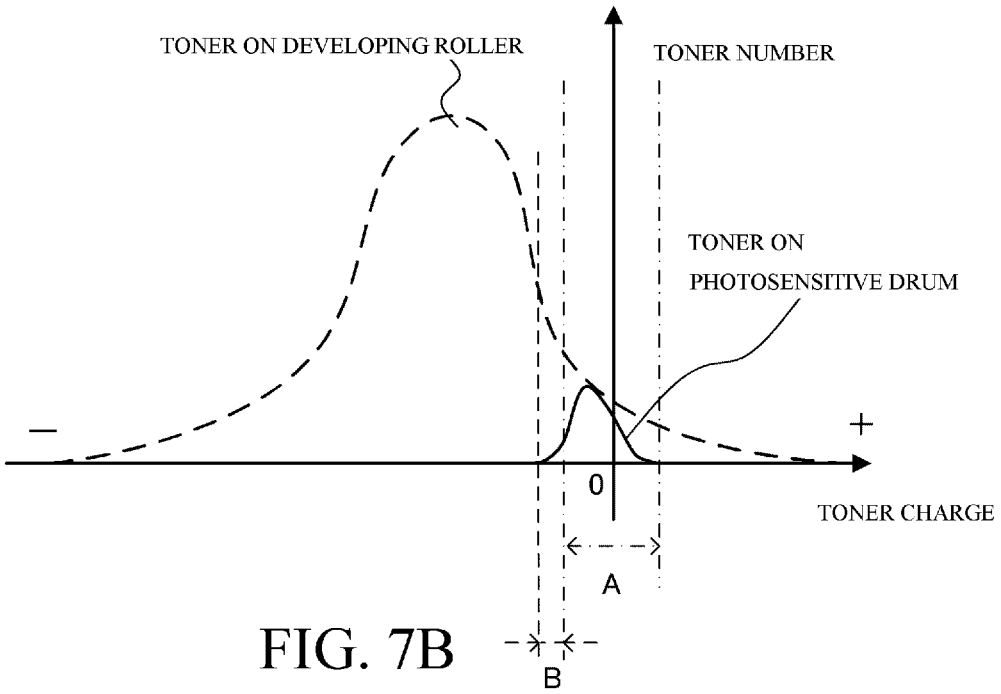

FIG. 7A is a schematic view illustrating a region of fogging toner transferred from the developing roller when the Vback value is relatively small. FIG. 7B is a schematic view of a charge quantity and a number distribution of fogging toner transferred to the photosensitive drum when the Vback value is relatively small.

When Vback is around 100 V, Coulomb force acting on toner charged with a negative polarity weakens as compared to the state of ((1)). Therefore, toner with a relatively small charge quantity in the toner charged with a negative polarity is also transferred to the photosensitive drum as the "fogging toner". Accordingly, toner in regions "A" and "B" shown in FIG. 7A are transferred to the photosensitive drum as the "fogging toner". In addition, trends in a charge quantity and a total amount of the "fogging toner" to be transferred are as shown in FIG. 7B and reveal that a transfer amount has increased and a charging polarity has shifted to a negative polarity as compared to the state of ((1)). Hereinafter, the "fogging toner" in a state where Vback is relatively small as described above will be referred to as "base fogging toner 100F".

((3)) When Difference in Potential Between Drum Charging Voltage and Developing Voltage is Relatively Large For example, when the dark-part potential Vd is −550 V of which an absolute value is larger than the setting during an image formation period and the difference in potential Vback between the developing voltage and the dark-part potential Vd is around 200 V, the amount of the "fogging toner" to be transferred to the photosensitive drum 2 increases and charging polarity shifts to a positive side as compared to ((1)). A description will now be given with reference to FIGS. 8A and 8B.

Figure 8A:
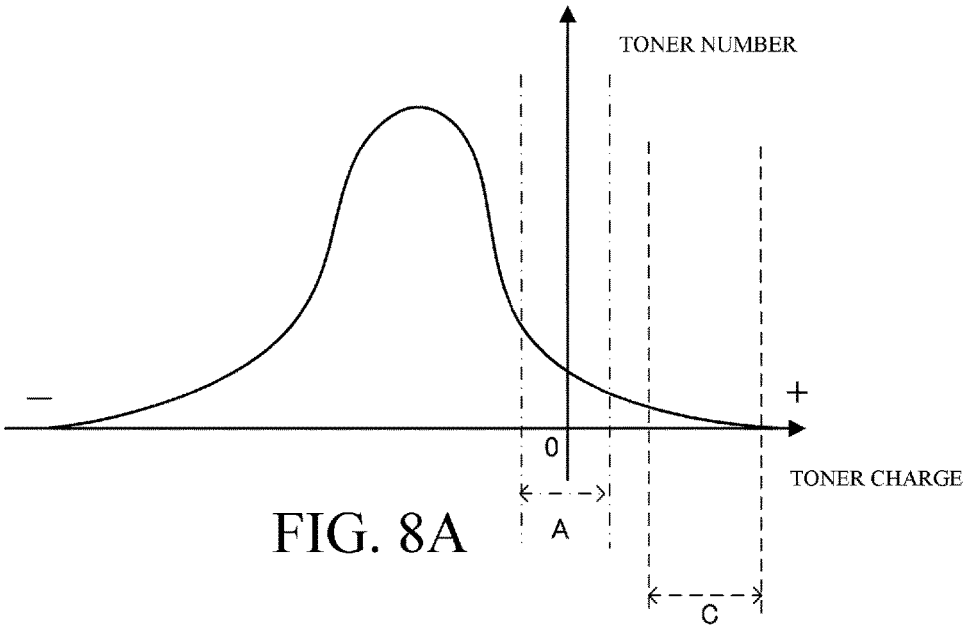
FIGS. 8A and 8B are schematic views of a case where a Vback value is relatively large in the first embodiment.
Figure 8B:
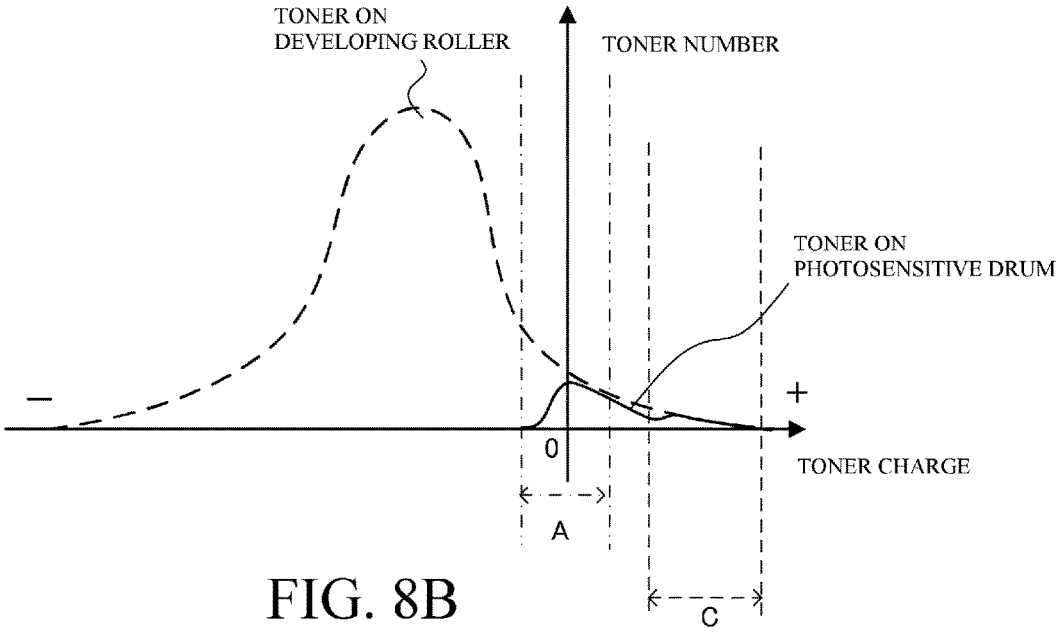

FIG. 8A is a schematic view illustrating a region of fogging toner transferred from the developing roller when the Vback value is relatively large. FIG. 8B is a schematic view of a charge quantity and a number distribution of fogging toner transferred to the photosensitive drum when the Vback value is relatively large.

When Vback is around 200 V, Coulomb force acting on toner charged with a positive polarity strengthens as compared to the state of ((2)). Therefore, toner with a relatively large charge quantity in the toner charged with a positive polarity is also transferred to the photosensitive drum as the "fogging toner".

Accordingly, toner in regions "A" and "C" shown in FIG. 8A are transferred to the photosensitive drum 2 as the "fogging toner". In addition, trends in a charge quantity and a total amount of the "fogging toner" to be transferred are as shown in FIG. 8B and reveal that a transfer amount has increased and a charging polarity has shifted to a positive polarity as compared to the state of ((1)). Hereinafter, the "fogging toner" in a state where Vback is relatively large as described above will be referred to as "positive fogging toner 100E".

Figure 9:
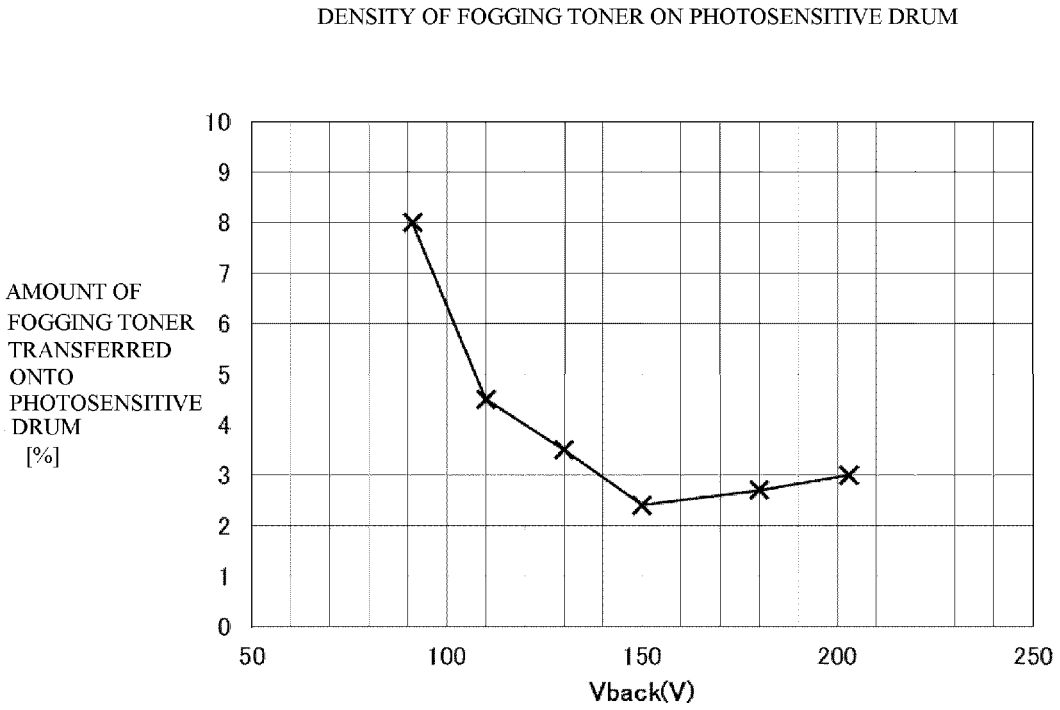
FIG. 9 is an explanatory diagram of a relationship between a Vback value and fogging toner in the first embodiment.

FIG. 9 is an explanatory diagram of a relationship between the Vback value and fogging toner transferred to the photosensitive drum in the configuration of the present embodiment. More specifically, an abscissa in FIG. 9 represents the Vback value when the developing voltage is fixed at −350 V and the dark-part potential is changed to various values, with the Vback value during an image formation period being 150 V. An ordinate represents a fogging toner density which indicates a transfer amount of the "fogging toner" on the photosensitive drum corresponding to each Vback value.

In this case, the transfer amount of the "fogging toner" on the photosensitive drum was measured by the following procedure.

First, the "fogging toner" existing on the photosensitive drum at the end of cleaning after jamming or after the density adjusting mode was adhered to an adhesive tape (Scotch (registered trademark) Mending Tape, manufactured by 3M Japan Limited). Next, the adhesive tape having collected the "fogging toner" was affixed to a sheet of white paper (trade name GF-0081, manufactured by Canon Inc.). In addition, an adhesive tape not having collected the "fogging toner" was also affixed to the same sheet of paper for comparison. Furthermore, using "REFLECTMETER MODEL TC-6DS" (manufactured by Tokyo Denshoku Co., Ltd.), a degree of whiteness (reflectance D1(%)) of the adhesive tape portion having collected the "fogging toner" and a degree of whiteness (reflectance D2(%)) of the adhesive tape portion not having collected the "fogging toner" were measured, and $$\text{fogging density (\%)} = D2(\%) - D1(\%)$$

was measured based on a difference between the reflectances.

FIG. 9 reveals that, when the Vback value is reduced from the value during an image formation period, the fogging toner that is transferred to the photosensitive drum 2 increases. This fogging toner corresponds to the base fogging toner 100F. FIG. 9 also reveals that, when the Vback value is increased from the value during an image formation period, the fogging toner that is transferred to the photosensitive drum 2 similarly increases. This fogging toner corresponds to the positive fogging toner 100E.

Table 2 presents a summary of the value of Vback and a charging polarity and a transfer amount of the "fogging toner" to be transferred to the photosensitive drum 2 in the present embodiment.

TABLE 2

(Vback value and characteristics of the "fogging toner" in first embodiment)

| | Vback value | | |
|---|---|---|---|
| | 100 V | 150 V | 200 V |
| Charging polarity | Large amount of relatively negatively charged toner (base fogging) | Charge quantity is small | Large amount of relatively positively charged toner (positive fogging) |
| Transfer amount | Slightly increases | Small | Slightly increases |
| Notes | Condition including smaller Vback value | Reference condition | Condition including larger Vback value |

(4-2) Relationship Among Charging Polarity of "Fogging Toner", Polarity of Primary Transfer Voltage, and Transfer Amount of "Fogging Toner" to Intermediate Transfer Belt FIGS. 10A to 10D are schematic explanatory diagrams which schematically represent a vicinity of the primary transfer unit. A relationship of a transfer amount of the "fogging toner" to the intermediate transfer belt 20 with respect to a combination of a charging polarity of the "fogging toner" and primary transfer voltage will be described with reference to FIGS. 10A to 10D.

Figure 10A:
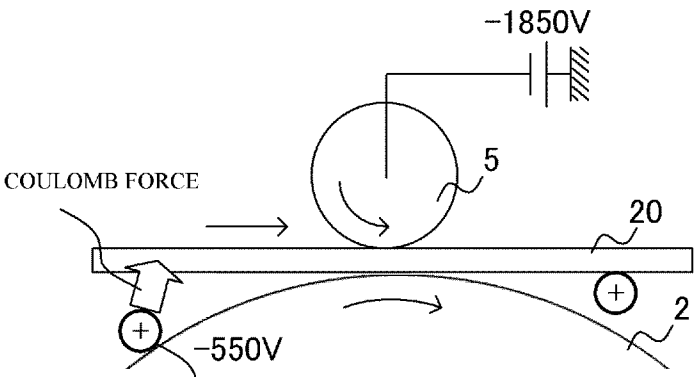
FIGS. 10A to 10D are schematic explanatory diagrams of a vicinity of a primary transfer unit in the first embodiment.
Figure 10B:
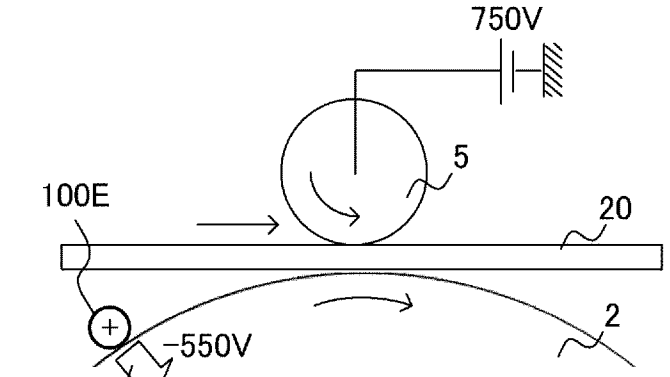
Figure 10C:
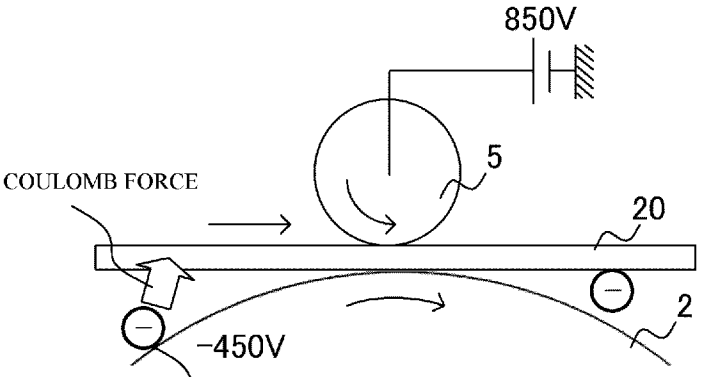
Figure 10D:
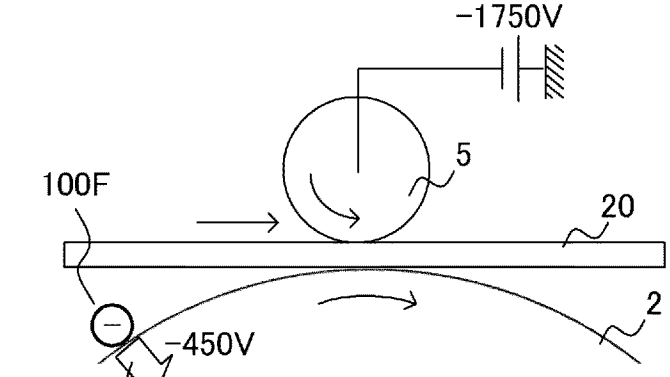

FIG. 10A is an explanatory diagram of a state where "positive fogging toner" is adhered to the photosensitive drum and voltage with a negative polarity is applied as primary transfer voltage. FIG. 10B is an explanatory diagram of a state where "positive fogging toner" is adhered to the photosensitive drum and voltage with a positive polarity is applied as primary transfer voltage. FIG. 10C is an explanatory diagram of a state where "base fogging toner" is adhered to the photosensitive drum and voltage with a positive polarity is applied as primary transfer voltage. FIG. 10D is an explanatory diagram of a state where "base fogging toner" is adhered to the photosensitive drum and voltage with a negative polarity is applied as primary transfer voltage.

First, FIG. 10A shows a state where the "positive fogging toner 100E" which is the "fogging toner" of which a charging polarity is relatively positive adheres to the photosensitive drum 2. Conditions of FIG. 10A represent a state where, for example, voltage with a negative polarity of −1850 V is applied as the primary transfer voltage or, in other words, a state where the difference in potential between the photosensitive drum 2 and the primary transfer voltage is +1300 V. In this state, the "positive fogging toner 100E" on the photosensitive drum 2 is subjected to Coulomb force in a direction in which the "positive fogging toner 100E" is attracted toward the intermediate transfer belt 20. Therefore, the "positive fogging toner 100E" on the photosensitive drum 2 is primarily transferred onto the intermediate transfer belt 20.

On the other hand, FIG. 10B shows a state where voltage with a positive polarity of 750 V is applied. In other words, this is a state where an absolute value of the difference in potential between the photosensitive drum 2 and the primary transfer voltage is set the same as in FIG. 10A (1300 V) but the polarity is set in reverse. In this state, the "positive fogging toner 100E" on the photosensitive drum 2 is subjected to Coulomb force in a direction in which the "positive fogging toner 100E" is attracted toward the photosensitive drum 2. Therefore, primary transfer onto the photosensitive drum 2 is suppressed and the "fogging toner" to be transferred to the intermediate transfer belt 20 is reduced as compared to a case where voltage with a negative polarity is applied.

Next, FIG. 10C shows a state where the "base fogging toner 100F" which is the "fogging toner" of which a charging polarity is relatively negative adheres to the photosensitive drum 2. Conditions of FIG. 10C represent a state where, for example, voltage with a positive polarity of 850 V is applied as the primary transfer voltage or, in other words, a state where the difference in potential between the photosensitive drum 2 and the primary transfer voltage is −1300 V. In this state, the "base fogging toner 100F" on the photosensitive drum 2 is subjected to Coulomb force in a direction in which the "base fogging toner 100F" is attracted toward the intermediate transfer belt 20. Therefore, the "base fogging toner 100F" on the photosensitive drum 2 is primarily transferred onto the intermediate transfer belt 20.

On the other hand, FIG. 10D shows a state where voltage with a negative polarity of −1750 V is applied as the primary transfer voltage. In other words, this is a state where an absolute value of the difference in potential between the photosensitive drum 2 and the primary transfer voltage is set the same as in FIG. 10C (1300 V) but the polarity is set in reverse. In this state, the "base fogging toner 100F" on the photosensitive drum 2 is subjected to Coulomb force in a direction in which the "base fogging toner 100F" is attracted toward the photosensitive drum 2. Therefore, primary transfer onto the photosensitive drum 2 is suppressed and the "fogging toner" to be transferred to the intermediate transfer belt 20 is reduced as compared to a case where voltage with a positive polarity is applied.

Figure 11:
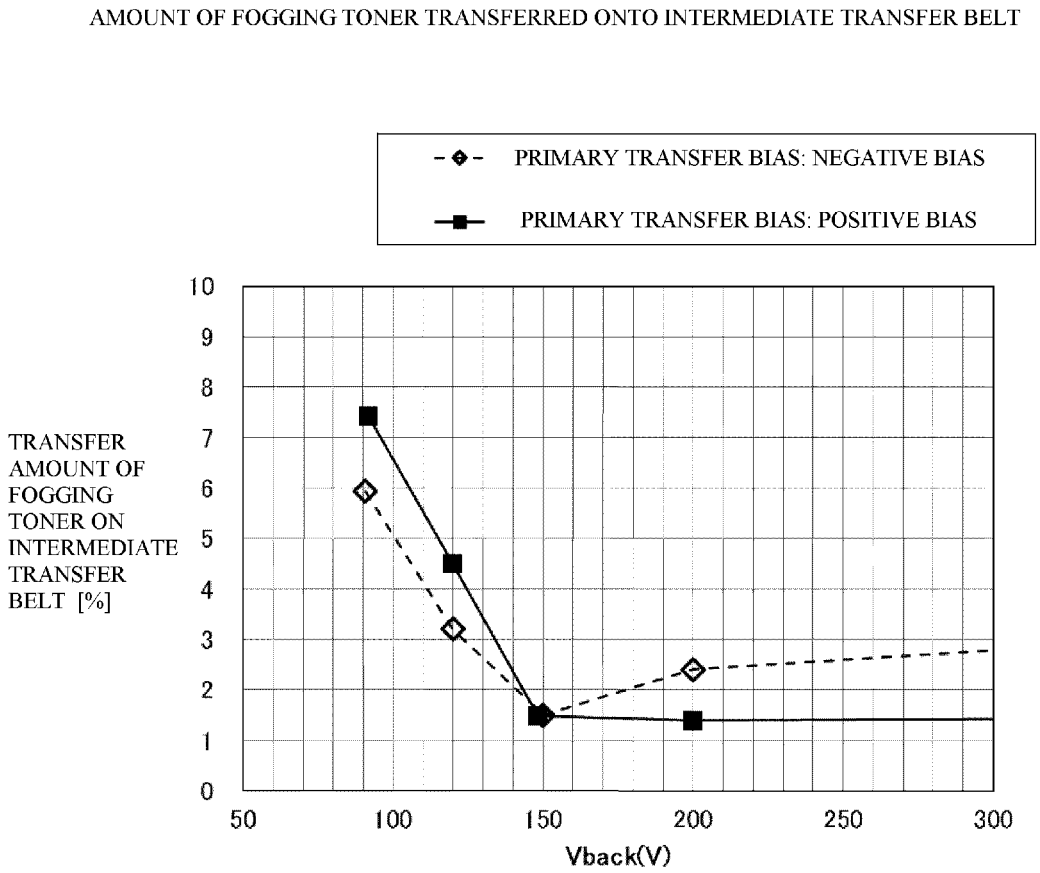
FIG. 11 is an explanatory diagram of a relationship between a Vback value and fogging toner in the first embodiment.
Figure 12:
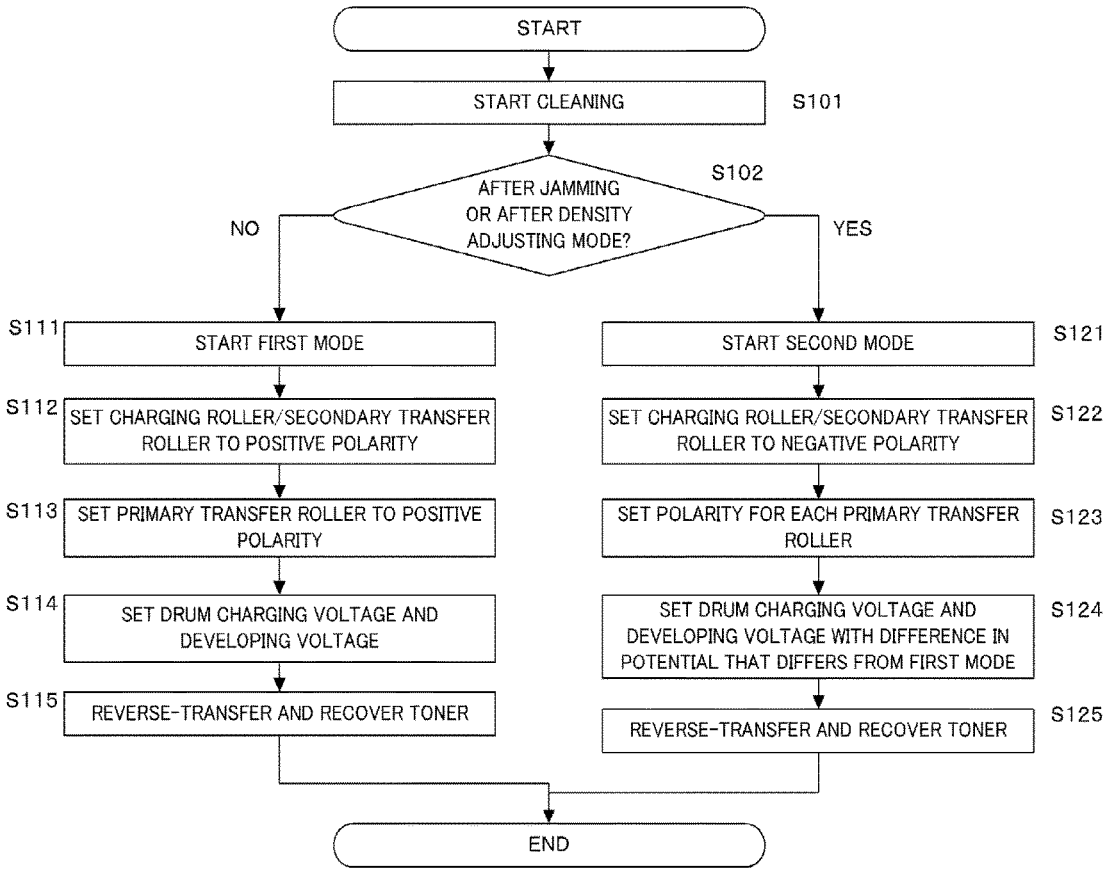
FIG. 12 is a flowchart for illustrating a flow of processing in the first embodiment.

FIG. 11 is an explanatory diagram of a relationship between the Vback value and fogging toner transferred to the intermediate transfer belt in the configuration of the present embodiment.

More specifically, FIG. 11 shows a graph of primary transfer voltage polarity and a transfer amount of the "fogging toner" on the intermediate transfer belt 20 under conditions where the Vback value is changed from 150 V during an image formation period in which the developing voltage is fixed at −350 V. A dashed line indicates a case where a primary transfer bias is a negative bias and a solid line indicates a case where the primary transfer bias is a positive bias.

FIG. 11 reveals that, when the Vback value is reduced from the value during an image formation period, the transfer amount of the "base fogging toner 100F" which is primarily transferred to the intermediate transfer belt 20 is held to a lower level when the primary transfer voltage is voltage with a negative polarity than when the primary transfer voltage is voltage with a positive polarity. On the other hand, FIG. 11 also reveals that, when the Vback value is increased from the value during an image formation period, the transfer amount of the "positive fogging toner 100E" which is primarily transferred to the intermediate transfer belt 20 is held to a lower level when the primary transfer voltage is voltage with a positive polarity than when the primary transfer voltage is voltage with a negative polarity.

As described above, the transfer amount of the "fogging toner" to be primarily transferred to the intermediate transfer belt 20 can be kept at a low level by a combination of the charging polarity of the "fogging toner" and a polarity of the primary transfer voltage. Table 3 presents a summary in the present embodiment.

TABLE 3

(Relationship among charging polarity of the "fogging toner", polarity of primary transfer voltage, and transfer amount of the "fogging toner" to intermediate transfer belt)

| | | Charging polarity | |
|---|---|---|---|
| | | Large amount of relatively positively charged toner (positive fogging) | Large amount of relatively negatively charged toner (base fogging) |
| Primary transfer voltage polarity | Negative polarity | Readily transferred onto intermediate transfer belt | Not readily transferred onto intermediate transfer belt |
| | Positive polarity | Not readily transferred onto intermediate transfer belt | Readily transferred onto intermediate transfer belt |

(4-3) Relationship Between Variation in Vback and Amount of "Fogging Toner" to be Transferred to Intermediate Transfer Belt As described in (4-1) above, whether the "fogging toner" to be transferred to the photosensitive drum 2 is the "base fogging toner 100F" or the "positive fogging toner 100E" is influenced by Vback which is a difference between developing voltage and drum charging voltage. In addition, as described in (4-2), the transfer amount of the "fogging toner" which is primarily transferred to the intermediate transfer belt 20 is also influenced by whether the "fogging toner" is the "base fogging toner 100F" or the "positive fogging toner 100E" and by primary transfer voltage polarity.

In other words, the transfer amount can be reduced by a combination of these conditions. Specifically, in order to reduce the amount of the "fogging toner" after jamming in a stable manner, desirably, Vback is maintained in a "base fogging toner" region or a "positive fogging toner" region in a stable manner and combined with an optimum primary transfer voltage polarity.

Variation Control

Meanwhile, since output of a drum charging voltage power supply or a developing voltage power supply is influenced by temperature/humidity conditions under which the image forming apparatus is used, frequency/history of use of the image forming apparatus, and the like, a slight variation may occur in an actually output voltage value. As a measure against such a variation in Vback, in the present embodiment, control is performed so as to change, after jamming or after the density adjusting mode, the drum charging voltage from a value thereof during an image formation period.

Hereinafter, a control method adaptable to a variation in Vback will be described. In the present embodiment, it is assumed that Vback may possibly vary by around 30V at a maximum, although a probability of occurrence is extremely small. Under this condition, if the Vback value after jamming or after the density adjusting mode is set to 150 V which is the same as during an image formation period, Vback may become 120 V at a minimum due to the variation. In this case, since the "fogging toner" is transferred to the "base fogging toner" region, in the second and third image forming stations in which voltage with a positive polarity is applied after jamming or after the density adjusting mode, an amount of the "fogging toner" to be primarily transferred to the intermediate transfer belt 20 ends up being increased.

For the purpose of preventing such a state, in the present embodiment, Vback is changed in advance after jamming or after the density adjusting mode so that the Vback value after jamming or after the density adjusting mode falls within a certain fogging toner polarity even when various variations are taken into account. An effect of the present embodiment will be described below.

(5) Result of Image Output Experiment

Table 4 presents a summary of performance evaluation results of the present embodiment and first and second comparative examples to be compared with the present embodiment.

TABLE 4

(Table 4: Performance evaluation results of first embodiment, first comparative example, and second comparative example)

| | (Reference) | | Vback value during cleaning operation | | Evaluation result of cleaning performance | | |
|---|---|---|---|---|---|---|---|
| Voltage setting | Dark-part potential Vd during image forming period | Dark-part potential Vd during cleaning operation | When no variation occurs | When maximum variation is expected | When no variation occurs | When maximum variation is expected | Toner consumption during image forming period |
| Present embodiment | −500 V | −530 V | 180 V | 150 V | No problem | No problem | No problem |
| Comparative example 1 | −500 V | −500 V | 150 V | 120 V | No problem | Minor image stain occurred | No problem |
| Comparative example 2 | −530 V | −530 V | 180 V | 150 V | No problem | No problem | Slightly increases |

As evaluation conditions, the image forming apparatus used had a processing speed of 180 mm/sec and a throughput of 30 pages per minute. GF-0081 (Canon Inc., trade name) was used as the sheet of paper, and plain paper mode was selected as the image formation mode.

As an evaluation mode, first, a sheet of paper with a solid white image (an image with a print percentage of 0%) is printed, and the sheet of paper is forcibly stopped midway through printing to cause jamming. Subsequently, the jammed sheet of paper is removed and cleaning after jamming is executed. Subsequently, solid white images are consecutively passed, and cleaning performance is evaluated based on whether or not a stain (faulty cleaning) attributable to the "fogging toner" occurs on the solid white images.

In addition, voltage settings during a cleaning operation after the density adjusting mode were as follows.

Developing voltage: Commonly set to −350 V for the first to fourth image forming stations.

Dark-part potential Vd: Drum charging voltage was adjusted so that dark-part potential Vd was commonly −500

V for the first and fourth image forming stations. The dark-part potential Vd was changed for each embodiment or comparative example with respect to the second and third image forming stations.

Primary transfer voltage: As described in (3), voltage with a negative polarity was applied in the first and fourth image forming stations, and voltage with a positive polarity was applied in the second and third image forming stations. Applied voltage values were adjusted so that an absolute value of a difference between the primary transfer voltage and the dark-part potential Vd is 1300 V as described in (4-2).

In the first comparative example, the dark-part potential Vd during a cleaning operation was not changed from during a normal image forming operation, and the drum charging voltage was adjusted to −500 V which corresponds to a minimum amount of the "fogging toner" during a normal image formation period. In this case, when a variation in Vback during a cleaning operation did not occur, no problems occurred in the cleaning evaluation. However, when a maximum variation of 30 V had occurred in Vback during a cleaning operation, a small amount of faulty cleaning occurred.

In the second comparative example, the dark-part potential Vd during a cleaning operation was not changed from during a normal image forming operation, and the drum charging voltage was adjusted to −530 V in consideration of a variation in the dark-part potential Vd during the cleaning operation. In this case, no problems occurred in the cleaning evaluation when a variation in Vback during the cleaning operation did not occur but also when a maximum variation of 30 V had occurred in Vback during the cleaning operation. However, since the dark-part potential Vd has been changed from during a normal image forming operation, there is a concern that the "fogging toner" to be transferred to the photosensitive drum 2 during an image formation period may increase. The configuration in this case can be described as a configuration in which, since toner is consumed as the "fogging toner" each time a sheet of paper is printed during an image formation period, toner consumption increases, albeit by a small amount.

In the present embodiment, in consideration of a variation in the dark-part potential Vd during a cleaning operation, the drum charging voltage was adjusted to −530 V which represents a change from during a normal image forming operation. In this case, no problems occurred in the cleaning evaluation when a variation in Vback during the cleaning operation did not occur but also when a maximum variation of 30 V had occurred in Vback during the cleaning operation. Furthermore, since the dark-part potential Vd has not been changed during a normal image formation period, the configuration in this case can be described as an excellent configuration in that there is no concern about an increase in toner consumption.

While Vback is adjusted by changing drum charging voltage during a cleaning operation in the description of the present embodiment, this method is not restrictive. Since Vback is a difference between the dark-part potential Vd and developing voltage as described earlier, Vback may be adjusted by changing the developing voltage.

In addition, while an amount of change of Vback during a cleaning operation is set to 30 V in consideration of a maximum variation of Vback, this numerical value is not restrictive. An essential significance of the present embodiment is in controlling the "fogging toner" to be transferred onto the photosensitive drum 2 to a prescribed fogging region (base fogging toner or positive fogging toner) even if a variation in Vback occurs during a cleaning operation. A similar effect may be obtained even when an amount of adjustment is changed as appropriate as long as such control is achieved.

Furthermore, while Vback during a cleaning operation is changed in the second and third image forming stations in the description of the present embodiment, this method is not restrictive. The image forming station in which Vback is changed may be selected by comprehensively determining characteristics of the "fogging toner", a polarity of voltage applied to the first to fourth image forming stations during a cleaning operation, a period of time of voltage application, and the like. In addition, a direction of change in Vback (whether the Vback value is to be increased or reduced) in this case can also be changed as appropriate.

As described above, in the present embodiment, during cleaning after jamming or after the density adjusting mode, a polarity of voltage to be applied to the primary transfer roller and a charging polarity of the "fogging toner" to be transferred from the developing roller onto the photosensitive drum are made the same. For example, by controlling a difference in potential Vback between developing voltage and the dark-part potential Vd by a method such as fixing the developing voltage and controlling drum charging voltage, the charging polarity of the "fogging toner" can be controlled. Due to such a configuration and control, an amount of the "fogging toner" to be transferred to the intermediate transfer belt can be reduced. As a result, since an occurrence in faulty cleaning can be suppressed, favorable image formation can be performed.

Second Embodiment

In the first embodiment, a difference in potential Vback between developing voltage and the dark-part potential Vd during cleaning after jamming or after the density adjusting mode is uniformly changed from a value during an image formation period. On the other hand, a feature of the present embodiment is that the amount of adjustment of Vback is changed in accordance with a degree of wear of the charging roller 32 and a degree of deterioration of the toner 100 inside the image forming unit 1. Since other configurations and control are similar to those of the first embodiment, descriptions thereof will be omitted.

First, a reason for changing the amount of adjustment of Vback in accordance with a degree of wear of the charging roller 32 (charging member) will be described. When the number of sheets of paper printed by the image forming apparatus increases, rubber itself of roller members may deteriorate due to energization of the charging roller 32 and discharge to toner and a discharge product created during charging of the toner may become stuck to a roller surface. As a result, charging performance of the charging roller 32 or, in other words, cleaning performance of the charging roller 32 gradually declines.

In consideration thereof, in the present embodiment, when the image forming apparatus is new and cleaning performance is high, the Vback value during cleaning is not changed from the setting during a normal image formation period and control is performed so as to suppress transfer of the "fogging toner" to the photosensitive drum 2. Accordingly, toner consumption is reduced while ensuring cleaning performance. On the other hand, at the end of durability where cleaning performance has declined, the Vback value is changed from the setting during a normal image formation period in consideration of a variation in the Vback value to suppress transfer of the "fogging toner" to the intermediate transfer belt 20. Accordingly, control prioritizing cleaning performance is performed.

Next, a reason for changing the amount of adjustment of Vback in accordance with a degree of deterioration of the toner 100 (developer) inside the image forming unit 1 will be described. When the image forming unit 1 is repetitively used, the toner 100 inside the developing apparatus 4 gradually deteriorates as the toner 100 sustains mechanical damage due to stirring, friction with the developing blade 81, and the like as well as electrical damage due to the actions of energization and charging on the developing roller. Specifically, chargeability of the toner declines due to the external additive which contributes to toner chargeability detaching from or becoming embedded in the toner. The degree of deterioration can be assessed based on, for example, a rotational distance of the developing roller 8 or an energization time of the developing blade 81.

In addition, the deterioration of the toner 100 becomes more prominent as the amount of toner 100 present inside the developing apparatus 4 decreases. This is because when the amount of toner 100 is relatively small, a frequency of one toner particle being influenced by stirring or energization is relatively high. The degree of influence can be assessed using, for example, an amount of the toner 100 remaining in the developing apparatus 4 as an indicator.

Therefore, as deterioration of the toner 100 progresses, since an existence probability of toner with low chargeability increases, a probability that the "fogging toner" is created also increases as a consequence.

In consideration thereof, in an initial stage of durability of the image forming unit 1 where a probability of occurrence of the "fogging toner" is relatively low, the Vback value during cleaning is not changed from the setting during a normal image formation period and control is performed so as to suppress transfer of the "fogging toner" to the photosensitive drum 2. Accordingly, toner consumption is reduced while ensuring cleaning performance. On the other hand, at the end of durability of the image forming unit 1 where the probability of occurrence of the "fogging toner" is relatively high, the Vback value is changed from the setting during a normal image formation period in consideration of a variation in the Vback value to suppress transfer of the "fogging toner" to the intermediate transfer belt 20. Accordingly, control prioritizing cleaning performance is performed.

As described above, in the present embodiment, the difference in potential Vback between developing voltage and the dark-part potential Vd during cleaning after jamming or after the density adjusting mode is changed in accordance with a cleaning performance of the charging roller 32 and a probability of occurrence of the "fogging toner" in the image forming unit. As a result, cleaning performance can be ensured while minimizing toner consumption by the "fogging toner".

Next, a specific control method in the present embodiment will be described. A degree of wear Cr (%) of the charging roller 32 ranging from brand new (0%) to end of a product lifetime (100%) of the charging roller is determined based on a history of the number of printed sheets of paper. As the history of the number of printed sheets of paper, for example, the control unit may acquire a numerical value which has been obtained by counting up the number of sheets of paper for each printing and which is stored in a memory in advance. The control unit calculates Cr (%) based on the acquired numerical value and a table, a formula, or the like stored in the memory in advance.

In a similar manner, a degree of deterioration Cp (%) of the toner 100 inside the image forming unit 1 ranging from brand new (0%) to end of a product lifetime (100%) of the image forming unit is determined based on the history of the number of printed sheets of paper. In this case, Cp is determined in consideration of at least one of a distance of travel of the developing roller 8 and an amount of the toner 100 inside the developing apparatus 4. The distance of travel and the toner amount may be acquired by the control unit by communicating with the image forming stations, the developing apparatuses, or the like. However, the methods of acquiring the number of printed sheets of paper, the distance of travel, and the toner amount are not particularly limited. The control unit calculates Cp (%) based on the distance of travel or the toner amount and a table, a formula, or the like stored in the memory in advance.

In addition, based on the degree of wear Cr (%) of the charging roller and the degree of deterioration Cp (%) of toner, the control unit determines the amount of adjustment of Vback during cleaning after jamming or after the density adjusting mode based on equation (1) below.

[Math. 1]

$$(Vback\ \text{adjustment amount}) = (\text{Expected maximum variation value of } Vback) * \left(\frac{\alpha \cdot Cr + \beta \cdot Cp}{\alpha + \beta}\right) \quad \text{Equation (1)}$$

In equation (1), α and β are coefficients for respectively weighting contribution degrees of the degrees of wear of the charging roller and the image forming unit with respect to cleaning performance. In the present embodiment, α=2 and β=3. In addition, as already described in the first embodiment, an expected maximum variation value of Vback refers to a maximum value of a difference of Vback that is actually output relative to a target Vback value in consideration of contributions made by temperature/humidity conditions under which the image forming apparatus is used, frequency/history of use of the image forming apparatus, or the like. In the present embodiment, 30 V that is the same as the first embodiment is adopted. These numerical values can also be acquired by the control unit by reading the numerical values from a memory or the like.

In equation (1), when the charging roller and the image forming unit are both brand new, the amount of adjustment of Vback is 0 V and there is no change from the value during an image formation period. Subsequently, depending on the degrees of wear of the charging roller and the image forming unit, the value of the amount of adjustment of Vback gradually increases toward a maximum value (30 V). For example, when the degree of wear Cr of the charging roller 32 is 50% and the degree of wear of the image forming unit 1 is 30%, the amount of adjustment of Vback is 14.4 V. Accordingly, for example, the developing voltage or the charging voltage is changed so as to change Vback during cleaning after jamming or after the density adjusting mode to 14.4 V.

As described above, in the present embodiment, an amount of adjustment of Vback during cleaning after jamming or after the density adjusting mode is changed in accordance with a degree of wear of the charging roller 32 and a degree of wear in the image forming unit. Accordingly, under conditions in which cleaning performance is severe, a polarity of the "fogging toner" and a polarity of primary transfer voltage are optimized while taking a variation in Vback into consideration to reduce the "fogging toner" to be transferred to the intermediate transfer belt 20. On the other hand, under conditions in which cleaning performance is favorable, the amount of adjustment of Vback is set low, and an amount of the "fogging toner" to be transferred to the photosensitive drum 2 is reduced to achieve a reduction in toner consumption. As a result, in the present embodiment, toner consumption can be further reduced as compared to the first embodiment while maintaining favorable cleaning performance.

Moreover, the method of calculating the amount of adjustment of Vback in accordance with the degrees of wear of the respective members is not limited to the method according to the present embodiment. An optimal calculation method in accordance with the influence of the degree of wear of the charging roller and the degree of deterioration of the toner 100 to cleaning performance and a configuration of the image forming apparatus is favorably used. For example, when a comparison between the influence of the degree of wear of the charging roller and the influence of the degree of deterioration of the toner 100 reveals that a degree of influence of one of the degree of wear and the degree of deterioration is significantly large, the numerical value can be determined by only taking one of the degree of wear and the degree of deterioration into consideration.

As described above, according to the respective embodiments of the present invention, by changing a setting of image bearing member charging voltage or developing voltage during cleaning after jamming or after the density adjusting mode from a setting during an image formation period, the "fogging toner" to be transferred to the intermediate transfer belt can be reduced regardless of a use environment or a use history of the image forming apparatus. As a result, faulty cleaning attributable to the "fogging toner" can be prevented without increasing downtime required by cleaning.

Third Embodiment

Hereinafter, a third embodiment will be described.

(1) Image Forming Apparatus

First, an overall configuration of an image forming apparatus according to the present embodiment will be described with reference to FIG. 14.

Figure 14:
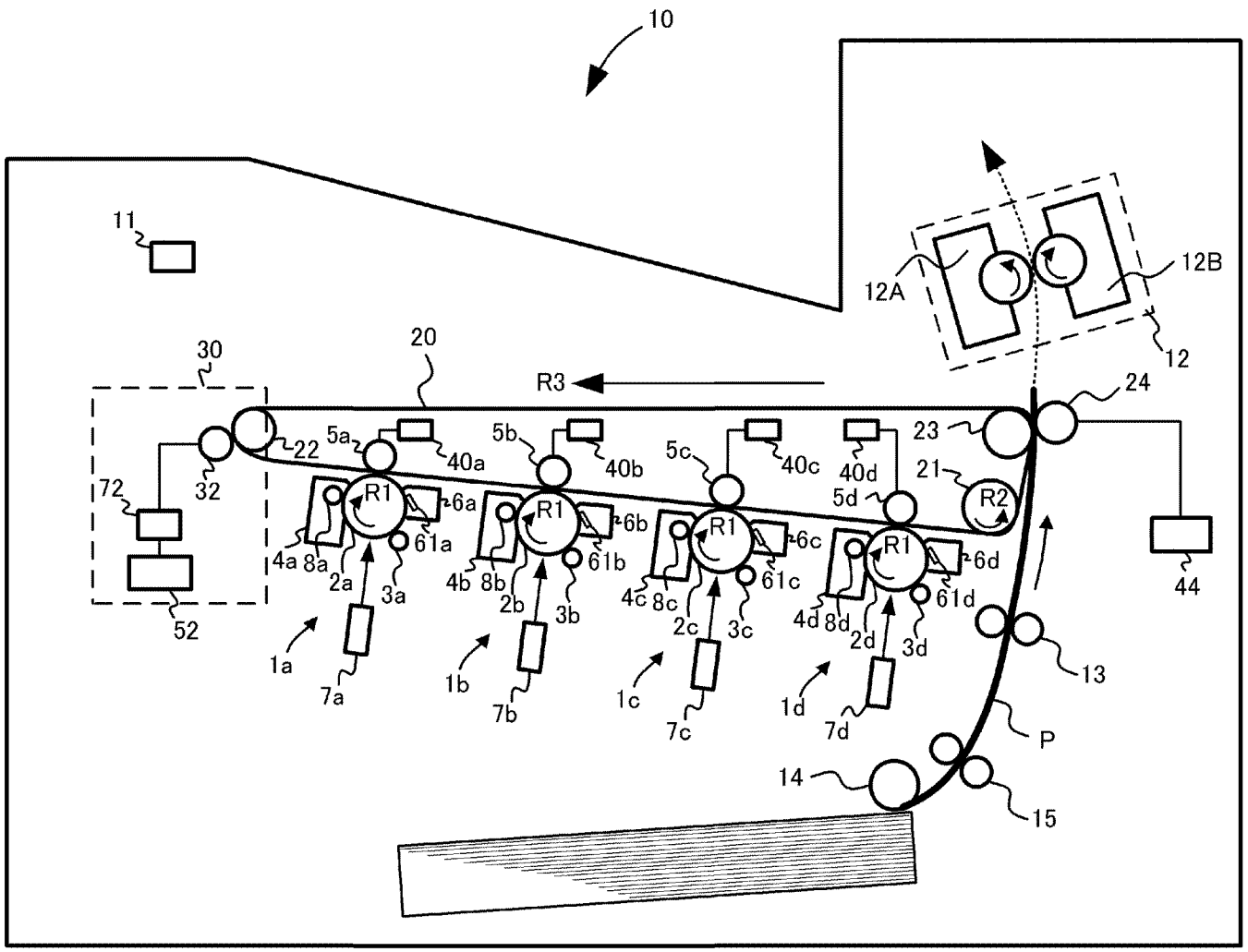
FIG. 14 is a schematic sectional view of an image forming apparatus according to the third embodiment.

FIG. 14 is a schematic sectional view of an image forming apparatus 10 according to the present embodiment. The image forming apparatus 10 according to the present embodiment is an in-line, intermediate-transfer full-color printer utilizing an electrophotographic system.

The image forming apparatus 10 according to the present embodiment includes first, second, third, and fourth image forming units (image forming stations) 1*a*, 1*b*, 1*c*, and 1*d* as a plurality of image forming units. The first, second, third, and fourth image forming units 1*a*, 1*b*, 1*c*, and 1*d* respectively form an image of each of the colors of yellow, magenta, cyan, and black. The image forming units 1*a*, 1*b*, 1*c*, and 1*d* are arranged in a single row at regular intervals.

Moreover, in the present embodiment, configurations of the first to fourth image forming units 1*a* to 1*d* are substantially the same with the exception of differences in colors of used toners (developers). Therefore, unless the image forming units must be distinguished from one another, the suffixes a, b, c, and d added to the reference characters in the drawings to indicate which color is to be produced by which element will be omitted and the image forming units will be collectively described.

A drum-type electrophotographic photosensitive member (hereinafter, a photosensitive drum) 2 as an image bearing member on which a toner image (a developer image) is formed by an electrophotographic processing unit is installed in the image forming unit 1. As members for constituting the electrophotographic processing unit, a drum charging roller 3, a developing apparatus 4, a primary transfer roller 5, and a drum cleaning apparatus 6 are installed around the photosensitive drum 2. In addition, as shown in FIG. 14, an exposing apparatus (a laser scanner apparatus) 7 is installed below a space between the drum charging roller 3 and the developing apparatus 4. In this case, the developing apparatus 4 corresponds to the developing unit. In addition, the primary transfer roller 5 corresponds to the transfer member. Furthermore, the image forming apparatus 10 includes a control unit 11 for controlling operations of the entire image forming apparatus.

In addition, an intermediate transfer belt 20 as an intermediate transfer member with an endless belt-shape is arranged so as to oppose all of the photosensitive drums 2*a* to 2*d* of the respective image forming units 1*a* to 1*d*. The intermediate transfer belt 20 is stretched over a driver roller 21, a cleaning opposing roller 22, and a secondary transfer opposing roller 23 as a plurality of supporting members, and rotates in a direction of an arrow R3 in FIG. 14. Primary transfer rollers 5 are arranged so as to correspond to the respective photosensitive drums 2 of the respective image forming units 1 on a side of an inner circumferential surface of the intermediate transfer belt 20. In addition, a secondary transfer roller 24 as a secondary transfer unit is arranged at a position opposing the secondary transfer opposing roller 23 on a side of an outer circumferential surface of the intermediate transfer belt 20.

The photosensitive drum 2 in the present embodiment is a negative-charging OPC (organic photoconductor) photosensitive member, and includes a photosensitive layer on an aluminum drum substrate. The photosensitive drum 2 is rotationally driven by a drive apparatus (not shown) at a prescribed peripheral velocity (surface movement speed) in a direction of an arrow R1 in FIG. 14 (clockwise in FIG. 14). In the present embodiment, the peripheral velocity of the photosensitive drum 2 corresponds to a processing speed of the image forming apparatus 10.

The drum charging roller 3 is in contact with a surface (a circumferential surface) of the photosensitive drum 2 with a prescribed pressure contact force, and a prescribed drum charging voltage (a drum charging bias) is applied to the drum charging roller 3 from a power supply (a voltage applying unit, not shown) for applying voltage so as to uniformly charge a surface of the photosensitive drum 2 to a prescribed potential. In the present embodiment, the photosensitive drum 2 is charged by the drum charging roller 3 with a negative polarity.

The exposing apparatus 7 exposes the surface of the photosensitive drum 2 to form an electrostatic latent image (an electrostatic image) in accordance with image information on the surface of the photosensitive drum 2 having been charged by the drum charging roller 3. In other words, in the exposing apparatus 7, laser light modulated in correspondence to a time-series electric digital pixel signal of image information input from a host computer (not shown) is output from a laser output unit, and the laser light is irradiated on the surface of the photosensitive drum 2 via a reflective mirror.

The developing apparatus 4 in the present embodiment uses a contact developing system as a developing system and includes a developing roller 8 as the developer bearing member. Toner borne in the form of a thin layer on the developing roller 8 (on the developer bearing member) is transported to an opposing portion (a developing unit) to the photosensitive drum 2 as the developing roller 8 is rotationally driven by a driving unit (not shown). In addition, developing voltage (a developing bias) is applied to the developing roller 8 from a power supply 90 (refer to FIG. 15, a developing voltage power supply) in order to develop the electrostatic latent image formed on the photosensitive drum 2 (on the image bearing member) as a toner image. Details of a configuration and operations of the developing apparatus 4 will be provided later. In the present embodiment, a mode in which the electrostatic latent image is developed by a reversal development system will be described. Specifically, by causing toner charged with a same polarity as a charging polarity of the photosensitive drum 2 to adhere to a portion (an exposed portion) of which a charge has been attenuated by exposure on the uniformly-charged photosensitive drum 2, the electrostatic latent image on the photosensitive drum 2 is developed as a toner image. In the present embodiment, the normal charging polarity of toner is a negative polarity, and the toner forming a toner image has a mainly negative charge.

Toner of each of the colors of yellow, magenta, cyan, and black are respectively stored in the developing apparatuses 4*a*, 4*b*, 4*c*, and 4*d*. In a full-color mode, all developing rollers 8 of the four developing apparatuses 4 come into contact with the photosensitive drum 2. In addition, in a monochrome (single color) mode, developing rollers 8 of the developing apparatuses 4 other than the image forming unit that forms an image are configured to be separated from the photosensitive drum 2. This is done to prevent deterioration and wear of the developing rollers 8 and the toners.

In the present embodiment, an intermediate transfer belt made of PEN (polyethylene naphthalate) resin is used as the intermediate transfer belt 20 which bears a toner image. The intermediate transfer belt 20 has a surface resistivity of $5.0\times10^{11}\Omega/\square$ and a volume resistivity of $8.0\times10^{11}$ Ωcm.

In addition, a resin such as PVDF (vinylidene fluoride resin), ETFE (ethylene tetrafluoride-ethylene copolymer resin), polyimide, PET (polyethylene terephthalate), and polycarbonate constructed in an endless belt-shape can be used for the intermediate transfer belt 20. Alternatively, for example, a rubber base layer such as EPDM being coated with, for example, urethane rubber containing a dispersed fluororesin such as PTFE and being constructed in an endless belt-shape can be used as the intermediate transfer belt 20.

Due to the driver roller 21 being rotationally driven in a direction of an arrow R2 in FIG. 14 (counterclockwise in FIG. 14), the intermediate transfer belt 20 circulates (rotates) at approximately the same speed as a peripheral velocity of the photosensitive drum 2 or, in other words, at a prescribed processing speed in a direction of an arrow R3 in FIG. 14 (counterclockwise in FIG. 14).

The primary transfer roller 5 is constructed by an elastic member such as sponge rubber. In the present embodiment, a 6 mm-diameter nickel-plated steel rod coated with 4 mm-thick NBR hydrin rubber is used as the primary transfer roller. An electric resistance value of the primary transfer roller 5 is $1.0\times10^{5}\Omega$ when the primary transfer roller is pressed onto an aluminum cylinder with a force of 9.8 N, rotated at 50 mm/sec, and 100 V is applied thereto.

In addition, the primary transfer roller 5 comes into contact with the photosensitive drum 2 via the intermediate transfer belt 20 and forms a primary transfer unit (a primary transfer nip unit, a transfer unit) in a contact portion between the intermediate transfer belt 20 and the photosensitive drum 2. Furthermore, the primary transfer roller 5 rotates so as to follow a movement of the intermediate transfer belt 20.

A power supply 40 (a primary transfer voltage power supply) is connected to the primary transfer roller 5, and primary transfer voltage (a primary transfer bias) is applied to the primary transfer roller 5 from the power supply 40. The power supply 40 is capable of selectively applying biases of positive and negative polarities. The toner image formed on the photosensitive drum 2 is transferred (primarily transferred) onto the rotating intermediate transfer belt 20 by the primary transfer roller 5 to which a primary transfer bias with a reverse polarity to the normal charging polarity (negative polarity) of toner is applied.

The secondary transfer roller 24 is constructed by an elastic member such as sponge rubber. In the present embodiment, a 6 mm-diameter nickel-plated steel rod coated with 6 mm-thick NBR hydrin rubber is used as the secondary transfer roller. An electric resistance value of the secondary transfer roller 24 is $3.0\times10^{7}\Omega$ when the secondary transfer roller 24 is pressed onto an aluminum cylinder with a force of 9.8 N, rotated at 50 mm/sec, and 1000 V is applied thereto.

The secondary transfer roller 24 is arranged in contact with the secondary transfer opposing roller 23 via the intermediate transfer belt 20, and forms a secondary transfer unit (a secondary transfer nip unit, a transfer unit) in a contact portion thereof. In addition, the secondary transfer roller 24 rotates so as to follow a movement of the intermediate transfer belt 20 or movements of the intermediate transfer belt 20 and a recording material P (a sheet of paper). A power supply 44 (a secondary transfer voltage power supply) is connected to the secondary transfer roller 24, and secondary transfer voltage (a secondary transfer bias) is applied to the secondary transfer roller 24 from the power supply 44. The power supply 44 is capable of selectively applying biases of positive and negative polarities.

The toner image formed on the intermediate transfer belt 20 is transferred (secondarily transferred) onto the recording material P having been transported to the secondary transfer unit by the secondary transfer roller 24 to which a secondary transfer bias with a reverse polarity to the normal charging polarity of toner is applied.

A belt cleaning unit 30 is installed on a downstream side of the secondary transfer unit in a rotation direction (a direction of an arrow R3 in FIG. 14, a movement direction of a belt surface) of the intermediate transfer belt 20 on an outer circumferential side of the intermediate transfer belt 20. Details of a configuration and operations of the belt cleaning unit 30 will be provided later.

A resist roller 13, a transporting roller 15, and a feeding roller 14 which constitute a unit for supplying the recording material P are installed on an upstream side in a transport direction of the recording material P of the secondary transfer unit.

In addition, a fixing apparatus 12 is installed on a downstream side in the transport direction of the recording material P of the secondary transfer unit. The fixing apparatus 12 includes a fixing roller 12A provided with a heat source and a pressure roller 12B which comes into pressure contact with the fixing roller 12A.

Next, an image forming operation by the image forming apparatus 10 according to the present embodiment will be described using an example of a full-color mode.

First, a toner image in each color is formed on the photosensitive drum 2 of each image forming unit 1 by an electrophotographic process. Specifically, when a start signal of an image forming operation is issued, each photosensitive drum 2 being rotationally driven at a prescribed processing speed is uniformly charged by the drum charging roller 3. In addition, each exposing apparatus 7 converts an input color-separated color image signal into an optical signal at a laser output unit. In addition, each exposing apparatus 7 scans and exposes a surface of each uniformly-charged photosensitive drum 2 with laser light that is the converted optical signal and forms an electrostatic latent image on each photosensitive drum 2. Subsequently, in the first image forming unit 1*a*, yellow toner from the developing apparatus 4*a* is electrostatically adsorbed in accordance with a potential of the surface of the photosensitive drum 2*a* and developed as a yellow toner image.

A configuration of the developing apparatus 4 will now be described in detail with reference to FIG. 15.

Figure 15:
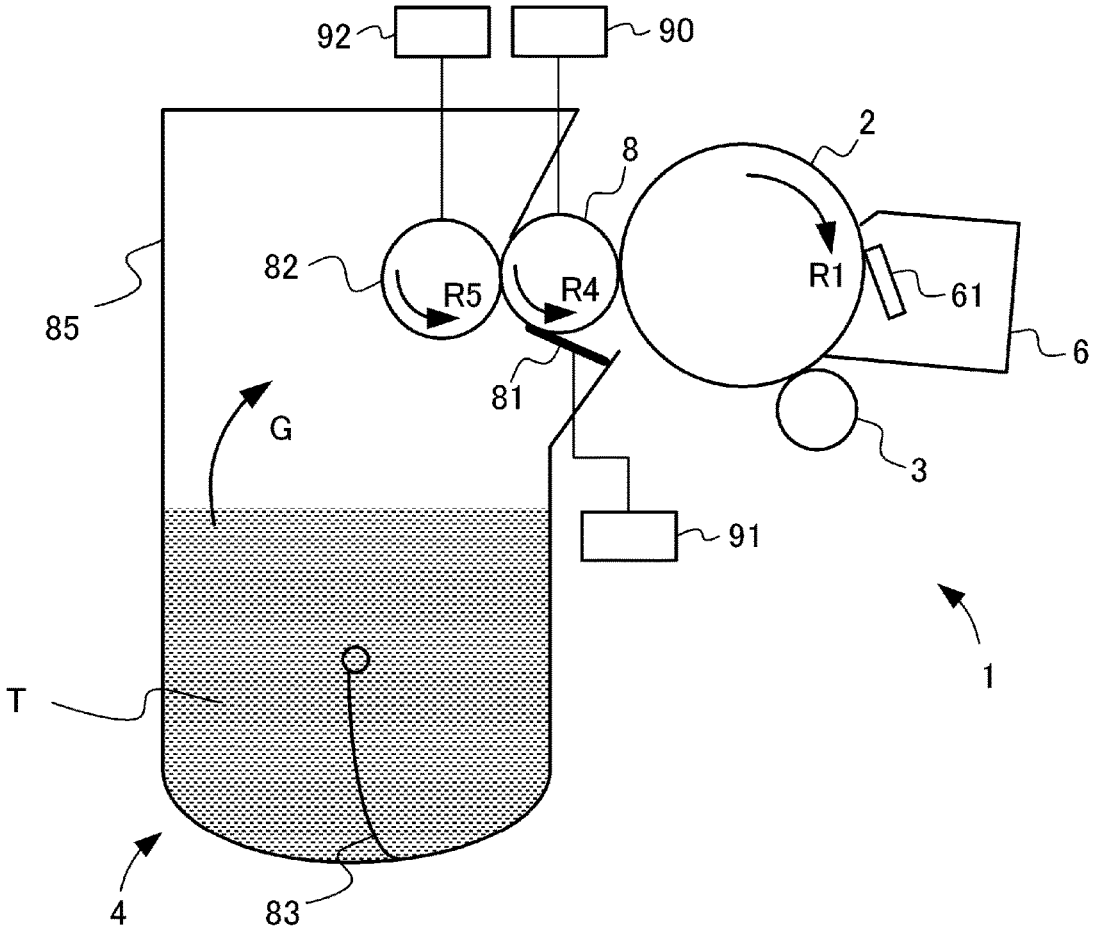
FIG. 15 is a schematic sectional view of an image forming unit as seen from a longitudinal direction of a photosensitive drum in the third embodiment.

FIG. 15 is a schematic sectional view of the image forming unit 1 according to the present embodiment as viewed from a longitudinal direction (a rotational axis direction) of the photosensitive drum 2.

The developing apparatus 4 is constituted by the developing roller 8 as a developer bearing member, a developing blade 81 as a developer control member, a toner supplying roller 82 as a developer supplying member, and a toner storage chamber 85 which stores toner T as a developer. In the present embodiment, as the toner T, a non-magnetic spherical toner with a particle size of 7 μm is used. In addition, silica particles (external additive particles) with a particle size of 20 nm are added as a toner external additive to the surface of the toner T. Furthermore, as described earlier, the normal charging polarity of the toner T in the present embodiment is a negative polarity.

The developing blade 81 is in contact with the developing roller 8 in a counter direction, and regulates a coating amount of toner supplied by the toner supplying roller 82 (regulates a layer thickness of toner on the developing roller 8) and imparts a charge to the toner. The developing blade 81 is formed of a thin plate-like member and creates contact pressure using spring elasticity of the thin plate, and a surface of the developing blade 81 is brought into contact with the toner and the developing roller 8.

In the present embodiment, a 0.1 mm-thick, leaf spring-like SUS (stainless steel) thin plate coated with a semiconductive resin is used as the developing blade 81, and the developing blade 81 is configured so that a surface thereof comes into contact with the toner and the developing roller 8. A configuration is adopted in which, at this point, contact pressure is created using spring elasticity of the thin plate. Moreover, the developing blade 81 is not limited thereto and a metal thin plate made of phosphor bronze, aluminum, or the like instead of SUS may be used. Alternatively, a metal thin plate coated with a semiconductive rubber instead of a semiconductive resin or an uncoated metal plate may be used.

In the present embodiment, prescribed voltage is applied to the developing blade 81 from a power supply 91 (a blade voltage power supply). Due to discharge between the developing blade 81 and the developing roller 8 and triboelectric charging by friction between the developing blade 81 and the developing roller 8, a negative charge is imparted to the toner on the developing roller 8 and, at the same time, a layer thickness of the toner on the developing roller 8 is regulated.

In addition, DC voltage (a developing blade bias) is applied to the developing blade 81 from the power supply 91 so that a difference in potential ΔVb of the developing blade 81 relative to a potential of the developing roller 8 during image formation is −100 V.

The toner supplying roller 82 is arranged so as to form a prescribed nip unit on a circumferential surface of the developing roller 8, and rotates in a direction of an arrow R5 in FIG. 15 (counterclockwise in FIG. 15). The toner supplying roller 82 is an elastic sponge roller in which a foam is formed on an outer circumference of a conductive core metal. The toner supplying roller 82 and the developing roller 8 are in contact with each other at a prescribed penetration level. In the contact portion, the toner supplying roller 82 and the developing roller 8 rotate so as to move in mutually opposite directions and, due to this operation, supply of toner to the developing roller 8 by the toner supplying roller 82 and stripping of toner remaining as development residue on the developing roller 8 are performed. In doing so, a toner supply amount to the developing roller 8 can be adjusted by adjusting a difference in potential between the toner supplying roller 82 and the developing roller 8. In the present embodiment, DC voltage (a toner supplying bias) is applied to the toner supplying roller 82 from a power supply 92 (a toner supplying voltage power supply) so that a difference in potential ΔVs of the toner supplying roller 82 relative to a potential of the developing roller 8 during image formation is −50 V.

In the present embodiment, the developing roller 8 and the toner supplying roller 82 both have an outer diameter ϕ of 20 mm and a penetration level of the toner supplying roller 82 with respect to the developing roller 8 is set to 1.5 mm. In addition, a toner stirring member 83 is provided inside the toner storage chamber 85. The toner stirring member 83 is for stirring the toner stored in the toner storage chamber 85 and also for transporting the toner in a direction of an arrow G in FIG. 15 toward an upper part of the toner supplying roller 82.

The developing roller 8 and the photosensitive drum 2 respectively rotate so that surfaces thereof move in a same direction (in the present embodiment, the directions indicated by the arrows R4 and R1 in FIG. 15) in a contact portion between the developing roller 8 and the photosensitive drum 2.

In the present embodiment, DC voltage (a developing bias) with a same polarity as the charging polarity (in the present embodiment, a negative polarity) of the photosensitive drum 2 is applied to the developing roller 8 from the power supply 90. In the developing unit in which the developing roller 8 comes into contact (sliding contact) with the photosensitive drum 2, due to the difference in potential between the developing roller 8 and the photosensitive drum 2, negatively charged toner is transferred only to a portion of the electrostatic latent image and the electrostatic latent image is developed.

Let us now return to the description of an image forming operation. Subsequently, as shown in FIG. 14, the yellow toner image developed on the photosensitive drum 2*a* is primarily transferred in the primary transfer unit onto the rotating intermediate transfer belt 20 by the primary transfer roller 5*a* to which primary transfer bias is applied. At this point, a primary transfer bias having an opposite polarity (in the present embodiment, a positive polarity) to the normal charging polarity of the toner is applied to the primary transfer roller 5*a*. In this manner, the intermediate transfer belt 20 onto which the yellow toner image has been transferred moves to a side of the second image forming unit 1*b*.

In the second image forming unit 1*b*, a magenta toner image is formed on the photosensitive drum 2*b* in a similar manner to the first image forming unit 1*a*. In addition, the magenta toner image is primarily transferred in the primary transfer unit so as to overlap with the yellow toner image on the intermediate transfer belt 20. In a similar manner, in the third and fourth image forming units 1*c* and 1*d*, the respective toner images of cyan and black are sequentially primarily transferred in the primary transfer unit so as to overlap with the respective toner images of yellow and magenta on the intermediate transfer belt 20.

In this manner, toner images in a plurality of colors (a multiple toner image) having been primarily transferred so as to sequentially overlap with one another in the respective primary transfer units is formed on the intermediate transfer belt 20.

In accordance with a timing at which a leading edge of the toner image on the intermediate transfer belt 20 reaches the secondary transfer unit, the recording material P fed out by the feeding roller 14 is transported to the secondary transfer unit by the transporting roller 15 and the resist roller 13. In addition, in the secondary transfer unit, the toner images on the intermediate transfer belt 20 are collectively secondarily transferred to the recording material P by the secondary transfer roller 24 to which a secondary transfer bias with a reverse polarity (in the present embodiment, a positive polarity) to the normal charging polarity of toner is applied.

Subsequently, the recording material P onto which the toner images have been transferred is transported to the fixing apparatus 12. The recording material P bearing the toner images is heated and pressurized by a fixing nip unit between the fixing roller 12A and the pressure roller 12B installed inside the fixing apparatus 12. Accordingly, the toner images are thermally fixed (fused and fixed) to a surface of the recording material P and an image (a full-color image) is formed on the recording material P. Subsequently, the recording material P is discharged to the outside of the image forming apparatus 10 and the series of image forming operations ends.

Toner (primary untransferred toner) that remains on the photosensitive drum 2 after the primary transfer process is removed and recovered from the photosensitive drum 2 by the drum cleaning apparatus 6. The drum cleaning apparatus 6 includes a drum cleaning blade 61 which is a plate-like member formed by an elastic body such as urethane rubber and a recovered toner container which stores toner scraped off from the photosensitive drum 2 by the drum cleaning blade 61.

In addition, toner (secondary untransferred toner) remaining on the intermediate transfer belt 20 after the secondary transfer process is removed and recovered from the intermediate transfer belt 20 by being uniformly charged with a positive polarity by the belt cleaning unit 30 and then transferred onto the photosensitive drum 2 by the primary transfer unit. This operation will be described in detail below. In this case, the control unit 11 is capable of executing, during an image formation period or during a non-image formation period, a cleaning mode for removing toner remaining on the intermediate transfer belt 20 from the intermediate transfer belt 20. The control unit 11 capable of executing the cleaning mode corresponds to the cleaning unit. Moreover, in the following description, transferring the toner remaining on the intermediate transfer belt 20 to the photosensitive drum 2 from the intermediate transfer belt 20 may be referred to as a reverse transfer.

(2) Belt Cleaning Mechanism During Image Formation Period

The belt cleaning mechanism during an image formation period in the present embodiment will be described in detail with reference to FIG. 13.

Figure 13:
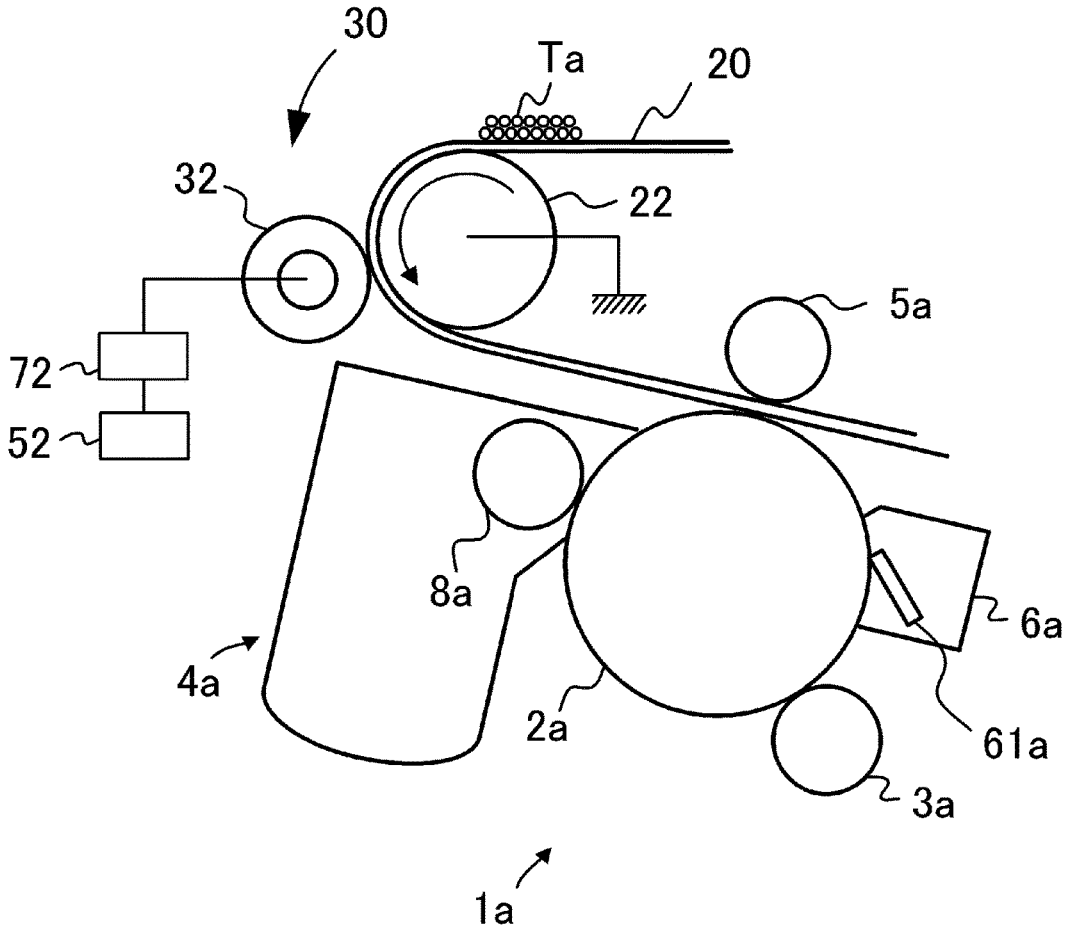
FIG. 13 is a schematic view showing a configuration of a belt cleaning unit according to a third embodiment.

FIG. 13 is a schematic view showing a configuration of the belt cleaning unit 30 according to the present embodiment. In order to remove toner such as secondary untransferred toner Ta which remains on the intermediate transfer belt 20 from the intermediate transfer belt 20, the belt cleaning unit 30 according to the present embodiment includes a charging roller 32 as a charging member which charges toner remaining on the intermediate transfer belt 20. The charging roller 32 is positioned on a downstream side of the secondary transfer unit and an upstream side of the primary transfer unit in a rotation direction of the intermediate transfer belt 20.

As the charging roller 32 in the present embodiment, a 6 mm-diameter nickel-plated steel rod coated with a 5 mm-thick solid elastic body made of EPDM rubber dispersed with carbon is used. An electric resistance value of the charging roller 32 is $5.0\times10^{7}\Omega$ when the charging roller is pressed onto an aluminum cylinder with a force of 9.8 N, rotated at 50 mm/sec, and 500 V is applied thereto. The charging roller 32 is in contact with the intermediate transfer belt 20 and is pressed toward the cleaning opposing roller 22 with total pressure of 9.8 N.

As shown in FIG. 13, the charging roller 32 is electrically connected to a high-voltage power supply 52 via a current detection unit 72 and is configured so that biases with a positive polarity and a negative polarity can be selectively applied thereto.

During a belt cleaning operation, DC voltage with a positive polarity is output from the high-voltage power supply 52 to the charging roller 32. An output value of the DC voltage is controlled based on a current value detected by the current detection unit 72, and constant-current control is performed so that the current value is at a target current value set in advance. A value which does not cause the secondary untransferred toner Ta to be excessively charged and does not cause an occurrence of faulty cleaning due to insufficient charging is selected as the target current value, and the target current value of the charging roller in the present embodiment is 30 μA.

The toner on the intermediate transfer belt 20 prior to the secondary transfer process is charged with a negative polarity that is the same polarity as an electrified charge on a surface of the photosensitive drum 2 and is charged in a state where a variation in charge distribution is small. On the other hand, the secondary untransferred toner Ta on the intermediate transfer belt after the secondary transfer process forms a distribution in which charge distribution has become broader and in which a peak has moved to a side of positive polarity that is an opposite polarity to the normal charging polarity of toner. As a result, the secondary untransferred toner Ta is in a state where toner charged with a negative polarity, toner that is hardly charged, and toner charged with a positive polarity are present in a mixed manner.

During a cleaning operation, applying a positive bias to the charging roller 32 causes a positive electric field to be formed from the charging roller 32 toward the intermediate transfer belt 20 and effectively charges the secondary untransferred toner Ta toward a side of positive polarity due to discharge between the charging roller 32 and the secondary untransferred toner.

The secondary untransferred toner Ta charged with a positive polarity by the charging roller 32 advances to the primary transfer unit of the first image forming unit 1*a*. In addition, due to an effect of a primary transfer bias with a positive polarity that is applied to the primary transfer roller 5*a* of the first image forming unit 1*a*, the secondary untransferred toner Ta is reverse-transferred to the photosensitive drum 2*a* of the first image forming unit 1*a* from the intermediate transfer belt 20. The toner reverse-transferred to the photosensitive drum 2*a* is subsequently removed and recovered from the photosensitive drum 2*a* by a drum cleaning blade 61*a* in the drum cleaning apparatus 6*a*.

As described above, by uniformly charging the secondary untransferred toner Ta with a positive polarity by the charging roller 32 and subsequently reverse-transferring the secondary untransferred toner Ta to the photosensitive drum 2 with the primary transfer unit, the secondary untransferred toner Ta can be removed from the intermediate transfer belt 20.

Moreover, a recovery method of the secondary untransferred toner Ta charged with a positive polarity by the charging roller 32 is not limited to the recovery method using the photosensitive drum 2 and a method such as the following may be used instead. This method involves using a dedicated recovery apparatus provided on the intermediate transfer belt 20 such as a metallic roller to which a bias with a negative polarity has been applied or a fur brush.

In addition, in order to prevent toner charging performance of the charging roller 32 from declining due to toner adhering to the charging roller 32 when cleaning is repetitively performed, a bias with a same polarity (in the present embodiment, a negative polarity) as the normal charging polarity of the toner is applied to the charging roller 32 during a non-image formation period. Most of the toner that adheres to the charging roller 32 during cleaning has a negative polarity, and applying a negative bias to the charging roller 32 causes the toner having adhered to the charging roller 32 to be electrostatically transferred to the intermediate transfer belt 20. Regularly performing this transfer process (ejection process) enables toner adhered to the charging roller 32 to be removed and favorable cleaning performance to be maintained.

In addition, the toner ejected onto the intermediate transfer belt 20 is reverse-transferred to the photosensitive drum 2 in the primary transfer unit on the downstream side in the rotation direction of the intermediate transfer belt 20 and recovered by the drum cleaning apparatus 6. Specifically, in the image forming units 1*a* to 1*d* during the ejection process, by applying a negative bias from the power supply 40 to the transfer roller 5 of at least one image forming unit, ejected toner with a negative polarity is reverse-transferred to the photosensitive drum 2. Furthermore, eventually, the ejected toner with a negative polarity is removed from the photosensitive drum 2 by the drum cleaning blade 61 on the photosensitive drum 2.

(3) Belt Cleaning Mechanism after Jamming or after Density Adjusting Mode

Next, the belt cleaning mechanism which is executed after jamming or after the density adjusting mode as a non-image formation period in the present embodiment will be described in detail with reference to FIGS. 16A and 16B.

Figure 16A:
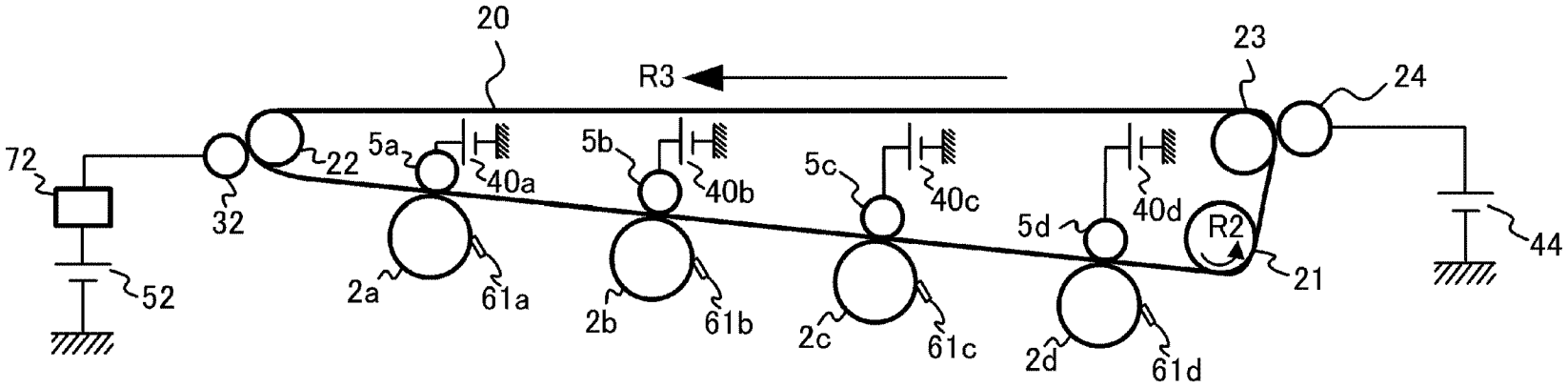
FIGS. 16A and 16B are diagrams for illustrating a belt cleaning mechanism in the third embodiment.

FIG. 16A is a schematic view showing polarities of biases applied to the charging roller 32, the primary transfer roller 5, and the secondary transfer roller 24 during image formation. FIG. 16B is a schematic view showing polarities of biases applied to the charging roller 32, the primary transfer roller 5, and the secondary transfer roller 24 during belt cleaning executed after jamming or after the density adjusting mode.

When cleaning secondary untransferred toner during image formation, a positive bias is respectively applied to the charging roller 32, the primary transfer roller 5, and the secondary transfer roller 24 as described above.

On the other hand, biases are applied as follows during belt cleaning executed after jamming or after the density adjusting mode. Specifically, a negative bias is applied to the charging roller 32, a negative bias is applied to the secondary transfer roller 24, and with respect to the primary transfer roller 5, a negative bias is applied in the first and fourth image forming units 1*a* and 1*d* but a positive bias is applied in the second and third image forming units 1*b* and 1*c*. A reason for setting the polarity of a bias applied to each member to the polarity shown in FIG. 16B will be described below.

Toner remaining on the intermediate transfer belt 20 during jamming and a test patch in the density adjusting mode is toner (hereinafter, also referred to as residual toner) that remains on the intermediate transfer belt 20 without being secondarily transferred and has the normal charging polarity of toner (in the present embodiment, a negative polarity). An amount of such residual toner is larger than that of secondary untransferred toner during an image formation period.

Therefore, when attempting to apply a positive bias to the charging roller 32 to impart a positive polarity to the residual toner in a similar manner to during an image formation period, it is difficult to uniformly impart a positive polarity to all of the residual toner because the polarity of the residual toner is a reverse polarity and a toner amount is large.

In consideration thereof, during a non-image formation period as described above, by applying a negative bias with a same polarity as the residual toner to the charging roller 32, residual toner is prevented by electrostatic repulsion from adhering to the charging roller 32 without reversing the polarity of the residual toner. At this point, the negative bias applied to the charging roller 32 is a bias for allowing the residual toner to pass through and a bias high enough to charge the toner need not be applied. Conversely, applying an excessively high negative bias ends up excessively charging the residual toner, and an increase in a reflection force of the toner with respect to the intermediate transfer belt 20 increases an electrostatic attachment force to the belt and may prevent the residual toner from being reverse-transferred to the photosensitive drum 2 in the primary transfer unit. Therefore, an absolute value of the negative bias applied to the charging roller 32 during cleaning is set to a value that is lower than an absolute value of the positive bias applied during an image formation period. In the present embodiment, while the bias applied to the charging roller 32 (a bias necessary for causing a target current of 30 μA to flow) during an image formation period is +1500 V, the bias applied to the charging roller 32 during cleaning is set to −500 V.

In a similar manner, a negative bias is also applied to the secondary transfer roller 24 to prevent residual toner by electrostatic repulsion from adhering to the secondary transfer roller 24.

On the other hand, at the primary transfer roller 5, the polarity of an applied bias is changed for each image forming unit. A negative bias is applied to the primary transfer rollers 5*a* and 5*d* in the first and fourth image forming units 1*a* and 1*d* to electrostatically reverse-transfer the residual toner having passed through the secondary transfer roller 24 and the charging roller 32 to the photosensitive drums 2*a* and 2*d* and to remove the residual toner from the intermediate transfer belt 20. The residual toner to be removed from the intermediate transfer belt 20 in the primary transfer unit is reverse-transferred to the photosensitive drum 2 and subsequently removed and recovered from the photosensitive drum 2 by the drum cleaning blade 61*a* in the drum cleaning apparatus 6*a* in a similar manner to cleaning during an image formation period. The reason for performing the recovery of the residual toner with two image forming units, namely, the first and fourth image forming units 1*a* and 1*d* is because, in a case where an amount of the residual toner is large, it is difficult to recover all of the residual toner at once when only one image forming unit is used. A case where an amount of the residual toner is large is, for example, when jamming occurs during printing of an image with a high print percentage. In the present embodiment, residual toner which the first image forming unit 1*a* fails to recover is recovered by the fourth image forming unit 1*d* positioned downstream from the first image forming unit 1*a* in the rotation direction of the intermediate transfer belt 20.

In addition, a positive bias is applied to the primary transfer rollers 5*b* and 5*c* in the second and third image forming units 1*b* and 1*c*. While most of the toner remaining on the intermediate transfer belt 20 after jamming or after the density adjusting mode is toner with a negative polarity, toner with a positive polarity also exists, albeit in a minute amount. For example, when jamming occurs, a part of the secondary untransferred toner present in an already secondarily-transferred region has been imparted with a positive bias from the secondary transfer roller 24 during image formation and has been positively polarized. In order to recover toner with such a positive polarity during cleaning, a positive bias is applied to the primary transfer rollers 5*b* and 5*c*. Accordingly, the toner with a positive polarity on the intermediate transfer belt 20 can be electrostatically transferred to the photosensitive drums 2*b* and 2*c*.

As described above, in belt cleaning during a non-image formation period such as after jamming or after the density adjusting mode, toner with a negative polarity which remains on the intermediate transfer belt 20 is reverse-transferred by the primary transfer unit and recovered by the image forming unit without charging the toner with a reverse polarity by the charging roller 32.

The polarity of the bias applied to the primary transfer roller of each image forming unit is not limited to the combination described in the present embodiment and can be optimized as appropriate in accordance with an amount of the residual toner and recovery performance at the photosensitive drum. For example, when the amount of residual toner is small, a configuration may be adopted in which a negative bias is only applied to the primary transfer roller 5*a* and a positive bias is applied to the primary transfer rollers 5*b*, 5*c*, and 5*d*. Conversely, when the amount of residual toner is large, a configuration may be adopted in which a negative bias is applied to the primary transfer rollers 5*a*, 5*c*, and 5*d* and a positive bias is only applied to the primary transfer roller 5*b*.

In addition, when the amount of residual toner recovered by a specific image forming unit is large, there is a risk that recovery failure (toner slipping through) at the drum cleaning blade 61 may occur. In consideration thereof, the recovery of the residual toner is favorably distributed among a plurality of image forming units by adjusting periods of time during which a negative bias is applied and application timings of the negative bias. Since the recovery of the residual toner is performed while a negative bias is being applied to the primary transfer roller, reducing a period of time of application of the negative bias in a specific image forming unit enables a recovery amount of the residual toner by the image forming unit to be reduced. For example, in the present embodiment, adjusting a period of time of application of a negative bias to the primary transfer roller 5*a* and a period of time of application of a negative bias to the primary transfer roller 5*d* enables a toner amount to be recovered by the drum cleaning blades 61*a* and 61*d* to be adjusted. Accordingly, a large amount of residual toner can be prevented from being sent to one drum cleaning blade 61.

In addition, a recovery method of residual toner on the intermediate transfer belt 20 is not limited to the recovery method using the image forming unit 1 as described above and, for example, a method using a dedicated recovery apparatus provided on the intermediate transfer belt 20 may be used.

Furthermore, while a case where belt cleaning is executed after jamming or after the density adjusting mode has been described in the present embodiment, a timing of execution of belt cleaning is not limited thereto. The belt cleaning according to the present embodiment is favorably executed during a non-image formation period in a case where an amount of toner remaining on the intermediate transfer belt 20 is larger than an amount of secondary untransferred toner during an image formation period.

(4) Setting of Developing Blade Bias During Belt Cleaning after Jamming or after Density Adjusting Mode Next, the setting of a developing blade bias during belt cleaning after jamming or after the density adjusting mode which is a feature of the present embodiment will be described in detail with reference to FIGS. 17A to 17C.

A feature of the present embodiment is that a difference in potential ΔVb of the developing blade bias relative to the developing bias during belt cleaning after jamming or after the density adjusting mode is set to a value on a side of a same polarity as the normal charging polarity of toner as compared to a difference in potential ΔVb during an image formation period. In other words, a feature of the present embodiment is that a difference in potential of voltage applied to the developing blade 81 relative to voltage applied to the developing roller 8 is further shifted toward a side of negative polarity. In the following description, setting the difference in potential ΔVb to a value on a side of a same polarity as the normal charging polarity of toner as compared to the difference in potential ΔVb during an image formation period may be described as setting the difference in potential ΔVb to a large value on a side of a same polarity as the normal charging polarity of toner or may be simply described as increasing (raising) the difference in potential ΔVb.

The reason for increasing the difference in potential ΔVb of the developing blade bias relative to the developing bias is to reduce "fogging toner" to be transferred to the intermediate transfer belt during belt cleaning after jamming or after the density adjusting mode.

Figure 17B:
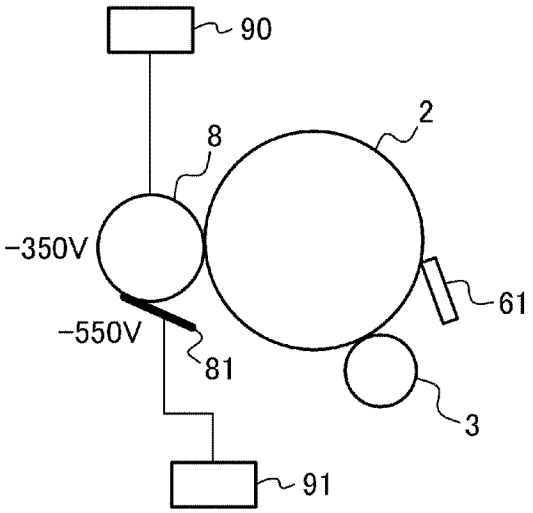
FIGS. 17A to 17C are diagrams for illustrating a relationship between a developing bias and a developing blade bias according to the third embodiment.
Figure 17A:
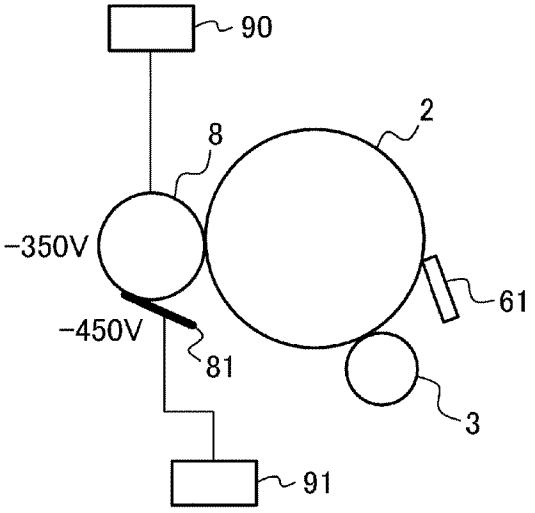

FIGS. 17A and 17B are schematic views showing a relationship between a developing bias applied to the developing roller 8 and a developing blade bias applied to the developing blade 81, in which FIG. 17A shows a relationship during image formation and FIG. 17B shows a relationship during cleaning after jamming or after the density adjusting mode.

As the developing bias applied to the developing roller 8, an optimum value is selected in accordance with a degree of wear of the developing apparatus 4 (the respective members constituting the developing apparatus 4) or the photosensitive drum 2, a use environment, and the like. For example, when the developing bias is set to −350 V, the developing blade bias applied to the developing blade 81 during an image formation period is set to −450 V, and the difference in potential ΔVb of the developing blade bias relative to the developing bias is set to −100 V (FIG. 17A). By comparison, during cleaning after jamming or after the density adjusting mode, the developing blade bias applied to the developing blade 81 is set to −550 V relative to the developing bias being set to −350 V. In this manner, the difference in potential ΔVb of the developing blade bias relative to the developing bias is set to −200 V which is higher than the setting during an image formation period (FIG. 17B).

In the present embodiment, by increasing the difference in potential of the developing blade bias relative to the developing bias, discharge with a negative polarity from the developing blade 81 to toner on the developing roller 8 becomes active and the polarity of the toner on the developing roller 8 can be shifted further toward the side of negative polarity.

Figure 17C:
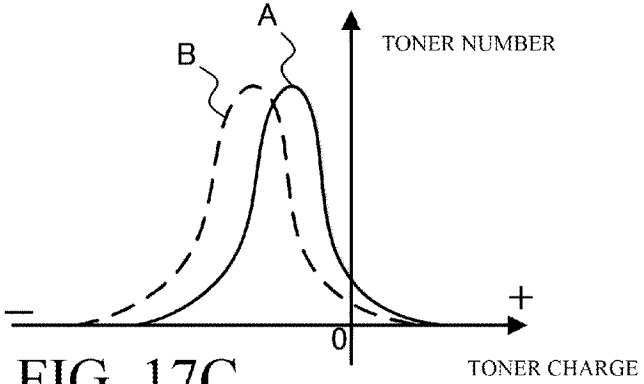

FIG. 17C is a diagram schematically representing charge distributions of toner on the developing roller 8, in which a solid line A indicates a charge distribution when the difference in potential ΔVb of the developing blade bias relative to the developing bias is −100 V (FIG. 17A) and a dashed line B indicates a charge distribution when ΔVb=−200 V (FIG. 17B). In this manner, setting the developing blade bias higher on the side of negative polarity relative to the developing bias enables the toner on the developing roller 8 to be charged further toward the side of negative polarity.

In FIG. 17B in which the toner on the developing roller 8 is charged further toward the side of negative polarity, even if triboelectric charging due to friction with the photosensitive drum 2 causes a shift toward the side of positive polarity, the charge distribution after the triboelectric charging exists further on the side of negative polarity than the charge distribution after triboelectric charging in FIG. 17A. Therefore, an amount of the "fogging toner" to be transferred to the photosensitive drum 2 is smaller during cleaning after jamming or after the density adjusting mode (FIG. 17B) than during an image formation period (FIG. 17A).

In addition, even with respect to toner of which chargeability has declined due to deterioration in accordance with wear of the developing apparatus 4 and is no longer capable of maintaining a normal charge quantity on the developing roller 8, by increasing the developing blade bias toward the side of negative polarity and making discharge of a negative polarity active, the charge quantity of the toner can be brought closer to the normal charge quantity. Accordingly, the amount of the "fogging toner" to be transferred to the photosensitive drum 2 can be reduced.

As described above, setting the developing blade bias higher on the side of negative polarity relative to the developing bias enables the amount of the "fogging toner" to be transferred to the photosensitive drum 2 to be reduced. As a result, the amount of the "fogging toner" to be transferred to the intermediate transfer belt 20 in the subsequent primary transfer unit can be reduced.

Figure 18:
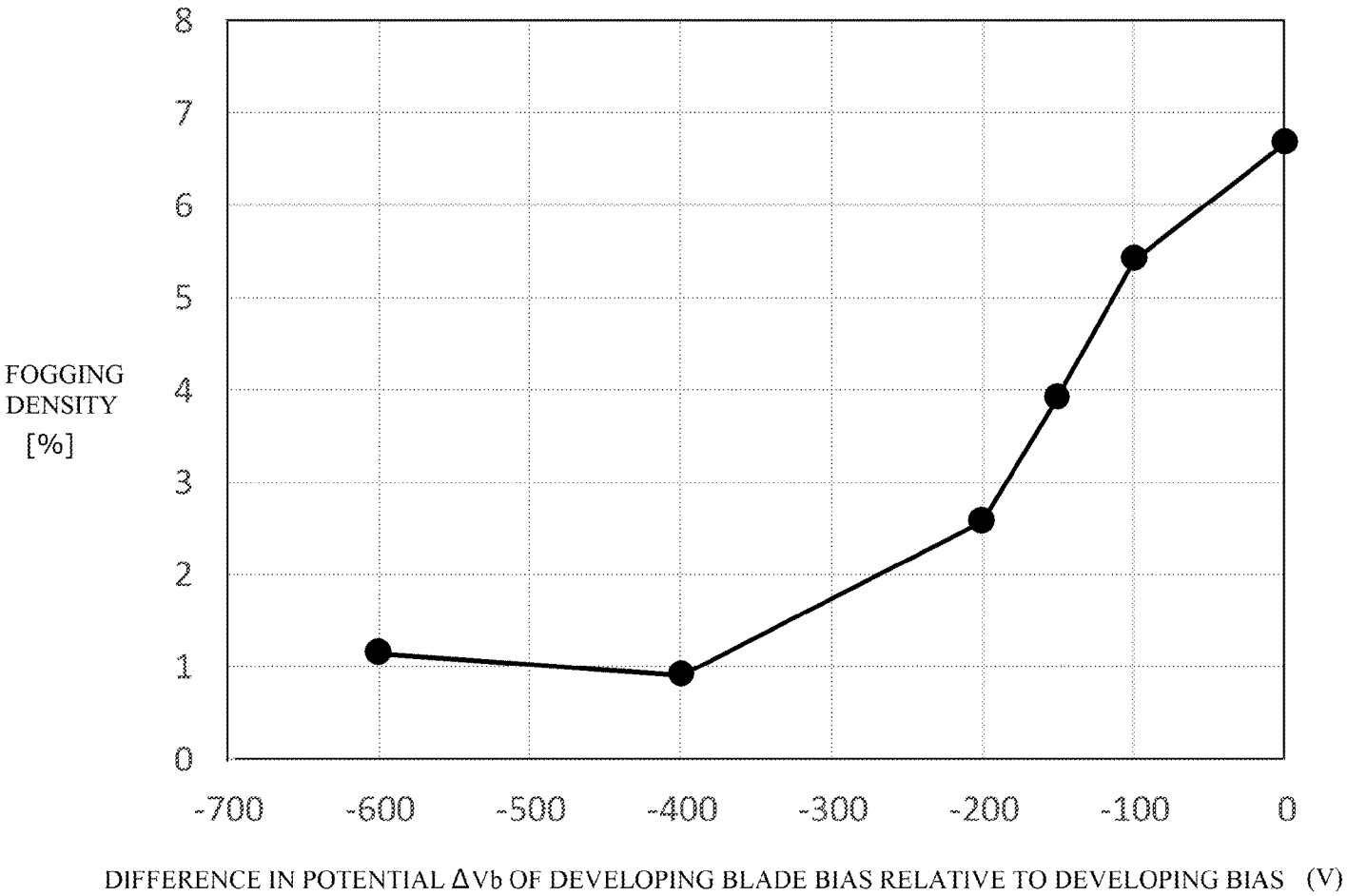
FIG. 18 is a diagram showing a measurement result of a fogging toner amount that is transferred onto an intermediate transfer belt according to the third embodiment.

FIG. 18 shows a result of measurement of an amount of the "fogging toner" to be transferred onto the intermediate transfer belt 20 when the difference in potential ΔVb of the developing blade bias relative to the developing bias is allocated in the present embodiment. In FIG. 18, an abscissa indicates the difference in potential ΔVb of the developing blade bias relative to the developing bias, and an ordinate indicates a fogging density of the "fogging toner" remaining on the intermediate transfer belt 20 at the end of cleaning after jamming or after the density adjusting mode.

In this case, the fogging density of the "fogging toner" on the intermediate transfer belt 20 was measured by the following procedure. First, a sheet of paper with a solid white image (an image with a print percentage of 0%) is printed, and the sheet of paper is forcibly stopped midway through printing to cause jamming. Subsequently, the jammed sheet of paper is removed and cleaning after jamming is executed. In a state where cleaning after jamming has ended, the "fogging toner" existing on the intermediate transfer belt 20 is adhered to an adhesive tape (trade name Scotch (registered trademark) Mending Tape, manufactured by 3M Japan Limited). Next, the adhesive tape having collected the "fogging toner" is affixed to a sheet of white paper (trade name GF-0081, manufactured by Canon Inc.). In addition, an adhesive tape not having collected the "fogging toner" is also affixed to the same sheet of paper for comparison. Furthermore, using "REFLECTMETER MODEL TC-6DS" (manufactured by Tokyo Denshoku Co., Ltd.), a degree of whiteness (reflectance D1(%)) of the adhesive tape portion having collected the "fogging toner" and a degree of whiteness (reflectance D2(%)) of the adhesive tape portion not having collected the "fogging toner" are measured. In addition, from a difference thereof, fogging density (%) (=D2(%)−D1(%)) is measured.

FIG. 18 shows that the larger an absolute value of the difference in potential ΔVb of the developing blade bias relative to the developing bias, the lower the fogging density of the "fogging toner" on the intermediate transfer belt 20.

This result also experimentally shows that increasing the difference in potential ΔVb reduces the amount of the "fogging toner" to be transferred to the intermediate transfer belt 20.

As described earlier, the "fogging toner" is toner which does not have a proper charge quantity and refers to, for example, toner with a negative polarity but a small charge quantity or toner charged with a reverse polarity (in the present embodiment, a positive polarity) to the normal polarity. The "fogging toner" is created when chargeability of toner declines due to deterioration in accordance with wear of the developing apparatus 4 and the toner is no longer capable of maintaining a normal charge quantity on the developing roller 8. In addition, the "fogging toner" is created when polarity of toner on the developing roller 8 shifts toward the side of positive polarity due to triboelectric charging between the toner and the photosensitive drum 2.

Such the "fogging toner" has weak electrostatic repulsion relative to a region in which an electrostatic latent image is not formed on the photosensitive drum 2 and may be inadvertently transferred to a region in which an electrostatic latent image is not formed. Therefore, even during cleaning after jamming or after the density adjusting mode which is a non-image formation period in which an electrostatic latent image is not formed, fogging toner may be inadvertently transferred to the photosensitive drum 2 and, in turn, to the intermediate transfer belt 20 via the primary transfer unit.

An example of means for preventing the "fogging toner" from being transferred to a photosensitive drum during cleaning after jamming or after the density adjusting mode is a method involving mechanically separating a developing roller from a photosensitive drum during cleaning. However, with an image forming apparatus in which a separation mechanism of a developing roller is not provided for the purpose of cost reduction or an image forming apparatus in which separation of the developing roller cannot be realized during cleaning due to other constraints, there is a concern that the "fogging toner" may be transferred to a photosensitive drum and, further, to the intermediate transfer belt. For example, a constraint may be imposed in that, in order to reduce noise (blade squeal) due to minute vibrations generated by friction between a photosensitive drum and a drum cleaning blade, the developing roller must be constantly brought into contact with the photosensitive drum to suppress such minute vibrations. In such a case, since the developing roller cannot be separated from the photosensitive drum, there is a concern that the "fogging toner" may be transferred to the intermediate transfer belt during cleaning.

In this manner, when the "fogging toner" is inadvertently transferred to the intermediate transfer belt during cleaning after jamming or after the density adjusting mode, there is a risk that faulty cleaning attributable to the "fogging toner" may occur when performing image formation after the cleaning.

Figure 16B:
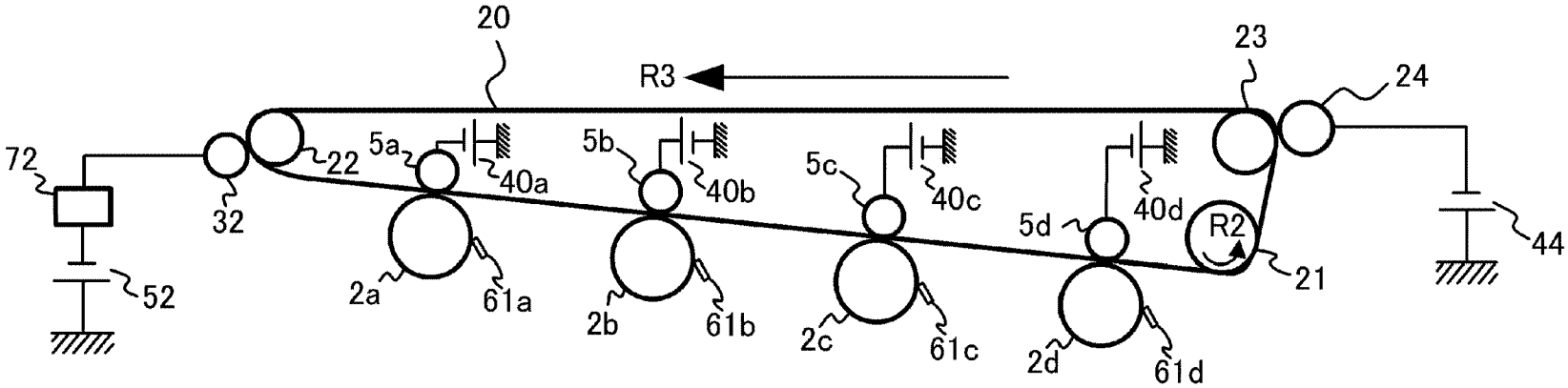

During cleaning after jamming or after the density adjusting mode, as shown in FIG. 16B, a polarity of the bias applied to the charging roller 32 is a negative bias and is not high enough to charge residual toner. Therefore, the "fogging toner" on the intermediate transfer belt cannot be charged with a uniform polarity and a state exists where the "fogging toner" retains a lower charge quantity than a normal charge quantity. Accordingly, it is difficult to electrostatically reverse-transfer the "fogging toner" to the photosensitive drum in the primary transfer unit. As a result, the "fogging toner" remains on the intermediate transfer belt even after cleaning.

In addition, in the event where an amount of the "fogging toner" remaining on the intermediate transfer belt is large, it is difficult to uniformly impart a positive polarity to all of the "fogging toner" even if the "fogging toner" is charged with a positive polarity by the charging roller to which a positive bias has been applied when performing image formation after the cleaning is finished. This is because, the "fogging toner" is toner which has low chargeability due to deterioration to begin with and which is less chargeable than secondary untransferred toner during an image formation period even when charged by the charging roller.

Therefore, when there is a large amount of residual the "fogging toner", there is risk that the "fogging toner" may become visible as a stain (faulty cleaning) on an output image during a next image formation period.

In consideration thereof, for the purpose of preventing faulty cleaning due to the "fogging toner" remaining on the intermediate transfer belt, the "fogging toner" can conceivably be recovered by carrying out the following method. In this method, once cleaning after jamming or after the density adjusting mode is completed, the intermediate transfer belt is rotated several turns in a state where a positive bias is applied to the charging roller based on constant-current control, and the "fogging toner" is gradually charged with a positive polarity and recovered by the primary transfer unit. However, with this method, there is a risk that a period of time from an end of processing of jamming or an end of density adjustment to a start of next image formation may increase and downtime may be extended.

In consideration thereof, in the present embodiment, the difference in potential ΔVb of the developing blade bias relative to the developing bias during cleaning after jamming or after the density adjusting mode is set to a larger value than the difference in potential ΔVb during an image formation period. At this point, as described earlier, an absolute value of a negative bias applied to the charging roller 32 is set to a value that is lower than an absolute value of a positive bias applied during an image formation period.

Accordingly, since an amount of the "fogging toner" to be transferred to the intermediate transfer belt 20 can be reduced, faulty cleaning attributable to the "fogging toner" can be prevented without increasing downtime required by cleaning.

Moreover, although FIG. 18 shows that the larger the difference in potential ΔVb, the smaller the amount of the "fogging toner" to be transferred to the intermediate transfer belt, the difference in potential ΔVb is limited to −200 V in the present embodiment. The reason for this is to suppress abnormal discharge from the developing blade 81 to the developing roller 8. An excessively large difference in potential ΔVb may prevent a uniform discharge from the developing blade 81 to the developing roller 8 from being maintained and may locally create a strong discharge (abnormal discharge). When an abnormal discharge occurs, a variation may be created in the charge distribution of toner on the developing roller 8 and, at the same time, damage may be inflicted on the developing blade 81 and the developing roller 8. Therefore, in the present embodiment, the difference in potential ΔVb is set to −200 V which is as high as possible within a range where an abnormal discharge does not occur. Such a value in a range where an abnormal discharge does not occur between the developing roller 8 and the developing blade 81 is favorably determined in advance.

In addition, while the difference in potential ΔVb is set to −200 V only during cleaning after jamming or after the density adjusting mode and the difference in potential ΔVb is not set to −200 V during a normal image formation period in the present embodiment, a reason therefor will be described below.

When the difference in potential ΔVb is constantly set to a high value, active discharge between the developing roller 8 and the developing blade 81 may, for example, promote deterioration of the semiconductive resin which coats SUS constituting the developing blade 81. In addition, deterioration of a surface of the developing roller 8 may be promoted. Therefore, constantly increasing the developing blade bias toward a side of negative polarity including during image formation may possibly shorten a durability lifetime of the developing apparatus 4.

In consideration thereof, in the present embodiment, the lifetime of the developing apparatus 4 is prolonged by setting the difference in potential ΔVb relatively low to −100 V based on the judgment that belt cleaning performance is favorable during an image formation period in which a positive bias is applied to the charging roller 32 and secondary untransferred toner is positively charged and recovered.

On the other hand, since belt cleaning performance is unfavorable during cleaning after jamming or after the density adjusting mode when a weak negative bias is being applied to the charging roller 32, the difference in potential ΔVb is set relatively high to −200 V. Accordingly, an amount of the "fogging toner" to be transferred to the intermediate transfer belt 20 can be reduced and favorable cleaning performance can be ensured.

As described above, in the present embodiment, the lifetime of the developing apparatus 4 is prolonged while obtaining favorable cleaning performance by changing the difference in potential ΔVb of the developing blade bias relative to the developing bias in accordance with the cleaning performance of the charging roller 32 on the intermediate transfer belt 20.

(5) Result of Image Output Experiment

Next, a result of an image output experiment conducted in the present embodiment, a third comparative example, and a fourth comparative example will be described.

In the image output experiment, output images were compared by respectively setting the difference in potential ΔVb of the developing blade bias relative to the developing bias during cleaning after jamming or after the density adjusting mode in the present embodiment, the third comparative example, and the fourth comparative example to −200 V, −100 V, and −400 V.

To compare output images, first, a sheet of paper with a solid white image (an image with a print percentage of 0%) is printed, and the sheet of paper is forcibly stopped midway through printing to cause jamming. Subsequently, the jammed sheet of paper is removed and cleaning after jamming is executed. The difference in potential ΔVb of the developing blade bias relative to the developing bias during cleaning after jamming is set to −100 V (third comparative example), −200 V (present embodiment), and −400 V (fourth comparative example).

Subsequently, once the cleaning after jamming ends, solid white images are consecutively passed, and cleaning performances are compared based on whether or not a stain (faulty cleaning) attributable to the "fogging toner" occurs on the solid white images.

The image forming apparatus used to carry out the output experiment had a processing speed of 180 mm/sec and a throughput of 30 pages per minute. GF-0081 (trade name) manufactured by Canon Inc. was used as the sheet of paper, and plain paper mode was selected as the image formation mode.

Table 5 shows a result of a presence/absence of faulty cleaning on output images in the present embodiment and in the third and fourth comparative examples. In table 5, "present" denotes a case where faulty cleaning has occurred and "absent" denotes a case where faulty cleaning has not occurred.

In addition, whether or not an abnormal discharge occurs between the developing roller and the developing blade in the present embodiment and in the third and fourth comparative examples was also determined. A presence or absence of an occurrence of an abnormal discharge was determined based on whether or not non-uniform coating attributable to an abnormal discharge occurred in a toner layer coating the developing roller when performing image formation at the respective bias settings of the present embodiment and the third and fourth comparative examples in an environment of 0.8 atmospheres. In table 5, "present" denotes a case where an abnormal discharge has occurred and "absent" denotes a case where an abnormal discharge has not occurred.

TABLE 5

Result of comparison of cleaning performance with comparative examples

| | Comparative example 3 (ΔVb = −100 V) | Present embodiment (ΔVb = −200 V) | Comparative example 4 (ΔVb = −400 V) |
|---|---|---|---|
| Presence/absence of faulty cleaning | Absent | Present | Present |
| Presence/absence of abnormal discharge | Present | Present | Absent |

As shown in Table 5, in the third comparative example in which the difference in potential ΔVb of the developing blade bias relative to the developing bias is set low to −100 V, a visually-confirmable toner stain had occurred on the solid white image that is the output image, and a result of cleaning performance was "present". In contrast, in the present embodiment and the fourth comparative example in which the difference in potential ΔVb is equal to or higher than −200 V, a visually-confirmable toner stain had not occurred on the solid white image that is the output image, and a result of cleaning performance was "absent". In this manner, the cleaning performance of the output image can be improved by increasing the difference in potential ΔVb.

Meanwhile, when focusing on abnormal discharge, an abnormal discharge was not confirmed or, in other words, results were "absent" in the third comparative example and the present embodiment in which the difference in potential ΔVb is equal to or lower than −200 V. In contrast, in the fourth comparative example in which the difference in potential ΔVb is −400 V, the result was "present" since non-uniform coating attributable to an abnormal discharge was confirmed in the toner layer coating the developing roller. In this manner, when the difference in potential ΔVb is excessively high, an abnormal discharge may occur between the developing roller and the developing blade and may inflict damage to the developing apparatus 4.

From the experimental results described above, it was found that the difference in potential ΔVb during cleaning after jamming or after the density adjusting mode is favorably set to a value described below. That is, since the difference in potential ΔVb is favorably set higher than a bias during an image formation period in order to improve cleaning performance but set to a value at which an abnormal discharge does not occur, the difference in potential ΔVb is set to −200 V in the present embodiment.

In the present embodiment, −200 V is set as the value of the difference in potential ΔVb of the developing blade bias relative to the developing bias. However, an optimum value of the difference in potential ΔVb varies in accordance with specifications of the image forming apparatus, and an optimum difference in potential ΔVb is favorably set in accordance with specifications of the image forming apparatus and in consideration of the cleaning performance of the charging roller, durability of the developing apparatus 4, and the like.

In addition, while the difference in potential ΔVb is increased by increasing the developing blade bias in the present embodiment, this method is not restrictive and the difference in potential ΔVb may be increased by reducing the developing bias or by changing both the developing blade bias and the developing bias.

Furthermore, while a configuration in which a negative bias is applied to the charging roller during cleaning after jamming or after the density adjusting mode has been described in the present embodiment, this configuration is not restrictive. The present invention can also be preferably applied to a configuration in which only a positive bias can be applied to the charging roller due to a reduction in cost or the like. In such a configuration, during cleaning after jamming or after the density adjusting mode, the bias applied to the charging roller may be set smaller than during an image formation period in order to make it difficult for residual toner having the normal charging polarity to adhere to the charging roller. In addition, cleaning performance can be improved by increasing the difference in potential ΔVb during cleaning after jamming or after the density adjusting mode.

Furthermore, while the charging roller 32 is used as a charging member for charging the secondary untransferred toner on the intermediate transfer belt in the present embodiment, the use of the charging roller 32 is not restrictive. As a charging member, a conductive brush member or the like may be used in place of the charging roller 32 or a conductive brush member or the like may be used in addition to a roller member.

Figure 19:
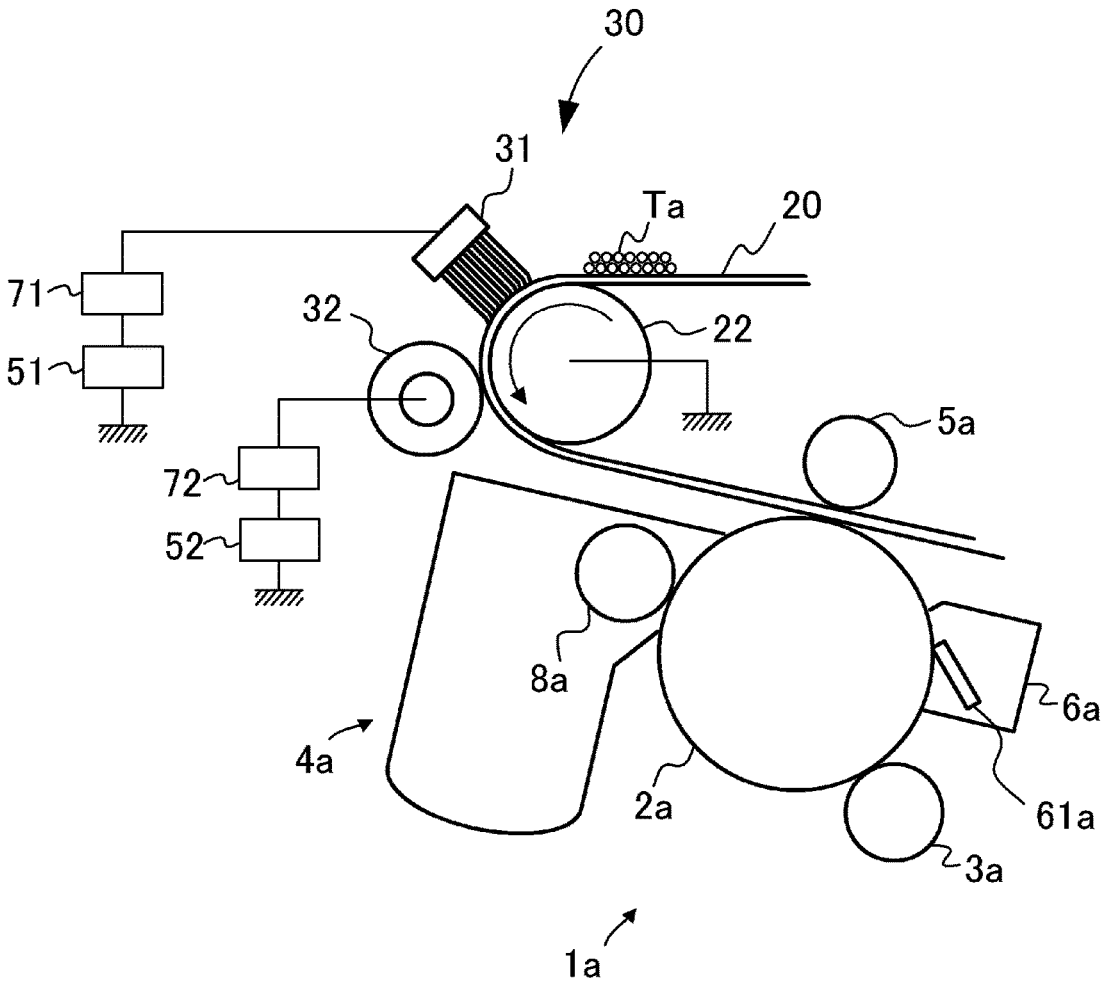
FIG. 19 is a diagram for illustrating a modification in which a conductive brush is provided on an upstream side of a charging roller.

FIG. 19 is a diagram for illustrating a modification in which a conductive brush is provided on an upstream side of the charging roller 32 in the rotation direction of the intermediate transfer belt 20.

In the example shown in FIG. 19, a conductive brush 31 is provided on an upstream side of the charging roller 32 in the rotation direction of the intermediate transfer belt 20 to improve cleaning performance. As the conductive brush 31, a nylon brush or the like given conductivity may be used and, as shown in FIG. 19, the conductive brush 31 is favorably electrically connected to a high-voltage power supply 51 via a current detection unit 71 and configured so that biases with a positive polarity and a negative polarity can be selectively applied thereto.

During an image formation period, a bias with a positive polarity is output from the high-voltage power supply 51 to the conductive brush 31. An output value thereof is controlled based on a current value detected by the current detection unit 71, and constant-current control is performed so that the current value is at a target current value set in advance. By providing the conductive brush 31 on an upstream side of the charging roller 32 in the rotation direction of the intermediate transfer belt 20, cleaning performance during an image formation period can be improved due to a pre-charging action with respect to toner on the intermediate transfer belt 20 and an action of dispersing the toner on the intermediate transfer belt 20. Therefore, an allowable amount of the "fogging toner" which does not cause faulty cleaning increases in the configuration (FIG. 19) which additionally includes the conductive brush 31 as compared to the configuration (FIG. 13) which only includes the charging roller 32.

Therefore, providing the conductive brush 31 enables a value of the difference in potential ΔVb during cleaning after jamming or after the density adjusting mode to be reduced and, as a result, enables the lifetime of the developing apparatus 4 to be prolonged.

Fourth Embodiment

Next, a fourth embodiment will be described. A basic configuration of the image forming apparatus according to the present embodiment is similar to that of the third embodiment. Therefore, in the present embodiment, only components that differ from those of the third embodiment will be described, and descriptions of components similar to those of the third embodiment will be omitted.

In the third embodiment, the difference in potential ΔVb between the developing blade bias and the developing bias during cleaning after jamming or after the density adjusting mode is set to a constant value. In contrast, a feature of the present embodiment is that the difference in potential ΔVb is changed in accordance with a degree of wear of the charging roller 32 and a degree of deterioration of toner T inside the image forming unit 1.

First, a reason for changing the difference in potential ΔVb in accordance with a degree of wear of the charging roller 32 will be described. When the image forming apparatus 10 is used over a long period of time, rubber itself of roller members may deteriorate due to energization of the charging roller 32 and discharge to toner and a discharge product created during charging of the toner may become stuck to a roller surface. In such a case, charging performance of the charging roller 32 or, in other words, cleaning performance of the charging roller 32 gradually declines as the number of printed sheets increases.

In consideration thereof, in the present embodiment, in a brand new state with high cleaning performance, the difference in potential ΔVb between the developing blade bias and the developing bias during cleaning after jamming or after the density adjusting mode is set low to prioritize prolongation of the lifetime of the developing apparatus 4. In addition, during a long period of use of the image forming apparatus 10 with declined cleaning performance, the difference in potential ΔVb is set high to prioritize reduction in an amount of the "fogging toner".

Next, a reason for changing the difference in potential ΔVb in accordance with a degree of deterioration of the toner T inside the image forming unit 1 will be described. When the image forming unit 1 is repetitively used, toner inside the developing apparatus 4 sustains mechanical damage due to stirring, friction with the developing blade, and the like as well as electrical damage due to the actions of energization and charging on the developing roller. As a result, the toner gradually deteriorates. Specifically, chargeability of the toner declines due to the external additive which contributes to toner chargeability detaching from or becoming embedded in the toner.

The degree of deterioration can be assessed based on, for example, a rotational distance of the developing roller 8 or an energization time of the developing blade 81.

In addition, the deterioration of the toner T becomes more prominent as the amount of toner T present inside the developing apparatus 4 decreases. This is because when the amount of toner T inside the developing apparatus 4 is small as compared when the amount of toner T is large, a frequency of one toner particle being influenced by stirring or energization is relatively high. The degree of influence can be assessed using, for example, an amount of the toner T remaining in the developing apparatus 4 as an indicator.

Therefore, as deterioration of the toner T progresses, since an existence probability of toner with low chargeability increases, a probability that the "fogging toner" is created also increases as a consequence.

In consideration thereof, in the present embodiment, in an initial stage of use of the image forming unit 1 in which a probability of occurrence of the "fogging toner" is relatively low, the difference in potential ΔVb is set low to prioritize prolongation of the lifetime of the developing apparatus 4. In addition, during a long period of use of the image forming unit 1 in which the probability of occurrence of the "fogging toner" increases, the difference in potential ΔVb is set high to prioritize suppression of the "fogging toner".

As described above, in the present embodiment, the difference in potential ΔVb during cleaning after jamming or after the density adjusting mode is changed in accordance with a cleaning performance of the charging roller 32 and a probability of occurrence of the "fogging toner" in the image forming unit. Accordingly, a balance between cleaning performance and the lifetime of the developing apparatus 4 can be optimized.

Next, a specific control method in the present embodiment will be described.

A degree of wear Cr (%) of the charging roller 32 ranging from brand new (0%) to end of a product lifetime (100%) of the charging roller is determined based on a history of the number of printed sheets of paper. In a similar manner, a degree of deterioration Cp (%) of the toner T inside the image forming unit 1 ranging from brand new (0%) to end of a product lifetime (100%) of the image forming unit is determined based on the history of the number of printed sheets of paper. In this case, Cp is determined by comprehensively taking a distance of travel of the developing roller 8 and an amount of the toner T inside the developing apparatus 4 into consideration. The control unit 11 which determines the degree of wear Cr (%) of the charging roller 32 and the degree of deterioration Cp (%) of the toner T corresponds to the calculating unit.

In addition, based on the determined (calculation results of) the degree of wear Cr (%) and the degree of deterioration Cp (%), the difference in potential ΔVb during cleaning after jamming or after the density adjusting mode is determined based on equation (2) below.

[Math. 2]

$$\Delta Vb = -\left(100 + \frac{a \cdot Cr + \beta \cdot Cp}{\alpha + \beta}\right) \quad \text{Equation (2)}$$

In equation (2), α and β are coefficients for respectively weighting contribution degrees of the degrees of deterioration of the charging roller and toner with respect to cleaning performance and, in the present embodiment, the coefficients are set such that α=2 and β=3.

In equation (2), when the charging roller 32 and the image forming unit 1 are both brand new, the difference in potential ΔVb is −100 V which is the same as during an image formation period, and a value of the difference in potential ΔVb gradually increases toward a maximum value (−200 V) depending on degrees of wear of the charging roller 32 and the image forming unit 1. For example, when the degree of wear Cr of the charging roller 32 is 50% and the degree of deterioration Cp of toner is 30%, the difference in potential ΔVb is −138 V, and when the developing bias is −350 V, −488 V is selected as the developing blade bias.

As described above, in the present embodiment, the difference in potential ΔVb during cleaning after jamming or after the density adjusting mode is changed as follows in accordance with a degree of wear of the charging roller 32 and a degree of deterioration of toner. That is, under conditions in which cleaning performance is severe, the difference in potential ΔVb is set relatively high. Accordingly, the "fogging toner" can be reduced. In addition, under conditions in which cleaning performance is favorable, the difference in potential ΔVb is set relatively low. Accordingly, the lifetime of the developing apparatus 4 can be prolonged.

As a result, in the present embodiment, the lifetime of the developing apparatus 4 can be further prolonged as compared to the third embodiment while maintaining favorable cleaning performance.

A calculation method of the difference in potential ΔVb in the present embodiment is not limited to the method described above, and an optimal calculation method in accordance with the influence of the degree of wear of the charging roller 32 and the degree of deterioration of the toner T to cleaning performance and a configuration of the image forming apparatus 10 is favorably used.

For example, when a comparison between the influence of the degree of wear of the charging roller 32 and the influence of the degree of deterioration of the toner T reveals that a degree of influence of one of the degree of wear and the degree of deterioration is significantly large, the numerical value can be determined by only taking one of the degree of wear and the degree of deterioration into consideration. In addition, the difference in potential ΔVb may be changed based on one of the degree of wear of the charging roller 32 and the degree of deterioration of the toner T.

Fifth Embodiment

Next, a fifth embodiment will be described. A basic configuration of the image forming apparatus according to the present embodiment is similar to that of the third embodiment. Therefore, in the present embodiment, only components that differ from those of the third embodiment will be described, and descriptions of components similar to those of the third embodiment will be omitted.

A feature of the present embodiment is that, as means for reducing the "fogging toner" to be transferred to the intermediate transfer belt during cleaning after jamming or after the density adjusting mode, a toner supplying bias applied to the toner supplying roller 82 is changed.

Specifically, a difference in potential ΔVs of the toner supplying bias relative to the developing bias during belt cleaning after jamming or after the density adjusting mode is set to a value on a side of an opposite polarity (in the present embodiment, a side of positive polarity) to the normal charging polarity of toner with respect to a difference in potential ΔVs during an image formation period. In other words, a feature of the present embodiment is that a difference in potential of voltage applied to the toner supplying roller 82 relative to voltage applied to the developing roller 8 is further shifted toward a side of positive polarity. At this point, in a similar manner to the third embodiment, an absolute value of a negative bias applied to the charging roller 32 is set to a value that is lower than an absolute value of a positive bias applied during an image formation period.

A reason why the amount of the "fogging toner" to be transferred to the intermediate transfer belt is reduced by shifting the difference in potential ΔVs toward a side of positive polarity will be described with reference to FIGS. 20A to 20C.

Figure 20A:
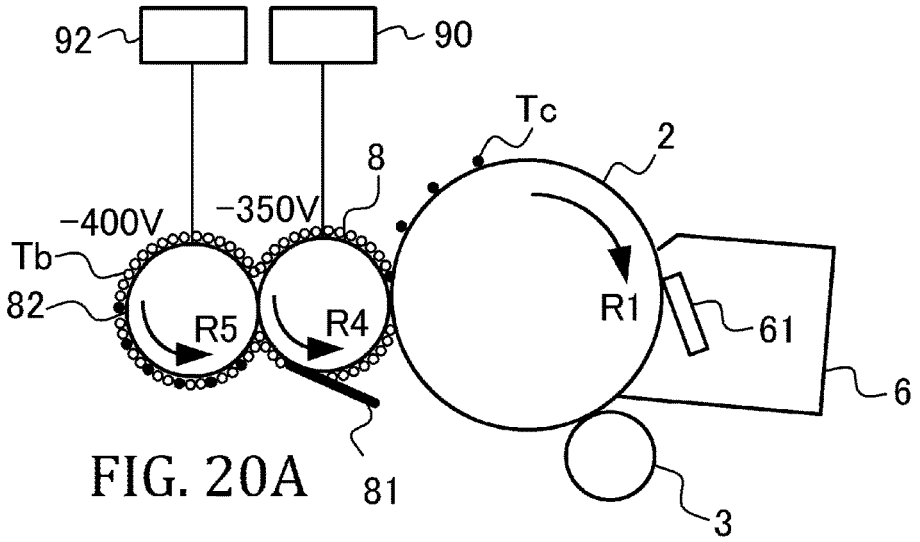
FIGS. 20A to 20C are diagrams for illustrating a relationship between a developing bias and a toner supplying bias according to a fifth embodiment.
Figure 20B:
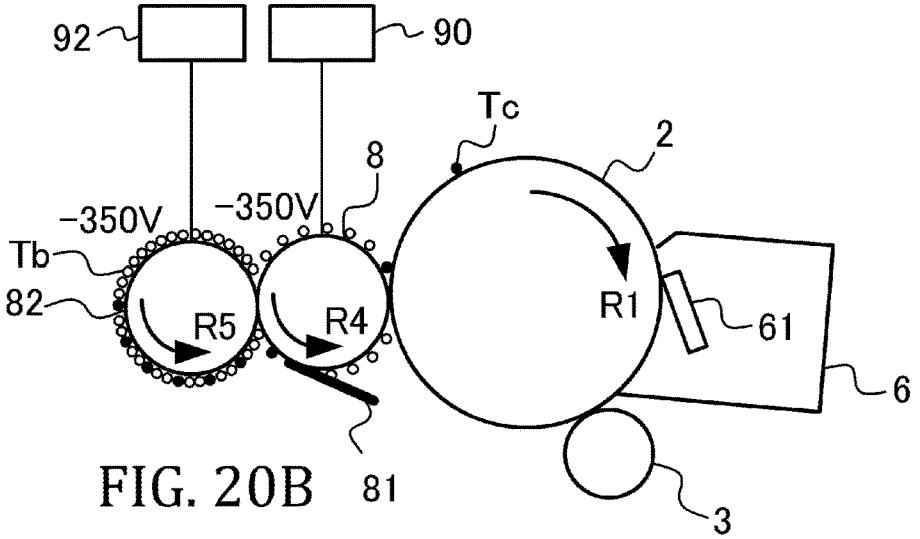
Figure 20C:
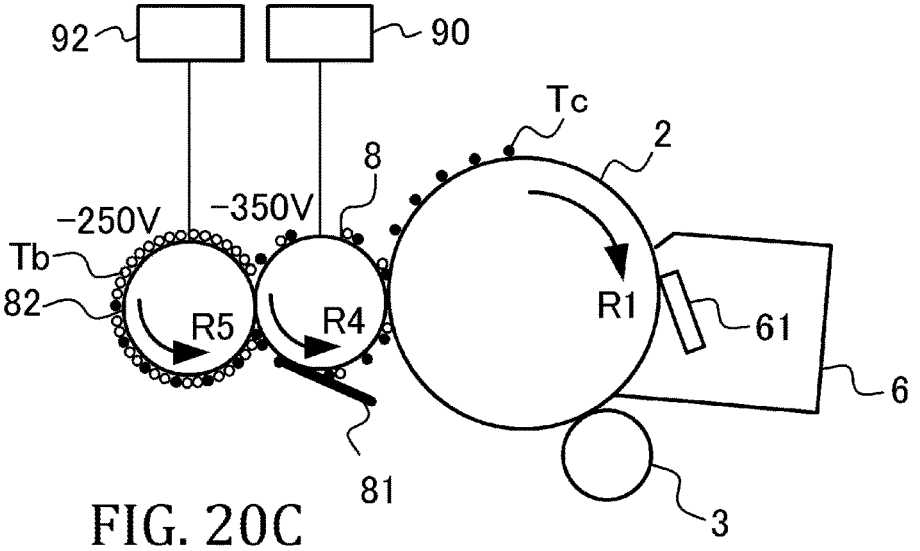

FIGS. 20A to 20C are diagrams schematically representing a relationship between a developing bias applied to the developing roller 8 and a toner supplying bias applied to the toner supplying roller 82, and a polarity and an amount of toner on the developing roller 8 and the photosensitive drum 2. In the diagrams, white circles denoted by Tb indicate toner with a negative polarity and black circles denoted by Tc indicate toner with a positive polarity.

FIG. 20A shows a relationship during image formation, in which toner supplying bias is −400 V as compared to the developing bias being −350 V, and the difference in potential ΔVs of the toner supplying bias relative to the developing bias is set to −50 V. In this manner, during image formation, a negative electric field is formed from the toner supplying roller 82 toward the developing roller 8, and the toner Tb (the white circles in the drawings) with a negative polarity that is the normal charging polarity is actively supplied to the developing roller 8. The reason for actively supplying toner with a negative polarity during image formation is to prevent a decline in solid-following capability (stability of density of a solid image) due to insufficient toner supply when an image with high print percentage such as a solid image (image with a maximum density level) is consecutively printed during an image formation period. When the toner amount supplied to the developing roller 8 is small, there is a concern that an image defect such as blank dots may occur when consecutively printing images with a high print percentage. Therefore, during image formation, the difference in potential ΔVs of the toner supplying bias relative to the developing bias is set to a side of negative polarity and toner with a negative polarity is actively supplied.

However, since a toner supply amount to the developing roller 8 is large, an amount of toner present on the developing roller 8 also increases, which inevitably leads to an increase in an amount of the "fogging toner" (the toner Tc indicated by black circles in the drawings) which is created by charging to a side of positive polarity due to triboelectric charging with the photosensitive drum.

On the other hand, FIG. 20B shows a relationship between the developing bias and the toner supplying bias during belt cleaning after jamming or after the density adjusting mode. During belt cleaning after jamming or after the density adjusting mode, the toner supplying bias is −350 V, and the difference in potential ΔVs of the toner supplying bias relative to the developing bias is set to 0 V, which represents a shift toward a side of positive polarity with respect to the difference in potential ΔVs during an image formation period (FIG. 20A).

The reason for shifting the difference in potential ΔVs toward a side of positive polarity during belt cleaning after jamming or after the density adjusting mode is to reduce the toner amount to be supplied to the developing roller 8. By shifting the difference in potential relative to the developing roller 8 toward a side of positive polarity, the negative electric field formed from the toner supplying roller 82 toward the developing roller 8 weakens and the supply amount of toner with a negative polarity decreases. In this manner, a decrease in the toner amount supplied to the developing roller 8 reduces the toner amount on the developing roller 8. Therefore, inevitably, the amount of the "fogging toner" created when the toner on the developing roller 8 is charged to a side of positive polarity due to triboelectric charging with the photosensitive drum 2 also decreases. In this manner, by reducing an absolute number of toner on the developing roller 8, the amount of the "fogging toner" can be reduced.

Moreover, since a period of belt cleaning after jamming or after the density adjusting mode is a non-image formation period and solid-following capability is not a concern, the difference in potential ΔVs can be shifted toward a side of positive polarity as in the present embodiment.

As described above, in the present embodiment, an amount in which the "fogging toner" is created can be reduced by shifting the difference in potential ΔVs of the toner supplying bias relative to the developing bias toward a side of positive polarity and reducing the toner amount on the developing roller 8. Since a decrease in the amount of the "fogging toner" also reduces the amount of the "fogging toner" to be transferred to the intermediate transfer belt 20, consequently, preferable cleaning performance can be realized.

FIG. 20C shows a relationship when the toner supplying bias is further shifted toward the side of positive polarity from FIG. 20B for comparison. In the relationship shown in FIG. 20C, the toner supplying bias is set to −250 V and the difference in potential ΔVs of the toner supplying bias relative to the developing bias is set to +100 V, which represents a further shift toward the side of positive polarity with respect to the relationship shown in FIG. 20B.

When the difference in potential ΔVs is extremely shifted toward the side of positive polarity, an electric field with a positive polarity is formed from the toner supplying roller 82 toward the developing roller 8. Accordingly, the toner supplying roller 82 electrostatically strips toner with a negative polarity off of the developing roller 8 and an amount of toner with a negative polarity on the developing roller 8 further decreases. However, as shown in FIG. 20C, since the toner Tc (the black circles in the drawings) with a positive polarity is supplied from the toner supplying roller 82 to the developing roller 8, a large amount of the "fogging toner" with a positive polarity exists on the developing roller 8 and, as a result, an amount of the "fogging toner" to be transferred to the photosensitive drum 2 increases.

In this manner, excessively shifting the difference in potential ΔVs toward the side of positive polarity conversely increases the amount of the "fogging toner" to be transferred to the intermediate transfer belt 20.

Figure 21:
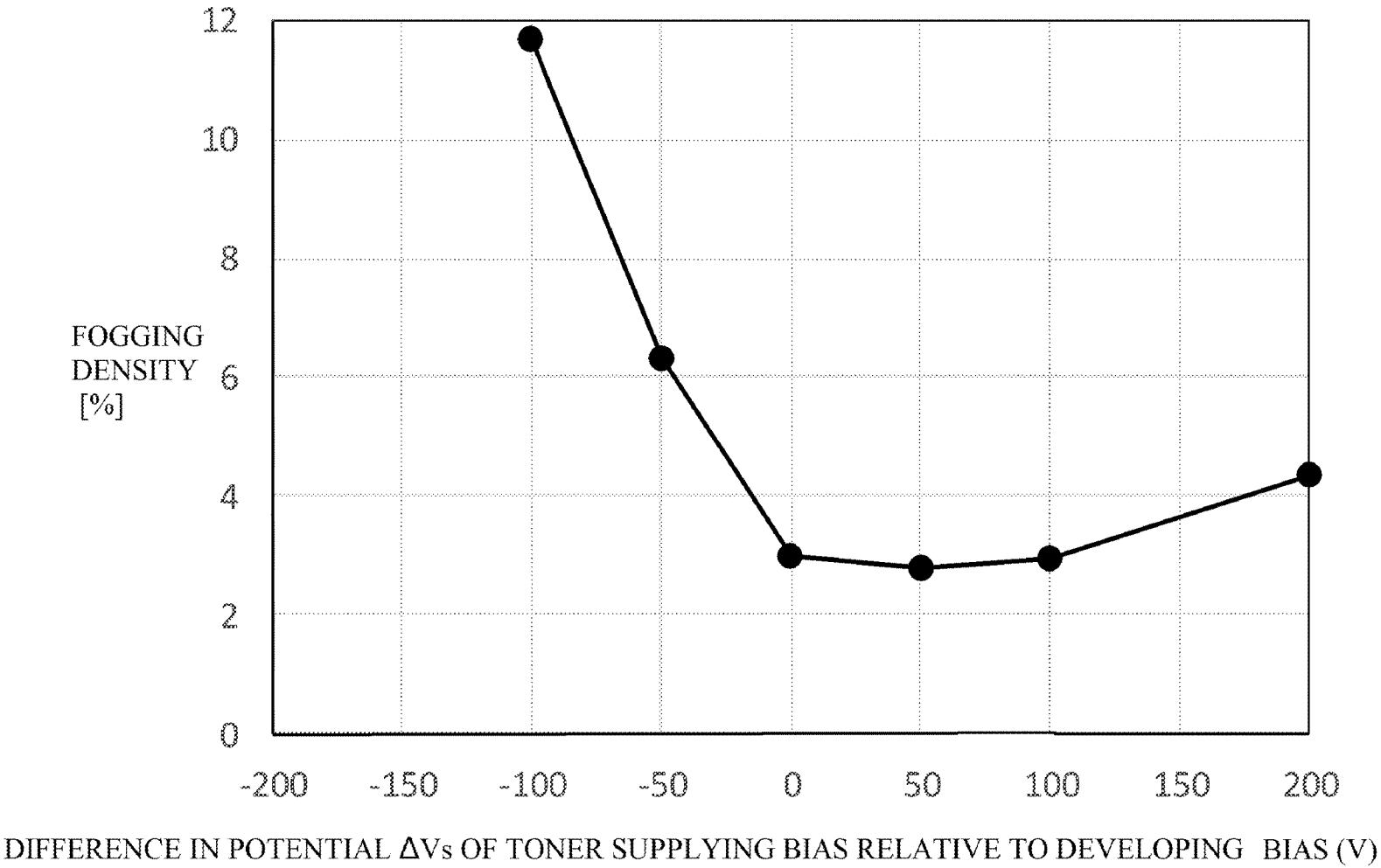
FIG. 21 is a diagram showing a measurement result of a fogging toner amount that is transferred onto an intermediate transfer belt according to the fifth embodiment.

FIG. 21 shows a result of actual measurements of an amount of the "fogging toner" to be transferred onto the intermediate transfer belt 20 when the difference in potential ΔVs of the toner supplying bias relative to the developing bias is allocated in the present embodiment. In FIG. 21, an abscissa indicates the difference in potential ΔVs of the toner supplying bias relative to the developing bias, and an ordinate indicates a fogging density of the "fogging toner" remaining on the intermediate transfer belt 20 at the end of cleaning after jamming or after the density adjusting mode.

In this case, the fogging density (%) (=D2(%)−D1(%)) of the "fogging toner" on the intermediate transfer belt 20 was measured by a procedure similar to that of the third embodiment.

As shown in FIG. 21, for example, when the difference in potential ΔVs of the toner supplying bias relative to the developing bias is −100 V which is high toward a side of negative polarity, the fogging density of the "fogging toner" on the intermediate transfer belt 20 is significantly high. In contrast, shifting the difference in potential ΔVs toward a side of positive polarity to −50 V and 0 V gradually reduces fogging density. On the other hand, further shifting the difference in potential ΔVs toward the side of positive polarity to +100 V or higher conversely increases the fogging density.

This result also experimentally shows that, by shifting the difference in potential ΔVs toward a side of positive polarity, the amount of the "fogging toner" to be transferred to the intermediate transfer belt 20 is reduced. However, it was confirmed that extremely shifting the difference in potential ΔVs toward the side of positive polarity increases toner with positive polarity which is supplied from the toner supplying roller 82 to the developing roller 8 and, consequently, increases the amount of the "fogging toner".

In consideration of the results described above, in the present embodiment, the difference in potential ΔVs during belt cleaning after jamming or after the density adjusting mode is set to 0 V (approximately 0 V).

As described above, in the present embodiment, the difference in potential ΔVs of the toner supplying bias relative to the developing bias during belt cleaning after jamming or after the density adjusting mode is properly shifted toward a side of positive polarity as compared to the difference in potential ΔVs during an image formation period. Accordingly, the "fogging toner" to be transferred to the intermediate transfer belt 20 can be reduced and preferable cleaning performance can be realized.

(6) Result of Image Output Experiment

Next, a result of an image output experiment conducted in the present embodiment, a fifth comparative example, and a sixth comparative example will be described.

In the image output experiment, output images were compared by respectively setting the difference in potential ΔVs of the toner supplying bias relative to the developing bias during cleaning after jamming or after the density adjusting mode in the present embodiment, the fifth comparative example, and the sixth comparative example to 0 V, −50 V, and +200 V.

To compare output images, first, a sheet of paper with a solid white image (an image with a print percentage of 0%) is printed, and the sheet of paper is forcibly stopped midway through printing to cause jamming. Subsequently, the jammed sheet of paper is removed and cleaning after jamming is executed. The difference in potential ΔVs of the toner supplying bias relative to the developing bias during cleaning after jamming is set to −50 V (fifth comparative example), 0 V (present embodiment), and +200 V (sixth comparative example).

Subsequently, once the cleaning after jamming ends, solid white images are consecutively passed, and cleaning performances are compared based on whether or not a stain (faulty cleaning) attributable to the "fogging toner" occurs on the solid white images.

The image forming apparatus used to carry out the output experiment had a processing speed of 180 mm/sec and a throughput of 30 pages per minute. GF-0081 (trade name) manufactured by Canon Inc. was used as the sheet of paper, and plain paper mode was selected as the image formation mode.

Table 6 shows a result of a presence/absence of faulty cleaning on output images in the present embodiment and in the fifth and sixth comparative examples. In table 6, "present" denotes a case where faulty cleaning has occurred and "absent" denotes a case where faulty cleaning has not occurred.

TABLE 6

Result of comparison of cleaning performance with comparative examples

| | Comparative example 5 (ΔVs = −50 V) | Present embodiment (ΔVs = 0 V) | Comparative example 6 (ΔVs = +200 V) |
|---|---|---|---|
| Presence/absence of faulty cleaning | Absent | Present | Absent |

As shown in Table 6, in the fifth comparative example in which the difference in potential ΔVs of the toner supplying bias relative to the developing bias is set to −50 V which is the same as during an image formation period, a visually-confirmable toner stain had occurred on the solid white image that is the output image, and a result of cleaning performance was "present". In contrast, in the present embodiment in which the difference in potential ΔVs is 0 V, a visually-confirmable toner stain had not occurred on the solid white image that is the output image, and a result of cleaning performance was "absent". On the other hand, in the sixth comparative example in which the difference in potential ΔVs is further shifted toward the side of positive polarity and set to +200 V, a visually-confirmable toner stain had occurred on the solid white image that is the output image albeit in a minute amount, and a result of cleaning performance was "present".

From the experimental results described above, it was found that the difference in potential ΔVs during cleaning after jamming or after the density adjusting mode is favorably set to a value described below. That is, since the difference in potential ΔVs is favorably shifted toward a side of positive polarity from the bias during an image formation period to reduce the toner supply amount to the developing roller 8 and, at the same time, set to a value at which a large amount of toner with a positive polarity is not supplied to the developing roller 8, the difference in potential ΔVs is set to 0 V in the present embodiment.

In the present embodiment, 0 V is set as the value of the difference in potential ΔVs of the toner supplying bias relative to the developing bias. However, an optimum value of the difference in potential ΔVs varies in accordance with specifications of the image forming apparatus, and an optimum difference in potential ΔVs is favorably set in accordance with specifications of the image forming apparatus and in consideration of the configurations of the toner supplying roller 82 and the developing roller 8, chargeability and a charge distribution of toner, and the like.

In addition, in the present embodiment, while a shift in the difference in potential ΔVs toward a side of positive polarity is realized by shifting the toner supplying bias toward the side of positive polarity, this method is not restrictive. Specifically, a shift in the difference in potential ΔVs toward the side of positive polarity may be realized by shifting the developing bias toward a side of negative polarity or changing both the toner supplying bias and the developing bias.

In addition, in a similar manner to the second embodiment, the difference in potential ΔVs may be calculated based on a degree of wear of the charging roller 32 and the degree of deterioration of the toner T in the present embodiment. In the present embodiment, when the degree of wear of the charging roller 32 and/or the degree of deterioration of the toner T is relatively high, the difference in potential ΔVs is to be set to a value on a side of an opposite polarity to the normal charging polarity as compared to when the degree of wear of the charging roller 32 and/or the degree of deterioration of the toner T is relatively low.

Sixth Embodiment

Next, a sixth embodiment will be described. A basic configuration of the image forming apparatus according to the present embodiment is similar to that of the third embodiment. Therefore, in the present embodiment, only components that differ from those of the third embodiment will be described, and descriptions of components similar to those of the third embodiment will be omitted.

A feature of the present embodiment is that, as means for reducing the "fogging toner" to be transferred to the intermediate transfer belt 20 during cleaning after jamming or after the density adjusting mode, a difference in potential between a surface potential (surface voltage) of the photosensitive drum 2 and the developing bias is changed.

The reason why the "fogging toner" to be transferred to the intermediate transfer belt 20 can be reduced by changing the difference in potential between the surface potential of the photosensitive drum 2 and the developing bias will be described in order.

As shown in FIG. 17C, in addition to toner charged with a negative polarity that is the normal charging polarity, toner with a negative polarity but having a small charge quantity and toner partially charged with a positive polarity exist on the developing roller 8. When the toner on the developing roller 8 is transferred onto the photosensitive drum 2 as the "fogging toner", a polarity of the transferred the "fogging toner" largely depends on a difference in potential between the surface potential of the photosensitive drum 2 and the developing bias. In this case, the surface potential of the photosensitive drum 2 is, more specifically, a surface potential (hereinafter, referred to as a dark-part potential Vd) before an electrostatic latent image is formed on the photosensitive drum 2 charged with a drum charging bias. In the following description, a difference in potential between the dark-part potential Vd and the developing bias will be referred to as a difference in potential Vback.

When the difference in potential Vback is small or, in other words, when an electric field with a negative polarity which is formed from the photosensitive drum 2 toward the developing roller 8 is weak, Coulomb force that acts on toner charged with a negative polarity on the developing roller 8 weakens. Therefore, toner with a relatively small charge quantity in the toner charged with a negative polarity is also transferred to the photosensitive drum 2 as the "fogging toner". Therefore, since toner with a negative polarity that is transferred to the photosensitive drum 2 increases when the difference in potential Vback is small, consequently, a polarity of the "fogging toner" shifts toward a side of negative polarity.

On the other hand, when the difference in potential Vback is large or, in other words, when an electric field with a negative polarity which is formed from the photosensitive drum 2 toward the developing roller 8 is strong, Coulomb force that acts on toner charged with a negative polarity on the developing roller 8 strengthens and an amount of toner with a negative polarity to be transferred to the photosensitive drum 2 decreases. However, due to stronger Coulomb force acting on a minute amount of toner with a positive polarity which exists on the developing roller 8, the amount of the "fogging toner" with a positive polarity to be transferred to the photosensitive drum 2 increases. Therefore, since toner with a positive polarity that is transferred to the photosensitive drum 2 increases when the difference in potential Vback is large, consequently, a polarity of the "fogging toner" shifts toward a side of positive polarity.

In this manner, depending on a magnitude of the difference in potential Vback between the dark-part potential Vd and the developing bias, the polarity of the "fogging toner" to be transferred to the photosensitive drum 2 can be controlled.

Meanwhile, when focusing on the primary transfer unit, by controlling the polarity of the "fogging toner" in accordance with a polarity of a bias to be applied to the primary transfer roller 5, an amount of the "fogging toner" to be transferred to the intermediate transfer belt 20 can be reduced.

For example, during cleaning after jamming or after the density adjusting mode, in the second and third image forming units 1*b* and 1*c*, a positive bias is applied to the primary transfer roller 5 as shown in FIG. 16B. In this case, in the second and third image forming units 1*b* and 1*c*, shifting the polarity of the "fogging toner" on the photosensitive drum 2 toward a side of positive polarity enables the amount of the "fogging toner" to be transferred to the intermediate transfer belt 20 to be reduced. This is due to the fact that, since an electric field with a positive polarity is formed from the primary transfer roller 5 toward the photosensitive drum 2, the "fogging toner" with a positive polarity is less likely to be electrostatically transferred to the intermediate transfer belt 20. Therefore, in the second and third image forming units 1*b* and 1*c*, increasing the difference in potential Vback and shifting the polarity of the "fogging toner" toward a side of positive polarity enables the amount of the "fogging toner" to be transferred to the intermediate transfer belt 20 to be reduced.

On the other hand, during cleaning after jamming or after the density adjusting mode, in the first and fourth image forming units 1*a* and 1*d*, a negative bias is applied to the primary transfer roller 5 as shown in FIG. 16B. In this case, in the first and fourth image forming units 1*a* and 1*d*, shifting the polarity of the "fogging toner" on the photosensitive drum 2 toward a side of negative polarity enables the amount of the "fogging toner" to be transferred to the intermediate transfer belt 20 to be reduced. This is due to the fact that, since an electric field with a negative polarity is formed from the primary transfer roller 5 toward the photosensitive drum 2, the "fogging toner" with a negative polarity is less likely to be electrostatically transferred to the intermediate transfer belt 20. Therefore, in the first and fourth image forming units 1*a* and 1*d*, reducing the difference in potential Vback and shifting the polarity of the "fogging toner" toward a side of negative polarity enables the amount of the "fogging toner" to be transferred to the intermediate transfer belt 20 to be reduced.

As described above, by changing the difference in potential Vback between the dark-part potential Vd of the photosensitive drum 2 and the developing bias in accordance with a polarity of the primary transfer bias of each image forming unit 1, the "fogging toner" to be transferred to the intermediate transfer belt 20 can be reduced. As a result, faulty cleaning attributable to the "fogging toner" can be prevented.

Next, a specific control method according to the present embodiment will be described.

During an image formation period, optimum values are selected for the developing bias and the drum charging bias in each image forming unit 1 in accordance with degrees of wear of the developing apparatus 4 and the photosensitive drum 2, a use environment, and the like. For example, a case will now be described in which the developing bias in each image forming unit 1 is set to −350 V during an image formation period, a drum charging bias is applied so that the dark-part potential Vd of the photosensitive drum 2 becomes −500 V, and the difference in potential Vback during an image formation period is set to 150 V.

In such a case, in the present embodiment, the value of the difference in potential Vback during cleaning after jamming or after the density adjusting mode is set to 120 V in the first and fourth image forming units 1*a* and 1*d* and set to 180 V in the second and third image forming units 1*b* and 1*c*.

In the first and fourth image forming units 1*a* and 1*d*, a value of the developing bias is set to −350 V which is the same as during an image formation period, a magnitude of the drum charging bias is reduced as compared to during an image formation period, and the dark-part potential Vd is set to −470 V. Accordingly, the difference in potential Vback is set to 120 V which is smaller than during an image formation period. By reducing the difference in potential Vback in this manner, a polarity of the "fogging toner" to be transferred to the photosensitive drum 2 can be shifted toward a side of negative polarity. Accordingly, in the first and fourth image forming units 1*a* and 1*d* in which a negative bias is applied to the primary transfer roller 5, an amount of the "fogging toner" to be transferred to the intermediate transfer belt 20 can be reduced.

On the other hand, in the second and third image forming units 1*b* and 1*c*, a value of the developing bias is set to −350 V which is the same as during an image formation period, a magnitude of the drum charging bias is increased as compared to during an image formation period, and the dark-part potential Vd is set to −530 V. Accordingly, the difference in potential Vback is set to 180 V which is larger than during an image formation period. By increasing the difference in potential Vback in this manner, a polarity of the "fogging toner" to be transferred to the photosensitive drum 2 can be shifted toward a side of positive polarity. Accordingly, in the second and third image forming units 1*b* and 1*c* in which a positive bias is applied to the primary transfer roller 5, an amount of the "fogging toner" to be transferred to the intermediate transfer belt 20 can be reduced.

As described above, in the present embodiment, the difference in potential Vback between the dark-part potential Vd of the photosensitive drum 2 and the developing bias is changed in accordance with a polarity of the primary transfer bias of each image forming unit 1. In other words, in the first and fourth image forming units 1*a* and 1*d*, during belt cleaning after jamming or after the density adjusting mode, a negative bias with a same polarity as residual toner is applied to the charging roller 32, a negative bias is applied to the primary transfer rollers 5*a* and 5*d*, and the difference in potential Vback is reduced. Accordingly, the residual toner on the intermediate transfer belt 20 can be preferably recovered. Furthermore, the polarity of the "fogging toner" to be transferred to the photosensitive drum 2 can be shifted toward a side of negative polarity, and the amount of the "fogging toner" to be transferred to the intermediate transfer belt 20 can be reduced.

In addition, in the second and third image forming units 1*b* and 1*c*, since a positive bias is applied to the primary transfer rollers 5*b* and 5*c*, the difference in potential Vback is increased. Accordingly, an amount of the "fogging toner" to be transferred to the intermediate transfer belt 20 can be similarly reduced.

As described above, even in the present embodiment, the "fogging toner" to be transferred to the intermediate transfer belt 20 can be reduced and, as a result, faulty cleaning attributable to the "fogging toner" can be prevented.

Moreover, in the present embodiment, the difference in potential Vback between the dark-part potential Vd of the photosensitive drum 2 and the developing bias during cleaning after jamming or after the density adjusting mode is set to 120 V in the first and fourth image forming units 1*a* and 1*d* and set to 180 V in the second and third image forming units 1*b* and 1*c*. However, settings are not limited thereto, and the value of the difference in potential Vback may be appropriately set to an optimum value in accordance with specifications of the image forming apparatus.

In addition, in consideration of an amount of the "fogging toner" with a negative polarity and an amount of the "fogging toner" with a positive polarity which are created in the image forming unit 1, control may be performed so that measures are taken only with respect to the "fogging toner" with one of the polarities. For example, when the amount of the "fogging toner" with a negative polarity which is created in the image forming unit 1 is extremely small, the following control may be performed. That is, during cleaning after jamming or after the density adjusting mode, the difference in potential Vback is increased only in the second and third image forming units 1*b* and 1*c* in which a positive bias is applied to the primary transfer roller 5, and the difference in potential Vback is not changed in the first and fourth image forming units 1*a* and 1*d*.

In addition, while the difference in potential Vback is changed by changing the drum charging bias in the present embodiment, this method is not restrictive and the difference in potential Vback may be changed by changing the developing bias or by changing both the drum charging bias and the developing bias.

Furthermore, in a similar manner to the fourth embodiment, the difference in potential Vback may be calculated based on a degree of wear of the charging roller 32 and the degree of deterioration of the toner T in the present embodiment. For example, in the present embodiment, in the first and fourth image forming units 1*a* and 1*d*, when the degree of wear of the charging roller 32 and/or the degree of deterioration of the toner T is relatively high, an absolute value of the difference in potential Vback may be reduced as compared to when the degree of wear of the charging roller 32 and/or the degree of deterioration of the toner T is relatively low. On the other hand, in the second and third image forming units 1*b* and 1*c*, when the degree of wear of the charging roller 32 and/or the degree of deterioration of the toner T is relatively high, an absolute value of the difference in potential Vback may be increased as compared to when the degree of wear of the charging roller 32 and/or the degree of deterioration of the toner T is relatively low.

As described above in the third to sixth embodiments, the "fogging toner" to be transferred to an intermediate transfer belt can be reduced by changing a developing blade bias, a toner supplying bias, and a drum charging bias during cleaning after jamming or after the density adjusting mode. Accordingly, faulty cleaning attributable to the "fogging toner" can be prevented without increasing downtime required by cleaning.

It is to be understood that the respective embodiments described above are intended to illustrate embodiments of the present invention and can be combined with each other or modified in various ways to the greatest extent feasible within the gist of the present invention. The advantageous effects produced by changing the respective biases including the developing blade bias, the toner supplying bias, and the drum charging bias as described in the third to sixth embodiments are independent of one another. Therefore, during cleaning after jamming or after the density adjusting mode, the respective biases may be appropriately combined and changed. For example, all of the developing blade bias, the toner supplying bias, and the drum charging bias can be changed at the same time. Accordingly, an amount of the "fogging toner" to be transferred to the intermediate transfer belt can be significantly reduced.

In addition, while cases where the normal charging polarity of toner is negative have been described in the respective embodiments, the present invention is not limited thereto and can be preferably applied to cases where the normal charging polarity of toner is positive. Furthermore, while modes in which an electrostatic latent image is developed by a reversal development system have been described in the respective embodiments, the present invention is not limited thereto. The present invention can also be preferably applied to an image forming apparatus adopting a normal development system.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190431, filed on Sep. 29, 2017, and Japanese Patent Application No. 2017-190398, filed on Sep. 29, 2017, which are hereby incorporated by reference herein in their entirety.

What is claimed is:

1. An image forming apparatus, comprising:

an image bearing member on which an electrostatic latent image is formed;

an image bearing member charging unit which applies an image bearing member charging voltage for charging the image bearing member;

a developer bearing member to which a developing voltage is applied and which bears and transports a developer in order to develop the electrostatic latent image formed on the image bearing member;

a primary transfer unit which primarily transfers a developer image developed on the image bearing member to an intermediate transfer member; and a charging member which applies a voltage to the intermediate transfer member so that the developer on the intermediate transfer member can be charged, the developer image being first primarily transferred to the intermediate transfer member by the primary transfer unit and then secondarily transferred to a recording material from the intermediate transfer member to form an image on the recording material, wherein the image forming apparatus operates in:

a first mode in which the developer, remaining on the intermediate transfer member without being secondarily transferred after the developer image is secondarily transferred to the recording material, is charged by the charging member with an opposite polarity to a normal charging polarity of the developer, and when primary transfer is performed, the developer is electrostatically removed from the intermediate transfer member and onto the image bearing member; and a second mode in which the developer existing on the intermediate transfer member is electrostatically removed from the intermediate transfer member and onto the image bearing member, and in the second mode, the intermediate transfer member is driven in a state in which an absolute value of the voltage applied to the charging member is lower than that in the first mode, and in which the developer bearing member and the image bearing member are in contact with each other, and a difference in potential between the developing voltage and the image bearing member charging voltage in the second mode differs from a difference in potential between the developing voltage and the image bearing member charging voltage in the first mode.

2. The image forming apparatus according to claim 1, wherein at least a part of the developer developed on the image bearing member is a fogging developer developed in a portion in which the electrostatic latent image is not formed, and when a charge quantity or a charging polarity of the fogging developer which is developed by the difference in potential between the developing voltage and the image bearing member charging voltage in the second mode is compared with a charge quantity or a charging polarity of the fogging developer which is developed by the difference in potential between the developing voltage and the image bearing member charging voltage in the first mode, at least one of the charge quantity and the charging polarity differs.

3. The image forming apparatus according to claim 1, wherein the second mode is a mode executed during cleaning after a paper jam occurs or after executing a density adjusting mode.

4. The image forming apparatus according to claim 1, wherein the image forming apparatus has a plurality of image forming units including the image bearing member, the image bearing member charging unit, and the developer bearing member.

5. The image forming apparatus according to claim 4, wherein in the second mode, after the developer remaining on the intermediate transfer member is charged by the charging member with the normal charging polarity of the developer, the developer remaining on the intermediate transfer member is recovered by applying a voltage with the normal charging polarity of the developer by the primary transfer unit corresponding to at least one of the plurality of image forming units.

6. The image forming apparatus according to claim 1, wherein the primary transfer unit has a primary transfer voltage applying unit, and when a polarity of a primary transfer voltage in the second mode is a negative polarity, the difference in potential between the developing voltage and the image bearing member charging voltage in the second mode is set to be less than that in the first mode.

7. The image forming apparatus according to claim 1, wherein the difference in potential between the developing voltage and the image bearing member charging voltage in the second mode is changed in accordance with at least one of a degree of wear of the charging member and a degree of deterioration of the developer.

8. An image forming apparatus, comprising:

an image bearing member on which an electrostatic latent image is formed;

a developer bearing member which bears a developer for developing the electrostatic latent image formed on the image bearing member;

a developer control member which controls an amount of the developer on the developer bearing member;

an intermediate transfer member which is provided with a transfer unit and in which a developer image developed on the image bearing member is primarily transferred to the transfer unit due to the transfer unit and the image bearing member coming into contact with each other and the developer image is further secondarily transferred from the transfer unit to a recording material due to the transfer unit and the recording material coming into contact with each other;

a charging member which charges the developer on the intermediate transfer member; and a cleaning unit capable of executing a cleaning mode in which the developer remaining on the intermediate transfer member after being secondarily transferred from the intermediate transfer member to the recording material is charged by the charging member and removed from the intermediate transfer member, wherein when executing the cleaning mode during a non-image formation period in which an image is not formed, the cleaning unit reduces an absolute value of a voltage applied to the charging member and, at the same time, sets a difference in potential ΔVb of a voltage applied to the developer control member relative to a voltage applied to the developer bearing member to a value on a side of a same polarity as a normal charging polarity of the developer, as compared to when executing the cleaning mode during an image formation period in which an image is formed.

9. The image forming apparatus according to claim 8, wherein the cleaning unit sets the difference in potential ΔVb to a value determined in advance at which an abnormal discharge does not occur between the developer bearing member and the developer control member.

10. The image forming apparatus according to claim 8, further comprising a calculating unit which calculates a degree of wear of the charging member and/or a degree of deterioration of the developer, wherein the cleaning unit changes the difference in potential ΔVb based on a result of a calculation by the calculating unit.

11. The image forming apparatus according to claim 10, wherein when the degree of wear of the charging member and/or the degree of deterioration of the developer calculated by the calculating unit is relatively large, the cleaning unit sets the difference in potential ΔVb to a value on a side of a same polarity as the normal charging polarity, as compared to when the degree of wear of the charging member and/or the degree of deterioration of the developer calculated by the calculating unit is relatively small.

12. An image forming apparatus, comprising:

an image bearing member on which an electrostatic latent image is formed;

a developer bearing member which bears a developer for developing the electrostatic latent image formed on the image bearing member;

a developer supplying member which supplies the developer to the developer bearing member;

an intermediate transfer member which is provided with a transfer unit and in which a developer image developed on the image bearing member is primarily transferred to the transfer unit due to the transfer unit and the image bearing member coming into contact with each other and the developer image is further secondarily transferred from the transfer unit to a recording material due to the transfer unit and the recording material coming into contact with each other;

a charging member which charges the developer on the intermediate transfer member; and a cleaning unit capable of executing a cleaning mode in which the developer remaining on the intermediate transfer member after being secondarily transferred from the intermediate transfer member to the recording material is charged by the charging member and removed from the intermediate transfer member, wherein when executing the cleaning mode during a non-image formation period in which an image is not formed, the cleaning unit reduces an absolute value of a voltage applied to the charging member and, at the same time, sets a difference in potential ΔVs of a voltage applied to the developer supplying member relative to a voltage applied to the developer bearing member to a value on a side of an opposite polarity to a normal charging polarity of the developer, as compared to when executing the cleaning mode during an image formation period in which an image is formed.

13. The image forming apparatus according to claim 12, wherein the cleaning unit sets the difference in potential ΔVs to approximately 0 V.

14. The image forming apparatus according to claim 12, further comprising a calculating unit which calculates a degree of wear of the charging member and/or a degree of deterioration of the developer, wherein the cleaning unit changes the difference in potential ΔVs based on a result of a calculation by the calculating unit.

15. The image forming apparatus according to claim 14, wherein when the degree of wear of the charging member and/or the degree of deterioration of the developer calculated by the calculating unit is relatively large, the cleaning unit sets the difference in potential ΔVs to a value on a side of an opposite polarity to the normal charging polarity, as compared to when the degree of wear of the charging member and/or the degree of deterioration of the developer calculated by the calculating unit is relatively small.

16. An image forming apparatus, comprising:

an image bearing member on which an electrostatic latent image is formed after a surface of the image bearing member is charged;

a developer bearing member which bears a developer for developing the electrostatic latent image formed on the image bearing member;

an intermediate transfer member which is provided with a transfer unit and in which a developer image developed on the image bearing member is primarily transferred to the transfer unit due to the transfer unit and the image bearing member coming into contact with each other and the developer image is further secondarily transferred from the transfer unit to a recording material due to the transfer unit and the recording material coming into contact with each other;

a transfer member for primarily transferring the developer image from the image bearing member to the intermediate transfer member;

a charging member which charges the developer on the intermediate transfer member; and a cleaning unit capable of executing a cleaning mode in which the developer remaining on the intermediate transfer member after being secondarily transferred from the intermediate transfer member to the recording material is charged by the charging member and removed from the intermediate transfer member, wherein when executing the cleaning mode during a non-image formation period in which an image is not formed, the cleaning unit reduces an absolute value of a voltage applied to the charging member and, at the same time, varies an absolute value of a difference in potential Vback between a voltage applied to the developer bearing member and a surface voltage prior to formation of an electrostatic latent image on the charged image bearing member, as compared to when executing the cleaning mode during an image formation period in which an image is formed.

17. The image forming apparatus according to claim 16, wherein when executing the cleaning mode during the non-image formation period, the cleaning unit sets a polarity of a voltage applied to the transfer member to a same polarity as a normal charging polarity of the developer, and as compared to when executing the cleaning mode during the image formation period, reduces an absolute value of the voltage applied to the charging member and, at the same time, reduces an absolute value of a difference in potential Vback between the voltage applied to the developer bearing member and the surface voltage prior to formation of the electrostatic latent image on the charged image bearing member.

18. The image forming apparatus according to claim 16, wherein when executing the cleaning mode during the non-image formation period, the cleaning unit sets a polarity of a voltage applied to the transfer member to a different polarity from a normal charging polarity of the developer, and as compared to when executing the cleaning mode during the image formation period, reduces an absolute value of the voltage applied to the charging member and, at the same time, increases an absolute value of a difference in potential Vback between the voltage applied to the developer bearing member and the surface voltage prior to formation of the electrostatic latent image on the charged image bearing member.

19. The image forming apparatus according to claim 16, further comprising a calculating unit which calculates a degree of wear of the charging member and/or a degree of deterioration of the developer, wherein the cleaning unit changes the difference in potential Vback based on a result of a calculation by the calculating unit.

20. The image forming apparatus according to claim 8, wherein the developer bearing member is arranged so as to come into contact with the image bearing member, and the image bearing member is arranged so as to come into contact with the intermediate transfer member.

21. The image forming apparatus according to claim 8, wherein in the cleaning mode executed during the image formation period, the developer remaining on the intermediate transfer member without being secondarily transferred is first charged by the charging member with an opposite polarity to the normal charging polarity, and when the developer on the image bearing member is primarily transferred to the intermediate transfer member, the developer remaining on the intermediate transfer member is transferred to the image bearing member and cleaned.

22. The image forming apparatus according to claim 8, further comprising a transfer member for primarily transferring the developer image from the image bearing member to the intermediate transfer member, wherein in the cleaning mode executed during the non-image formation period, a voltage with a same polarity as the normal charging polarity is applied to the transfer member, and the developer remaining on the intermediate transfer member is transferred to the image bearing member and cleaned.

23. The image forming apparatus according to claim 8, wherein the charging member is formed of a roller member and/or a brush member.

24. An image forming apparatus, comprising:

an image bearing member on which an electrostatic latent image is formed;

an image bearing member charging unit which applies an image bearing member charging voltage for charging the image bearing member;

a developer bearing member to which a developing voltage is applied and which bears and transports a developer in order to develop the electrostatic latent image formed on the image bearing member;

a primary transfer unit which primarily transfers a developer image developed on the image bearing member to an intermediate transfer member, the primary transfer unit having a primary transfer voltage applying unit; and a charging member which applies a voltage to the intermediate transfer member so that the developer on the intermediate transfer member can be charged, the developer image being first primarily transferred to the intermediate transfer member by the primary transfer unit and then secondarily transferred to a recording material from the intermediate transfer member to form an image on the recording material, wherein the image forming apparatus operates in:

a first mode in which the developer remaining on the intermediate transfer member after the developer image is secondarily transferred to the recording material is charged by the charging member and electrostatically removed from the intermediate transfer member; and a second mode in which the developer existing on the intermediate transfer member is electrostatically removed from the intermediate transfer member and onto the image bearing member, and in the second mode, the intermediate transfer member is driven in a state in which an absolute value of the voltage applied to the charging member is lower than that in the first mode, and in which the developer bearing member and the image bearing member are in contact with each other, and wherein, when a polarity of a primary transfer voltage in the second mode is a positive polarity, a difference in potential between the developing voltage and the image bearing member charging voltage in the second mode is set to be greater than that in the first mode.

25. The image forming apparatus according to claim 24, wherein the first mode is a mode in which, after the developer remaining on the intermediate transfer member without being secondarily transferred is charged by the charging member with an opposite polarity to a normal charging polarity of the developer, and when primary transfer is performed, the developer is recovered by the image bearing member.

26. The image forming apparatus according to claim 24, wherein at least a part of the developer developed on the image bearing member is a fogging developer developed in a portion in which the electrostatic latent image is not formed, and when a charge quantity or a charging polarity of the fogging developer which is developed by the difference in potential between the developing voltage and the image bearing member charging voltage in the second mode is compared with a charge quantity or a charging polarity of the fogging developer which is developed by the difference in potential between the developing voltage and the image bearing member charging voltage in the first mode, at least one of the charge quantity and the charging polarity differs.

27. The image forming apparatus according to claim 24, wherein the second mode is a mode executed during cleaning after a paper jam occurs or after executing a density adjusting mode.

28. The image forming apparatus according to claim 24, wherein the image forming apparatus has a plurality of image forming units including the image bearing member, the image bearing member charging unit, and the developer bearing member.

29. The image forming apparatus according to claim 28, wherein in the second mode, after the developer remaining on the intermediate transfer member is charged by the charging member with the normal charging polarity of the developer, the developer remaining on the intermediate transfer member is recovered by applying a voltage with the normal charging polarity of the developer by the primary transfer unit corresponding to at least one of the plurality of image forming units.

30. The image forming apparatus according to claim 24, wherein when the polarity of the primary transfer voltage in the second mode is a negative polarity, the difference in potential between the developing voltage and the image bearing member charging voltage in the second mode is set to be lower than that in the first mode.

31. The image forming apparatus according to claim 24, wherein the difference in potential between the developing voltage and the image bearing member charging voltage in the second mode is changed in accordance with at least one of a degree of wear of the charging member and a degree of deterioration of the developer.

32. The image forming apparatus according to claim 1, comprising:

a first image forming station including a first image bearing member and a first primary transfer unit, and a second image forming station including a second image bearing member and a second primary transfer unit, wherein, in the second mode, the first primary transfer unit is applied with a voltage that has a polarity opposite to the normal charging polarity of the developer, and the second primary transfer unit is applied with a voltage that has a polarity the same as the normal charging polarity of the developer.

33. The image forming apparatus according to claim 24, comprising:

a first image forming station including a first image bearing member and a first primary transfer unit, and a second image forming station including a second image bearing member and a second primary transfer unit, wherein, in the second mode, the first primary transfer unit is applied with a voltage that has a polarity opposite to a normal charging polarity of the developer, and the second primary transfer unit is applied with a voltage that has a polarity the same as the normal charging polarity of the developer.

34. The image forming apparatus according to claim 6, wherein the normal charging polarity of the developer is a negative polarity.

35. The image forming apparatus according to claim 24, wherein a normal charging polarity of the developer is a negative polarity.

* * * * *